US009954307B2

(12) United States Patent
Tait

(10) Patent No.: US 9,954,307 B2
(45) **Date of Patent: *Apr. 24, 2018**

(54) CONNECTOR PLUG AND SOCKET HAVING A WIRE CLAMPING CONFIGURATION

(71) Applicant: Cameron Stuart Tait, Killarney (AU)

(72) Inventor: Cameron Stuart Tait, Killarney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/425,076

(22) Filed: Feb. 6, 2017

(65) Prior Publication Data

US 2017/0149170 A1 May 25, 2017

Related U.S. Application Data

(63) Continuation-in-part of application No. 14/790,339, filed on Jul. 2, 2015, now Pat. No. 9,608,342, which (Continued)

(30) Foreign Application Priority Data

Mar. 28, 2013 (AU) ..... 2013901088
Sep. 19, 2014 (AU) ..... 2014903740
Dec. 1, 2016 (AU) ..... 2016904942

(51) Int. Cl.
*H01R 4/24* (2006.01)
*H01R 13/58* (2006.01)
(Continued)

(52) U.S. Cl.
CPC ..... *H01R 13/5816* (2013.01); *H01R 13/506* (2013.01); *H01R 4/26* (2013.01); *H01R 4/70* (2013.01)

(58) Field of Classification Search
CPC ..... H01R 134/26; H01R 13/5829
(Continued)

(56) References Cited

U.S. PATENT DOCUMENTS 3,217,282 A 11/1965 Chevalier et al.
4,047,784 A * 9/1977 Trank ..... H01R 4/2433 439/403

(Continued)

FOREIGN PATENT DOCUMENTS

EP 0653810 5/1995

OTHER PUBLICATIONS

Australian Patent Application No. 2013901088 Office Exam Report dated Oct. 4, 2013.

(Continued)

*Primary Examiner* — Tho D Ta
(74) *Attorney, Agent, or Firm* — Perkins Coie LLP

(57) ABSTRACT

A plug (301) adapted to hold a wire (320) and to be received within a socket (330). The plug (301) comprises a plug body (302) comprising at least two plug body portions (500) that are connected to a plug body end (305), and a passage (307) extending substantially along a central longitudinal axis (501) of the plug body (302) for receiving the wire (320). The plug body (302) is configurable in a first wire-receiving configuration so that the wire (320) can be placed within the passage (307) and a second clamping configuration so that the plug body (302) can clamp to and retain the wire (320) within the passage (307) such that conducting strands (321) of the wire (320) extend substantially along the central longitudinal axis (501) of the plug body (302). The at least two plug body portions (500) are moveable away from the central longitudinal axis (501) into the first wire-receiving configuration, and are moveable towards the central longitudinal axis (501) into the second clamping configuration.

20 Claims, 29 Drawing Sheets

Related U.S. Application Data is a continuation-in-part of application No. PCT/AU2014/000306, filed on Mar. 24, 2014.

(51) Int. Cl.
*H01R 13/506* (2006.01)
*H01R 4/70* (2006.01)
*H01R 4/26* (2006.01)

(58) Field of Classification Search
USPC ..... 439/409
See application file for complete search history.

(56) References Cited

U.S. PATENT DOCUMENTS

| | | | | |
|---|---|---|---|---|
| 4,451,104 | A | 5/1984 | Hodgson et al. | |
| 4,508,409 | A | 4/1985 | Cherry et al. | |
| 4,612,423 | A | 9/1986 | Munroe | |
| 4,634,205 | A | 1/1987 | Gemra | |
| 5,076,806 | A | 12/1991 | Hotea et al. | |
| 5,306,195 | A | 4/1994 | Hayashi | |
| 5,681,179 | A | 10/1997 | Lane | |
| 6,168,455 | B1 | 1/2001 | Hussaini | |
| 7,211,725 | B1 | 5/2007 | Tait | |
| 7,425,153 | B1 | 9/2008 | Miller | |
| 7,713,081 | B2 * | 5/2010 | Chen | H01R 9/037 439/409 |
| 7,922,516 | B2 | 4/2011 | Temblador et al. | |
| 8,192,224 | B2 * | 6/2012 | Schmidt | H01R 24/64 439/409 |
| 8,702,444 | B2 * | 4/2014 | Maranto | H01R 13/5829 439/418 |
| 2004/0072461 | A1 | 4/2004 | Matsuda et al. | |

OTHER PUBLICATIONS

Australian Patent Application No. 2015201133 Office Exam Report dated May 7, 2015.
European Search Report and Written Opinion dated Jul. 21, 2016 for European Application No. 14775475.8.
PCT/AU2014/000306 International Preliminary Report on Patentability dated Feb. 4, 2015.
PCT/AU2014/000306 International Search Report dated Jun. 26, 2014.

* cited by examiner

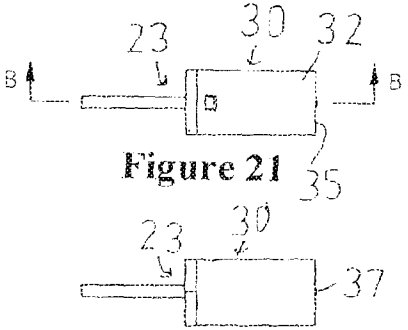
Figure 21
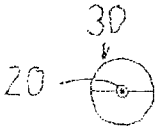
Figure 22
Figure 23
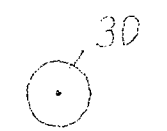
Figure 24
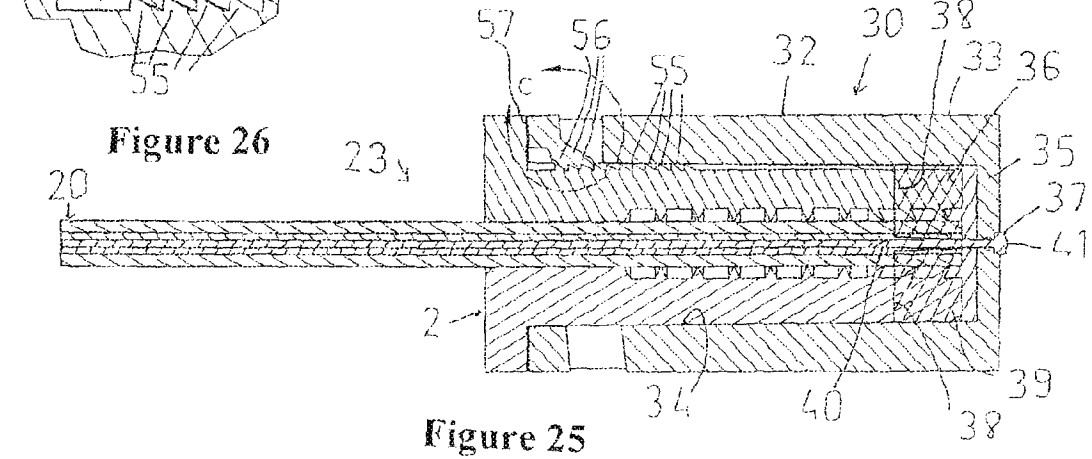
Figure 25
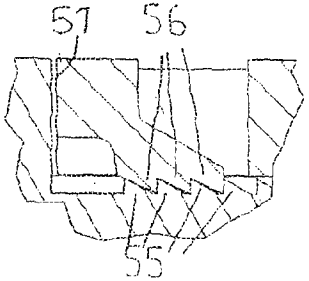
Figure 26

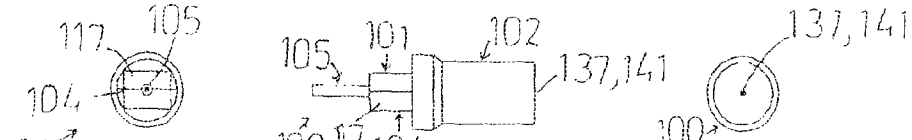
Figure 65
Figure 62
Figure 63
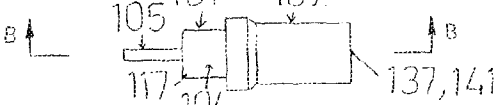
Figure 64
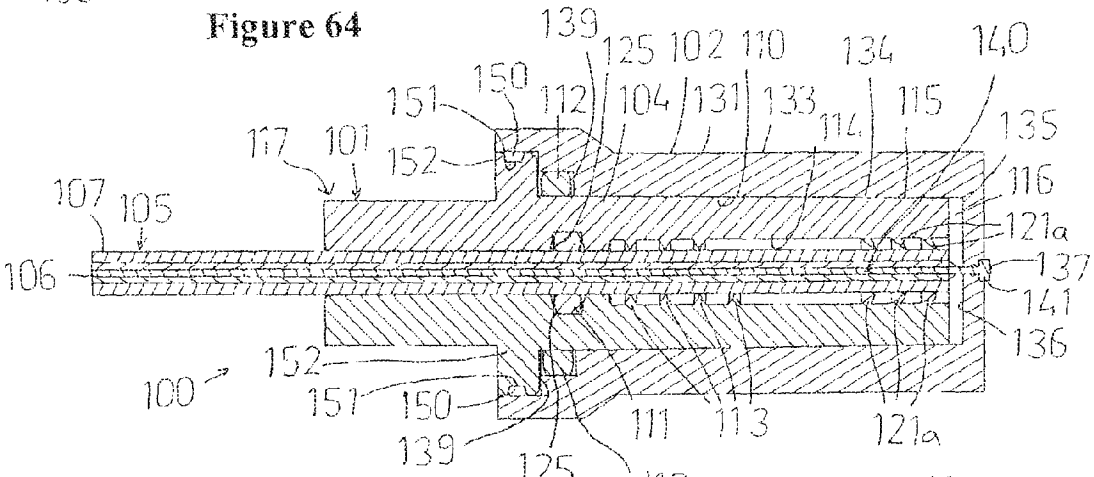
Figure 66

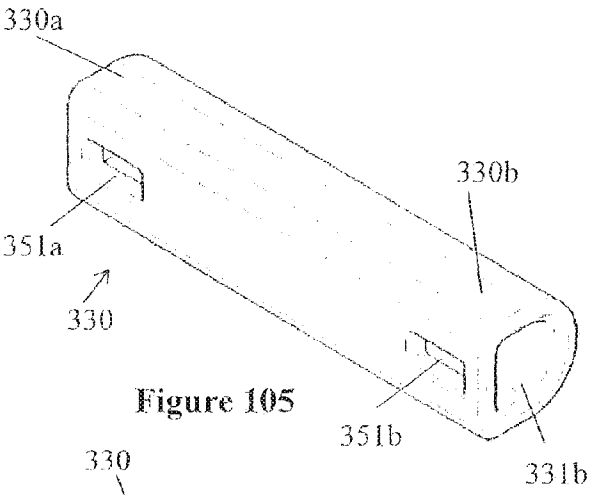
Figure 105
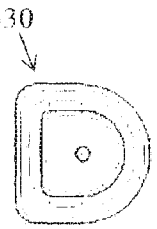
Figure 112
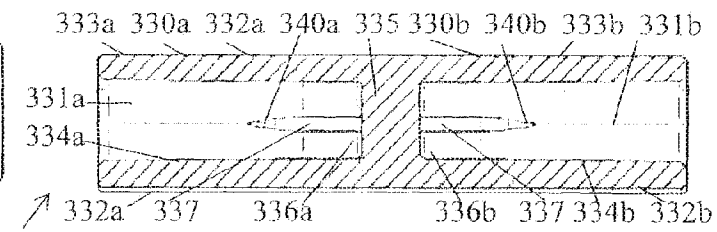
Figure 107
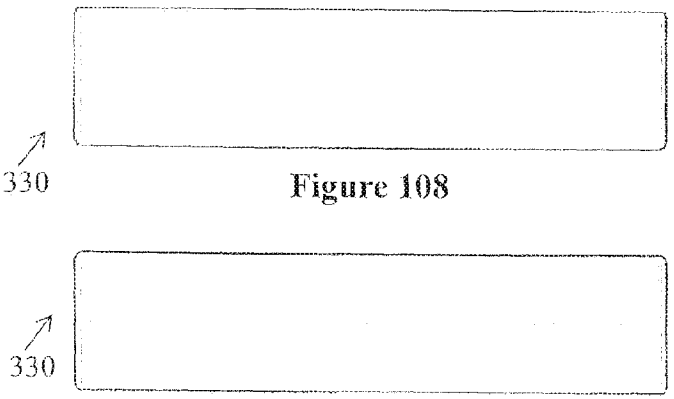
Figure 108
Figure 109
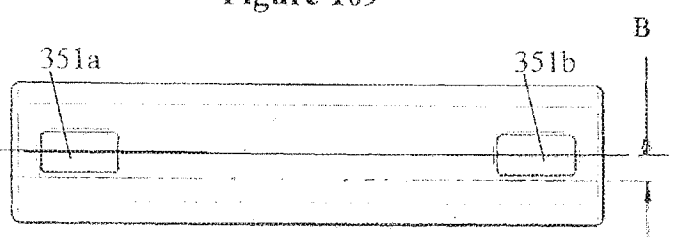
Figure 106
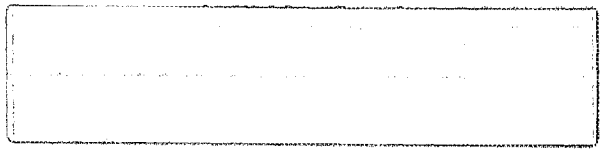
Figure 110
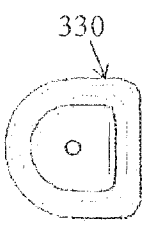
Figure 111

CONNECTOR PLUG AND SOCKET HAVING A WIRE CLAMPING CONFIGURATION

This application is a continuation in part of United States of America Patent Application No. U.S. Ser. No. 14/790,339 filed 2 Jul. 2015, which in turn is a continuation in part of International Patent Application No. PCT/AU2014/000306 filed 24 Mar. 2014 which designates the United States of America, and claims priority of Australian Provisional Application No. 2013901088 filed 28 Mar. 2013, Australian Provisional Application No. 2014903740 filed 19 Sep. 2014 and Australian Provisional Application No. 2016904942 filed 1 Dec. 2016. The entire contents of each of the forgoing are incorporated herein by cross-reference.

TECHNICAL FIELD

The present invention generally relates, inter alia, to a plug, a socket and to a connection apparatus for making an electrical or data connection.

BACKGROUND ART

It will be clearly understood that, if a prior art publication is referred to herein, this reference does not constitute an admission that the publication forms part of the common general knowledge in the art in Australia or in any other country.

Electrical connectors for connecting one conductor to another are known. One such connector is described in the present applicant's earlier patent, U.S. Pat. No. 7,211,725. However, a problem with that connector is that there are some applications where it is difficult to insert the conductors into the patented connector, particularly when flexible cables are to be inserted to make the electrical connection. It can also be difficult to insert the cable in cramped situations or locations having access limited by configuration of the location, presence and/or orientation of other equipment and such like, or where the size of the cable is too small to afford sufficient pushing force into the connector.

Most commercially available electrical connectors are not suited to making electrical connections in moist or wet environments. In marine applications, in particular, direct contact of an electrical connection with, or even immersion in, water can occur, requiring the electrical conductors to be adequately insulated. Even if the electrical connection is kept away from direct contact with water, a hygroscopic plaque can build up on the surface, the plaque often being highly conductive due to its electrolyte content. It is therefore necessary to ensure electrical conductors are kept insulated electrically and separated physically from the environment whilst at the same time making a reliable electrical connection to an appliance or another conductor.

Although the connector of U.S. Pat. No. 7,211,725 provides a satisfactory solution to the problems associated with electrical connections in moist environments in many situations, it still suffers from the problem described above.

Another problem with the connector of U.S. Pat. No. 7,211,725 is that, because it is generally used to connect two wires together, it cannot be used to capture and incorporate an end of a wire into a type of plug that can then be plugged into a socket of an electrical appliance so as to make an electrical connection.

SUMMARY OF INVENTION

It is an object of the invention to provide a plug, socket or connection apparatus that minimises or overcomes a problem addressed above. An alternative object is to provide a plug, socket or connection apparatus for electrical use or other than for electrical use. An alternative object is to provide the public with a useful or commercial choice.

In a first aspect, the invention concerns: a plug for holding a wire and for being received within a socket (or a plug adapted to hold a wire and to be received within a socket), said plug comprising: a plug body and a passage extending axially within the plug body for receiving a wire, wherein the plug body is configurable in a first wire-receiving configuration so that a wire can be placed within the passage and a second clamping configuration so that the plug body can clamp to and retain the wire within the passage.

In a second aspect, the invention concerns a plug for holding a wire (or a plug adapted to hold a wire), said plug comprising: a plug body comprising: an inside face and an outside face; a passage extending axially within the plug body for receiving a wire; and at least one gripping formation extending inwardly from the inside face for gripping a wire when located within the passage, wherein the plug body is configurable in a first wire-receiving configuration so that a wire can be placed within the passage and a second clamping configuration so that the plug body can clamp to and retain the wire within the passage when the plug has been received within a socket.

In a third aspect, the invention concerns a plug assembly comprising the plug as defined according to the first aspect or second aspect and a wire.

In a fourth aspect, the invention concerns a socket for receiving at least one plug as defined according to the first aspect or second aspect, or the plug assembly according to the third aspect.

In a fifth aspect, the invention concerns a connection apparatus comprising: the plug as defined according to the first aspect or second aspect, or the plug assembly as defined according to the third aspect; and/or the socket as defined according to the fourth aspect.

In a sixth aspect, the invention concerns a method of forming a connection and optionally an electrical connection comprising the steps of: locating a wire within a plug as defined according to the first or second aspect; and receiving the plug within a socket according to the fourth aspect that optionally comprises an electrical conductor.

The plug can be of any suitable size, shape and construction, and can be made of any suitable material or materials. The plug can comprise a single component or possibly more than one component. In some embodiments, the plug can comprise a plug body that directly or indirectly engages a socket.

Any suitable type of wire can be held by the plug. The wire can be rigid or flexible. The wire can comprise rigid or malleable conducting filaments or strands and an insulating exterior coating or sheath made of plastics material or rubber, for example. The wire can be in the form of a cable having interwoven conducting strands and a sheathed/coated exterior.

The wire can have a substantially circular cross-section. Preferably the wire comprises a round plastic sheathed/coated exterior that contains centrally extending conducting filaments or strands. The wire can be of any suitable gauge. Preferably the wire gauge is anywhere from between about 0.5 mm and about 6 mm, and more preferably between about 2 mm and 4 mm. In the second clamping configuration, preferably the conducting filaments extend substantially along the central longitudinal axis of the plug body.

The plug body can be of any suitable size, shape and construction and can be made of any suitable material or materials. In a preferred embodiment the plug body is made of a non-conductive material or materials, such as plastics material or rubber.

In an embodiment, the plug body can be of unitary construction and can be manipulated to adopt the second clamping configuration. This may be possible, for example, by way of two or more plug body portions being hinged together and moveable via at least one hinge or at least one hinge region into the second clamping configuration. In the first wire-receiving configuration the plug body portions can be moved away from the central longitudinal axis so as to receive a wire and in the second clamping configuration the plug body portions can be moved towards the central longitudinal axis so as to hold the wire there between. This may be possible, for example, by way of two or more plug body portions being flexible and movable relative to the central longitudinal axis of the plug body, wherein in the first wire-receiving configuration the plug body portions can be flexed away from the central longitudinal axis so as to receive a wire and in the second clamping configuration the plug body portions can be flexed towards the central longitudinal axis so as to hold the wire there between.

The plug body can have a first end and a second end that is opposite the first end. The plug body can have socket receiving end. In some embodiments, only one end of the plug body is received within a socket. In some other embodiments, both ends of the plug body are received within a socket.

In some embodiments, the plug body comprises two body portions hinged together at an end of the plug body using at least one hinge or at least one hinge region. The hinge or hinge region may be in the form of one or more fold lines or a region relative to which the plug body portions can move. The two body portions can be of similar length and shape. The plug body can resemble a split sleeve or split tube substantially sealed or semi-sealed at the plug body end. When in the second clamping configuration the body portions may or may not directly contact each other along their entire or substantially entire body portion lengths as they may be spaced apart by the wire. In some embodiments, when clamping a wire in the second clamping configuration, non-hinged ends or regions of the body portions may be spaced from each other.

In some embodiments, the plug body comprises two body portions connected together at an end of the plug body. The body portions can be flexed or bent relative to the plug body end. The two body portions can be of similar length and shape. The plug body can resemble a split sleeve or split tube substantially sealed or semi-sealed at the plug body end. When in the second clamping configuration the body portions may or may not directly contact each other along their entire or substantially entire body portion lengths as they may be spaced apart by the wire. In some embodiments, when clamping a wire in the second clamping configuration, non-hinged ends or regions of the body portions may be spaced from each other.

In some embodiments, the plug body comprises two substantially identical or similar body portions hinged together at an end of the plug body using at least one hinge or at least one hinge region. The hinge or hinge region may be in the form of one or more fold lines or a region from which the plug body portions can bend or flex. The substantially identical or similar body portions can be like a sleeve or tube split into longitudinal halves and hinged at one end, or a sleeve or tube substantially sealed or semi-sealed at one end (end wall of the plug body) and split into longitudinal halves and hinged at one end. When in the second clamping configuration the body portions may or may not directly contact each other along their entire or substantially entire body portion lengths as they may be spaced apart by the wire. In some embodiments, when clamping a wire in the second clamping configuration, the body portions may be spaced from each other in relation to their non-hinged ends.

In some embodiments, if received directly by a socket, the plug body can comprise two substantially identical or similar body portions hinged together at a socket receiving end of the plug body (or optionally at the other end of the plug body), using at least one hinge or at least one hinge region. The hinge or hinge region may be in the form of one or more fold lines or a region from which the plug body portions can bend or flex. The substantially identical or similar body portions can be like a sleeve or tube split into longitudinal halves and hinged at the socket receiving end (or optionally at the other end of the body), or a sleeve or tube substantially sealed or semi-sealed at one end (end wall of the plug body) and split into longitudinal halves and hinged at one end. When in the second clamping configuration the body portions may or may not directly contact each other along their entire or substantially entire body portion lengths as they may be spaced apart by the wire. In some embodiments, when clamping a wire in the second clamping configuration, non-hinged ends or regions of the body portions may be spaced from each other.

The plug body can be in the form of a (split) sleeve or tube extending completely or incompletely around the wire when in the second clamping configuration and the (split) sleeve or tube can be of any suitable cross-section. For example, the (split) sleeve or tube can be of arcuate cross-section, circular cross-section or of substantially circular cross-section when in the second clamping configuration. Alternatively, the (split) sleeve or tube can be of substantially triangular, rectangular or other geometrical cross-section when in the second clamping configuration. For example, the (split) sleeve or tube can have a generally D-shaped cross-section when viewed in end elevation (ie. a substantially rectangular cross-section with two rounded corners to provide an arcuate face/wall).

The inside and outside faces of the plug body can be of similar or differing cross-sections, profiles or shapes.

In some embodiments, the plug body end opposite the socket receiving end can be enlarged. For example, in one embodiment, the enlarged end can be in the form of a circumferentially extending flange. The flange may be gripped with fingers or using a pair of pliers particularly when the plug body is in a second clamping configuration. The flange can abut the socket when the plug body has been received within the socket. The flange can sealingly engage the socket.

The flange can be of circular cross-section or of substantially circular cross-section when in the second clamping configuration. Alternatively, the flange can be of a substantially triangular, rectangular or other geometrical cross-section when in the second clamping configuration. For example, the flange can have a substantially D-shaped cross-section when viewed in end elevation.

For example, in another embodiment, the enlarged end can be sized and shaped so as to be easily gripped with fingers or a pair of pliers particularly when the plug body is in a second clamping configuration. The enlarged end (or head) can be of any suitable size and shape. In some embodiments, the enlarged end or head is substantially cuboid in shape, substantially in the shape of a cylinder, substantially in the shape of a rectangular prism, or of substantially D-shaped cross-section, for example.

The passage extending axially within the plug body for receiving a wire can extend completely through a central region of the plug body or partway along the plug body. Preferably, the passage extends centrally along a longitudinal axis of the plug body, completely through the plug body, including the ends/end wall/enlarged end/head of the plug body. Alternatively, one end of the passage, such as at the socket receiving end, could be blind or substantially blind, so as to completely or almost completely insulate/isolate an end of the wire—depending on the intended use (ie. non-electrical connection).

The passage can snugly receive the wire. The diameter of the passage and inside face of the plug body can vary depending on the gauge of the wire. The part of the passage extending through the enlarged end or head can be used to check wires for appropriate gauge size/diameter. When in the second clamping configuration the inside face can have a cross-section shaped to snugly receive a wire having a circular cross-section (ie. a round wire) such that conducting strands of the wire extend along the central longitudinal axis of the plug body.

The at least one gripping formation can be of any suitable size, shape and construction. The at least one gripping formation can comprise one or more gripping teeth extending along the inside face of the plug body. Preferably the at least one gripping formation comprises one or more gripping teeth that are pointed in a direction that prevents or minimises the risk of the wire being pulled out of the passage in an axial direction. The wire can be snugly or tightly received by the gripping formation.

Preferably the gripping teeth extend around the inside face and are spaced along the longitudinal axis. Preferably the teeth are pointed perpendicularly towards the central longitudinal axis, or toward the socket receiving end, or toward the other end of the plug body.

The tooth or teeth of the at least one gripping formation may or may not deflect when gripping or biting into the wire. That is, the tooth or teeth may be flexible or rigid in differing circumstances depending on the nature of the wire—for example, whether insulated or not, and whether flexible or malleable or not. The gripping teeth can preferably grip or bite into the wire, particularly the exterior insulating coat or sheath of the wire.

The at least one gripping formation can extend inwardly from the inside face and grip opposed sides of the wire when located within the passage.

In an embodiment, the at least one gripping formation can be provided as a plurality of axially spaced circumferentially running ridges having a parallelogram shaped cross-section circumferentially, the parallelogram leaning towards an end of the plug body, preferably the socket receiving end of the plug body (but this need not be the case).

In another embodiment, the at least one gripping formation can be provided as a plurality of axially spaced circumferentially running ridges having a pointed end or edge leaning towards an end of the plug body, preferably the socket receiving end of the plug body (but this need not be the case).

In some embodiments the connection apparatus can be used to make a connection to another wire or wires, or to an electrical appliance, equipment or device in a waterproof or fluid-tight manner in a moist or wet environment. To that end, the plug, socket and/or connection apparatus can comprise a sealing arrangement or sealing means. The sealing arrangement or sealing means can be, for example, in the form of one or more O-rings/sealing members, one or more sealing formations, and/or sealant such as chemical sealant. Preferably chemical sealant is used to render the connection fluid-tight or waterproof.

The socket can provide an electrical connection with another wire or other type of conductor, or simply help isolate/insulate an end of the wire from electrical contact or the elements, such as rain or moisture. Alternatively, the socket could be used as a means of labelling/identifying the wire/nature of the wire/intended purpose for the wire, in addition to making an electrical connection or not. That is, the sealing arrangement need not be present.

The (electrical or non-electrical) conductor can be of any suitable size, shape and construction, and can be made of any suitable material or materials (preferably highly conductive material such as metal). In some embodiments the conductor can be in the form of a pin, wire or spike, of any suitable size and shape. In some embodiments the conductor can be in the form of a plate, strip, terminal or tab, of any suitable size and shape.

In an embodiment, the socket can contain a conductor and can convert the plug assembly into a type of plug that can then be plugged into an electrical appliance, equipment or device. An electrical appliance, equipment or device (as used throughout this specification) includes, but is not limited to, anything of an electrical or electronic nature, or anything used in the transfer or transmission of data. That is, the electrical connection can be made for data transmission purposes. An electrical appliance, equipment or device (as used throughout this specification) also includes, but is not limited to, a major appliance, microcontroller, power tool or small appliance, or a component part of an electrical distribution system such as an electric switchboard, distribution board, circuit breaker or disconnect, electricity meter or transformer.

Therefore, the method according to the sixth aspect can comprise the step of using the socket containing the plug assembly (the connection apparatus) as a plug/connector to be received within a socket of an electrical appliance, equipment or device.

In another embodiment, the socket can be in the form of an opening in a circuit board or other type of electrical appliance, equipment or device for receiving the plug or plug assembly, for either isolating the wire or making an electrical connection with one or more other wires or other types of conductors. Put another way, a main body of the socket and electrical conductor etc may be provided by the electrical appliance, equipment or device itself.

Therefore, the socket can be of any suitable size, shape and construction and can be made of any suitable material or materials. For example, in an embodiment, the socket is merely an opening in an electrical appliance, equipment or device. For example, in another embodiment, the socket is in the form of a sleeve comprising a main body and a central opening for receiving the plug/plug assembly, for either isolating the wire or making an electrical connection with one or more other wires or conductors. The central opening can be blind or not.

The socket main body and end wall can be of unitary construction or comprise multiple connectable pieces. The socket main wall and end wall can be made of any suitable non-conductive material or materials such as plastics material, rubber, carbon fibre, insulated metal or ceramics material. The socket main wall and end wall can preferably be made of plastics material, and may have a Shore D hardness of approximately 85+ or 100-120R Rockwell.

In one embodiment the socket can comprise an opening extending axially within a main body for receiving the plug, preferably the socket receiving end of the plug body. The main body can have an outer face and an inner face that extends around the opening. The socket can comprise an end wall that borders a blind end of the opening. The main body can be in the form of a sleeve or tube having a sealed/blind end. The other end of the sleeve can be flared or the main body can have a stepped interior. The sleeve or tube can be of any suitable cross section, but preferably is of circular cross-section or of substantially circular cross-section. Alternatively, the main body (sleeve or tube) can be of substantially triangular, substantially rectangular, substantially D-shaped (ie generally rectangular but an arcuate face in place of two right-angle corners), or other geometrical cross-section. The inner and outer faces can be of similar or different cross-sections, profiles or shapes. Preferably, the main body is shaped to snugly receive the plug body and/or plug. That is, preferably the outer surface of the plug body is snugly received by the inner face/opening of the socket main body.

The plug can be adapted to be received within the socket in any suitable way. That is, the connection apparatus can comprise at least one male and female formation or at least one engagement formation enabling the plug body to be received within an opening in the socket and to be held or locked in place within the socket opening.

For example, the outside face of the plug body can have at least one male or female formation that engages at least one male or female formation of the socket main body. For example, the at least one engagement formation can comprise the outside face of the plug body having one or more engagement formations for engagement with one or more complementary engagement formations of the socket main body.

In one embodiment, the outside face of the plug body can have one or more teeth that engage one or more teeth located at the main body inner face. For example, the teeth can be in the form of a pawl and ratchet arrangement whereby the teeth of the pawl engage the ratchet teeth as the plug body is inserted into the socket opening. The pawl can be hinged to the main body of the socket and the teeth of the pawl can extend adjacent the inner face of the main body.

In one embodiment, the at least one engagement formation comprises a plurality of circumferentially extending grooves or slots in regular spaced relationship axially along the outside face of the plug body. Preferably, the grooves have a saw-tooth configuration and extend circumferentially such that the engagement formations and complementary engagement formations of the socket main body engage and lock together.

In one embodiment, the outside face of the plug body can have at least one flexibly resilient tooth that engages and locks within at least one recess or opening in the socket main body. That is, when first pushing the plug body into the socket, the at least one tooth can be flexed from its resting position by the socket main wall towards the wire. However, when the at least one tooth engages the at least one recess or opening in the socket main body, then the at least one tooth can flex back into its resting position and lock within the recess or opening. That is, an edge, shoulder of the tooth can abut an edge of the recess or opening to prevent the plug from being pulled out from within the socket. However, it is possible to release the plug from the socket by way of manually disengaging the at least one tooth from the at least one recess or opening—thereby allowing re-use of the plug and socket.

The connection apparatus can comprise a guide for aligning the plug body with the socket main body and guiding it axially within the opening in the socket. The guide can be of any suitable form.

In some embodiments the guide can be in the form of the plug and socket having a keyway and key arrangement for aligning the plug body with the socket main body and guiding it axially within the opening in the socket. The guide can incorporate some of the at least one engagement formation or male and female formations as described above, but this need not be the case.

In some embodiments, the plug body and socket opening can be shaped such that the plug body can only be inserted into the socket opening one way. For example, the plug outer body can be generally D-shaped when viewed in end elevation and the socket opening can likewise be generally D-shaped when viewed in end elevation.

An external diameter of the plug body can narrow or taper and a diameter of the socket opening can narrow or taper in a similar manner. Preferably, a diameter of an outer face of the plug body narrows or tapers as it extends from the enlarged end towards the plug end/end wall, and the socket opening diameter narrows or tapers in a similar axial direction so as to assist with insertion of the plug body into the socket and with manufacturing—ie. to alleviate stickiness during the moulding process.

In an embodiment the socket can comprise an opening extending axially within a main body for receiving the socket receiving end of the plug body. The main body can have an outer face and an inner face that borders the opening. The socket can have an end wall that borders a blind end of the opening. The socket can comprise an electrical conductor located adjacent the end wall of the socket at the blind end of the opening, for contacting the wire located within the plug. That is, as the plug body is inserted into the opening in the socket, a conducting filament of the wire within the plug makes an electrical connection with the conductor. In one embodiment, the conductor is flat or raised and adjacent the end wall of the socket. In another embodiment, the conductor is in the form of a penetrator—spike or pin, for example—for penetrating the wire when the wire of the plug is inserted into the opening in the socket. Preferably the penetrator is capable of penetrating the external insulating coating of the wire in the event that the filament is not exposed.

The conductor, such as the penetrator, can extend through the end wall of the socket to an exterior of the socket end wall to provide another electrical point of contact. If the conductor extends to an exterior of the end wall as a pin or other point of electrical contact then the socket/connection apparatus can function as an electrical plug that can be plugged into an electrical appliance, equipment or device. That is, the plug captures an end of the wire to form a plug assembly, the plug assembly is received by the socket to make an electrical connection within the socket, and the socket itself serves as a plug that can be plugged into an electrical appliance, equipment or device so as to make another electrical contact by virtue of the exposed conductor (pin or other point of electrical contact) with the electrical appliance, equipment or device. That is, the plug and socket can serve as an adapter plug for the wire.

If a non-electrical connection is required (eg. when merely isolating the end of the wire), the socket can be devoid of any electrical conductor adjacent the end wall of the socket.

Any suitable type of chemical sealant/s can be used to render the connection waterproof or fluid-tight. The chemical sealant/s may set, for example, when exposed to air, moisture, light or heat, or when different sealant components mix with one another. Suitable chemical sealants include non-conductive sealants that coat the wire and stick to the plug body and socket main body, although binding with the bodies may not be essential. Suitable chemical sealants include those that have adhesive properties. Preferably the chemical sealant/s is free flowing and hardens when exposed to air or when two sealant components are mixed together.

The term 'sealant' as defined herein is preferably insoluble, non-conducting, corrosion resistant and adhesive. It is preferably a liquid, although it need not be free-flowing. The term includes all types of sealants usually used for electrical work, including adhesives, cements, pastes and other settable materials. Examples include silicone-based sealants, drying adhesives (eg. solvent based adhesives and polymer dispersion adhesives), contact adhesives (eg. natural rubber and polychloroprene), one-part adhesives (eg. cyanoacrylates and urethanes) and multi-part adhesives (polyester resin—polyurethane resin, polyols—polyurethane resin, and acrylic polymers—polyurethane resins).

In some embodiments, the plug and socket connection is rendered fluid-tight or waterproof by dipping the wire/end of the wire into a chemical sealant (such as silicone or superglue), holding the wire within the plug body, applying chemical sealant to the outside face of the plug body (silicone or superglue), and inserting the plug body into the socket. Once the chemical sealant has dried/set/cured, the connection may be fluid-tight/waterproof.

Preferably, the plug is of unitary construction and is made of plastics material, and may have a Shore D hardness of approximately 85+ or 100-120R Rockwell.

The connection apparatus can comprise other components such as, for example, a closure for isolating or enclosing an end of the wire. The closure can be, for example, a cap or cover that friction fits or screws to the plug and/or socket. Preferably the closure is a cap that extends over an end of the plug and friction fits to the outer face of the main body of the socket.

In an embodiment the conductor of the socket can make electrical contact with any suitable number of conductors (wires or other types of conductors). Any suitable number includes 1, 2, 3, 4, 5, 6, 7, 8, 9, 10, about 15, about 20, about 25, about 30, about 35, about 40, about 45, about 50, about 55, about 60, about 65, about 70, about 75, about 80, about 85, about 90, about 95, about 100 (and any number in between 10-100) and more than 100.

In an embodiment, the socket can have diametrically opposed blind openings separated by a common end wall (median wall). Such an embodiment could receive a respective plug/plug assembly within each opening to electrically connect two wires together. That is, the socket can be in the form of a dual socket for connecting two wires together, said dual socket comprising essentially two said sockets connected at their said end walls, and a conductive penetrator of both sockets is connected together.

In another embodiment, the socket can have more than two, three, four or five blind openings for receiving more than two, three, four or five plugs/plug assemblies.

In another embodiment, the socket can have any suitable number of blind openings for receiving any suitable number of plugs/plug assemblies. For example, the one socket can be electrically connected to 1, 2, 3, 4, 5, 6, 7, 8, 9, 10, about 15, about 20, about 25, about 30, about 35, about 40, about 45, about 50, about 55, about 60, about 65, about 70, about 75, about 80, about 85, about 90, about 95, about 100 (and any number in between 10-100) and more than 100. Preferably, the sockets are connected by their end walls or by way of an additional connector region, branched body or webbing, and the conductors/penetrators of the sockets are connected together.

In an embodiment, the socket can be in the form of a socket assembly for connecting two or more wires or other types of conductors together, said socket assembly comprising two or more said sockets electrically connected together.

According to a seventh aspect of the present invention, there is provided a dual socket assembly for connecting two wires or other types of conductors together, said dual socket assembly comprising two said sockets as defined according to the fourth aspect of the invention electrically connected together and capable of receiving two plugs or plug assemblies as defined according to the first, second or third aspects of the invention.

According to an eighth aspect of the present invention, there is provided a socket assembly for connecting a plurality of wires or other types of conductors together, said socket assembly comprising a plurality of sockets as defined according to the fourth aspect of the invention electrically connected together and capable of receiving a plurality of plugs or plug assemblies as defined according to the first, second or third aspects of the invention.

Particularly preferred embodiments of the invention are defined in the paragraphs below.

In preferred embodiments there is provided a plug adapted to hold a wire and to be received within a socket, said plug comprising: a plug body comprising at least two plug body portions that are connected to a plug body end; and a passage extending substantially along a central longitudinal axis of the plug body for receiving the wire, wherein:

the plug body is configurable in a first wire-receiving configuration so that the wire can be placed within the passage and a second clamping configuration so that the plug body can clamp to and retain the wire within the passage such that conducting strands of the wire extend substantially along the central longitudinal axis of the plug body; and wherein the at least two plug body portions are moveable away from the central longitudinal axis into the first wire-receiving configuration, and are moveable towards the central longitudinal axis into the second clamping configuration.

The passage can extend along a central longitudinal axis of the plug body completely through the plug body including substantially centrally through the plug body end.

Preferably, an outer diameter of the plug body reduces as it extends towards the plug body end. The reduction can be very slight, so as to assist with insertion into a socket.

The plug can be of unitary construction.

The end of the plug body can be in the form of an end wall.

The plug body can comprise an inside face and an outside face.

The plug can comprise gripping formations extending inwardly from the inside face for gripping opposing sides of the wire when located within the passage. Each said gripping formation can comprise one or more gripping teeth that: grip or bite into an exterior insulating coat or sheath of the wire; extend along the inside face of the plug body; and/or are pointed in a direction that prevents or minimises the risk of the wire being pulled out of the passage in an axial direction. The gripping formations can grip opposed size of the wire when located within the passage.

Each of the two plug body portions can be hinged to the plug body end by way of at least one hinge or at least one hinge region.

Each of the two plug body portions can be connected to the plug body end such that each said plug body portion can be bent or flexed relative to the central longitudinal axis.

The plug body can resemble a sleeve or tube split into longitudinal halves, whereby the plug body portions are connected at an end of the sleeve or tube.

The two plug body portions can resemble a sleeve or tube split into longitudinal halves and are hinged at an end of the sleeve or tube.

The two plug body portions can be similar, substantially identical or identical to each other.

The inside face of a first said plug body portion can be similar, substantially identical or identical to the inside face of a second said plug body portion.

A first gripping formation of a first plug body portion can be substantially identical to a second gripping formation of a second plug body portion.

When in the second clamping configuration the inside face can have a cross-section shaped to snugly receive a wire having a circular cross-section.

Being hinged together at the end or end wall of the plug body can enable both plug body portions to move towards the central longitudinal axis of the plug body so that the plug body can clamp to and retain the wire within the passage.

Being hinged together at the end or end wall of the plug body can enable both of the plug body portions to move towards or away from the central longitudinal axis of the plug body when configuring the plug body.

The plug body and wall can be substantially D-shaped when viewed in end elevation.

The plug body portions can be spaced or substantially spaced from each other when gripping a wire in the second clamping configuration.

In preferred embodiments there is provided a connection apparatus comprising the plug as described above and a socket for receiving the plug.

In preferred embodiments there is provided a socket for use with the plug as described or when used with the plug as described.

The plug can have at least one male or female formation that engages at least one corresponding male or female formation of a socket, for preventing unintentional removal of the plug from the socket.

The plug can have at least one flexibly resilient tooth that engages and locks within at least one recess or opening in a socket main body.

The plug body can have an enlarged end in the form of a circumferentially extending flange. The flange can be gripped with fingers or using a pair of pliers.

The flange can be of the generally rectangular or generally D-shaped cross-section when viewed in end elevation. If the end wall is generally D-shaped then the flange can also be generally D-shaped.

Each of the two plug body portions can have part of the flange.

The socket can comprise an opening extending axially within a main body for receiving the plug.

The plug body and plug opening of the socket can be shaped such that the plug body can only be inserted into the plug opening one way.

The socket can be an opening in an electrical appliance, equipment or device.

The main body of the socket can comprise an outer face, an inner face that extends around the opening and an end wall that borders a blind end of the opening.

The socket can comprise an electrical conductor located adjacent the end wall of the socket at the blind end of the opening, for contacting the wire located within the plug.

The conductor can be in the form of a penetrator for penetrating the wire when the wire of the plug is inserted into the opening in the socket.

The conductor can extend through the end wall of the socket to an exterior of the socket end wall to provide another electrical point of contact.

The socket of the connection apparatus can function as an electrical plug that can be plugged into an electrical appliance, equipment or device.

The socket can be in the form of a dual socket for connecting two wires together, said dual socket comprising essentially two said sockets connected at their said end walls, and the conductor of both sockets is connected together.

Preferably, a diameter of the plug opening in the socket reduces as it extends towards the socket end wall. The reduction can be very slight, so as to assist with plug insertion.

The plug and socket connection can be rendered fluid-tight or waterproof by dipping the wire/end of the wire into a chemical sealant (such as silicone or superglue), holding the wire within the plug body, applying chemical sealant to the outside face of the plug body (silicone or superglue), and inserting the plug body into the socket. Once the chemical sealant has dried/set/cured, the connection is fluid-tight/waterproof.

Other embodiments of the invention, as previously described in United States of America Patent Application No. U.S. Ser. No. 14/790,339, are again described below.

In a first aspect, the invention concerns: a plug for holding a wire and for being received within a socket (or a plug adapted to hold a wire and to be received within a socket), said plug comprising: a plug body and a passage extending axially within the plug body for receiving a wire, wherein the plug body is configurable in a first wire-receiving configuration so that a wire can be placed within the passage and a second clamping configuration so that the plug body can clamp to and retain the wire within the passage.

In a second aspect, the invention concerns a plug for holding a wire (or a plug adapted to hold a wire), said plug comprising: a plug body comprising: an inside face and an outside face; a passage extending axially within the plug body for receiving a wire; and at least one gripping formation extending inwardly from the inside face for gripping a wire when located within the passage, wherein the plug body is configurable in a first wire-receiving configuration so that a wire can be placed within the passage and a second clamping configuration so that the plug body can clamp to and retain the wire within the passage when the plug has been received within a socket.

In a third aspect, the invention concerns a plug assembly comprising the plug as defined according to the first aspect or second aspect and a wire.

In a fourth aspect, the invention concerns a socket for receiving the plug as defined according to the first aspect or second aspect, or the plug assembly according to the third aspect.

In a fifth aspect, the invention concerns a connection apparatus comprising: the plug as defined according to the first aspect or second aspect, or the plug assembly as defined according to the third aspect; and/or the socket as defined according to the fourth aspect.

In a sixth aspect, the invention concerns a method of forming a connection and optionally an electrical connection comprising the steps of: locating a wire within a plug as defined according to the first or second aspect; and receiving the plug within a socket according to the fourth aspect that optionally comprises an electrical conductor.

The plug can be of any suitable size, shape and construction, and can be made of any suitable material or materials. The plug can comprise a single component or more than one component. In some embodiments, the plug can comprise a plug body that directly engages a socket. In other embodiments, the plug can further comprise a plug adapter that connects to, engages with or receives the plug body and then enables the plug body to be snugly received by a socket. The plug adapter can carry out a number of different functions, including providing a sealing function so as to protect or fluid-proof/waterproof the wire or electrical connection, and/or modifying the overall size of the plug should the plug body be of inadequate size so as to be snugly received within a socket.

Any suitable type of wire can be held by the plug. The wire can be rigid or flexible. The wire can comprise rigid or malleable conducting filaments or strands and optionally an insulating exterior coating or sheath made of plastics material or rubber, for example. The wire can be in the form of a cable having interwoven conducting strands and a sheathed/coated exterior. The wire can be in the form of a coaxial cable having conducting filaments concentrically spaced and insulated from one another.

The plug body can be of any suitable size, shape and construction and can be made of any suitable material or materials. In a preferred embodiment the plug body is made of a non-conductive material or materials, such as plastics material, ceramics material, carbon fibre or rubber.

In an embodiment, the plug body can be of unitary construction and can be manipulated to adopt the second clamping configuration. This may be possible, for example, by way of two plug body portions being hinged together and moveable together via a live hinge into the second clamping configuration. The hinge can hinge the plug body portions such that the plug body portions pivot along an axis parallel with the passage or transversely of the passage. Alternatively, this may be possible, for example, by way of three, four or possibly more plug body portions being hinged together and moveable together into the second clamping configuration. The hinge or hinges can hinge the plug body portions such that the plug body portions pivot along an axis parallel to the passage or transversely of the passage.

The plug body can have a first end and a second end that is opposite the first end. The plug body can have socket receiving end or a plug adapter receiving end. In some embodiments, only one end of the plug body is received within a socket or plug adapter. In some other embodiments, both ends of the plug body are received within a socket or plug adapter.

In an embodiment, the plug body comprises two substantially identical body portions hinged together at an end of the plug body using at least one hinge, which hinge could be in the form of one or more fold lines. The substantially identical body portions can be like a sleeve or tube split into longitudinal halves and hinged at one end, or a sleeve or tube substantially sealed or semi-sealed at one end (end wall of the plug body) and split into longitudinal halves and hinged at one end.

In some embodiments, if received directly by a socket, the plug body can comprise two substantially identical body portions hinged together at a socket receiving end of the plug body (or optionally at the other end of the plug body), using at least one hinge, which hinge could be in the form of one or more fold lines. The substantially identical body portions can be like a sleeve or tube split into longitudinal halves and hinged at the socket receiving end (or optionally at the other end of the body), or a sleeve or tube substantially sealed or semi-sealed at one end (end wall of the plug body) and split into longitudinal halves and hinged at one end.

In other embodiments, if first received within a plug adapter, the plug body can comprise two substantially identical body portions hinged together at an end of the plug body that is not received within the plug adapter, using at least one hinge, which hinge could be in the form of one or more fold lines. The substantially identical body portions can be like a sleeve or tube split into longitudinal halves and hinged at an end, or a sleeve or tube substantially sealed or semi-sealed at one end (end wall of the plug body) and split into longitudinal halves and hinged at one end.

In another embodiment, the plug body can comprise two or more separate plug body pieces that can be connected together to adopt the second clamping configuration. For example, the plug body can comprise two substantially identical body pieces that can be connected together and possibly held together using male and female locking formations. For example, the plug body can comprise three or more body pieces that can be connected together and possibly held together using male and female locking formations.

In yet another embodiment, the plug can comprise at least one fastener, and the plug body can comprise two or more separate plug body pieces that can be connected together to adopt the second clamping configuration using the at least one fastener. The fastener can be, for example, a clip, clamp, band, screw, nail and/or adhesive. The fastener can be used in conjunction with male and female locking formations, if required.

The plug body can be in the form of a sleeve or tube extending around the wire when in the second clamping configuration and the sleeve or tube can be of any suitable cross-section. For example, the sleeve or tube can be of circular cross-section or of substantially circular cross-section when in the second clamping configuration. Alternatively, the sleeve or tube can be of triangular, rectangular or other geometrical cross-section when in the second clamping configuration. The inside and outside faces of the plug body can be of similar or differing cross-sections.

In some embodiments, the plug body end opposite the socket receiving end can be enlarged. For example, in one embodiment, the enlarged end can be in the form of a circumferentially extending flange. The flange may be gripped with fingers or using a pair of pliers when the plug body is in a second clamping configuration. The flange can abut the socket when the plug body has been received within the socket. The flange can sealingly engage the socket.

For example, in another embodiment, the enlarged end can be sized and shaped so as to be easily gripped with fingers or a pair of pliers when the plug body is in a second clamping configuration. The enlarged end (or head) can be of any suitable size and shape. In some embodiments, the enlarged end or head is cuboid in shape, in the shape of a cylinder, or in the shape of a rectangular prism, for example.

In some embodiments, the plug body end opposite a plug adapter receiving end can be enlarged. For example, in one embodiment, the enlarged end can be in the form of a circumferentially extending flange. The flange may be gripped with fingers or using a pair of pliers when the plug body is in a second clamping configuration. The flange can abut the plug adapter when the plug body has been received within the socket. The flange can sealingly engage the plug adapter.

The passage extending axially within the plug body for receiving a wire can extend completely through a central region of the plug body or partway along the plug body. Preferably, the passage extends centrally along a longitudinal axis of the plug body, completely through the plug body, including the ends/end wall/enlarged end/head of the plug body. Alternatively, one end of the passage, such as at the socket receiving end, could be blind or substantially blind, so as to completely or almost completely insulate/isolate an end of the wire—depending on the intended use (ie. non-electrical connection).

The passage can snugly receive the wire. The diameter of the passage and inside face of the plug body can vary depending on the gauge of the wire. The part of the passage extending through the enlarged end or head can be used to check wires for appropriate gauge size/diameter.

The at least one gripping formation can be of any suitable size, shape and construction. The at least one gripping formation can comprise one or more gripping teeth extending along the inside face of the plug body. Preferably the at least one gripping formation comprises one or more gripping teeth that are pointed in a direction that prevents or minimises the risk of the wire being pulled out of the passage in an axial direction. The wire can be snugly or tightly received by the gripping formation.

Preferably the gripping teeth extend around the inside face and are spaced along the longitudinal axis. Preferably the teeth are pointed perpendicularly towards the central longitudinal axis, or toward the socket receiving end, or toward the other end of the plug body, or away from the plug adapter receiving end.

The tooth or teeth of the at least one gripping formation may or may not deflect when gripping or biting into the wire. That is, the tooth or teeth may be flexible or rigid in differing circumstances depending on the nature of the wire—for example, whether insulated or not, and whether flexible or malleable or not. The gripping teeth can preferably grip or bite into the wire, particularly the exterior insulating coat or sheath of the wire.

In an embodiment, the at least one gripping formation can be provided as a plurality of axially spaced circumferentially running ridges having a parallelogram shaped cross-section circumferentially, the parallelogram leaning towards an end of the plug body, preferably the socket receiving end of the plug body (but this need not be the case).

In another embodiment, the at least one gripping formation can be provided as a plurality of axially spaced circumferentially running ridges having a pointed end or edge leaning towards an end of the plug body, preferably the socket receiving end of the plug body (but this need not be the case).

As mentioned above, the plug can further comprise a plug adapter that connects to, engages with, or receives the plug body and then enables the plug body to be received by a socket. The plug body can have an adapter receiving end and an adapter non-receiving end opposite the adapter receiving end.

The plug adapter can be of any suitable size, shape and construction, and can be made of any suitable material or materials. For example, the plug adapter can comprise an adapter body and a passage extending there through for receiving the plug body and wire. The adapter body can be made of any suitable non-conductive material or materials such as plastics material, rubber, carbon fibre, insulated metal or ceramics material. The adapter body can preferably be made of plastics material, and may have a Shore D hardness of approximately 85+ or 100-120R Rockwell. The passage can be of any suitable cross sectional shape, width and length.

In one embodiment the plug adapter can comprise a passage extending axially within an adapter body for receiving all or some of the plug body and a wire. The adapter body can have an outer face and an inner face that extends around the passage. The adapter body can comprise a sleeve, tube or barrel portion. The sleeve, tube or barrel portion can be of any suitable cross section, but preferably is of circular cross-section or of substantially circular cross-section. Alternatively, the adapter body (sleeve, tube or barrel portion) can be of triangular, rectangular or other geometrical cross-section. The inner and outer faces can be of similar or different cross-sections. Preferably, the adapter body is shaped to snugly receive the plug body and wire. That is, preferably the outer surface of the plug body is snugly received by the inner face/passage of the adapter body.

The adapter body can have a plug body receiving end and a wire receiving end. A part of the passage extending through the plug body receiving end can be sized to receive the plug body. A part of the passage extending through the wire receiving end can be sized to receive only the wire. That is, that part of the passage can be of smaller diameter than the part of the passage extending through the plug body receiving end.

Preferably, the adapter body comprises a barrel portion having a chamber for receiving the plug body, and a wire-receiving portion having a wire-receiving passage extending from the chamber for receiving a wire.

The connection apparatus can be used to make a connection to another wire or wires, or to an electrical appliance, equipment or device in a waterproof or fluid-tight manner in a moist or wet environment. To that end, the plug, socket and/or connection apparatus can comprise a sealing arrangement or sealing means. The sealing arrangement or sealing means can be, for example, in the form of one or more O-rings/sealing members, one or more sealing formations, and/or sealant such as chemical sealant.

For example, in some embodiments the plug can comprise at least one sealing formation extending around the inside face of the plug body, to seal against fluid (such as air or sealant as described later) from flowing between an outer periphery of the wire and the inside face. The at least one sealing formation can comprise at least one circumferentially extending ridge or tooth, preferably having a square, rectangular, triangular, rounded, tapered, wedge-shaped or pointed circumferential cross section. An inner face of each ridge/tooth or point of contact with the wire can be rounded, pointed or flat, for example. The wire can be snugly or tightly received by the sealing formation. Preferably the tooth or teeth grip or bite into the wire, particularly the exterior insulating coat or sheath of the wire.

In one embodiment the at least one sealing formation can be spaced from the at least one gripping formation, preferably away from the socket receiving end of the plug body.

In another embodiment, the at least one gripping formation can also serve as the at least one sealing formation.

For example, in some embodiments the plug or connection apparatus can comprise at least one O-ring/annular sealing member extending around the inside face of the plug body, to seal against fluid (such as air or sealant as described later) from flowing between an outer periphery of the wire and the inside face. The O-ring/annular sealing member can be located within a groove or shoulder extending along the inside face of the plug body. The O-ring/annular member can be made of rubber.

For example, in some embodiments the plug, socket or connection apparatus can comprise at least one O-ring/annular sealing member for preventing fluid from passing between the plug body or plug adapter and the socket. For example, an O-ring/annular sealing member can extend around the outside face of the plug body and seal against the socket or a groove, channel or shoulder of the socket.

For example, in some embodiments the plug adapter or connection apparatus can comprise at least one O-ring/annular sealing member extending around the inside face of the adapter body, to seal against fluid from flowing between an outer periphery of the wire and the inside face. The O-ring/annular sealing member can be located within a groove or shoulder extending along the inside face of the adapter body. The O-ring/annular member can be made of rubber.

For example, in some embodiments the plug, socket or connection apparatus can comprise at least one O-ring/annular sealing member for preventing fluid from passing between the adapter body and the socket. For example, an O-ring/annular sealing member can extend around the outside face of the adapter body and seal against the socket or a groove, channel or shoulder of the socket.

The socket can provide an electrical connection with another wire or other type of conductor, or simply help isolate/insulate an end of the wire from electrical contact or the elements, such as rain or moisture. Alternatively, the socket could be used as a means of labelling/identifying the wire/nature of the wire/intended purpose for the wire, in addition to making an electrical connection or not. That is, the sealing arrangement need not be present.

The (electrical or non-electrical) conductor can be of any suitable size, shape and construction, and can be made of any suitable material or materials. In some embodiments, the conductor can be in the form of a pin, wire or spike, of any suitable size and shape. In some embodiments, the conductor can be in the form of a plate, strip, terminal or tab, of any suitable size and shape.

In an embodiment, the socket can contain a conductor and can convert the plug assembly into a type of plug that can then be plugged into an electrical appliance, equipment or device. An electrical appliance, equipment or device (as used throughout this specification) includes, but is not limited to, anything of an electrical or electronic nature, or anything used in the transfer or transmission of data. That is, the electrical connection can be made for data transmission purposes. An electrical appliance, equipment or device (as used throughout this specification) also includes, but is not limited to, a major appliance, microcontroller, power tool or small appliance, or a component part of an electrical distribution system such as an electric switchboard, distribution board, circuit breaker or disconnect, electricity meter or transformer.

Therefore, the method according to the sixth aspect can comprise the step of using the socket containing the plug assembly (the connection apparatus) as a plug/connector to be received within a socket of an electrical appliance, equipment or device.

In another embodiment, the socket can be in the form of an opening in a circuit board or other type of electrical appliance, equipment or device for receiving the plug or plug assembly, for either isolating the wire or making an electrical connection with one or more other wires or other types of conductors. Put another way, a main body of the socket and electrical conductor etc may be provided by the electrical appliance, equipment or device itself.

Therefore, the socket can be of any suitable size, shape and construction and can be made of any suitable material or materials. For example, in an embodiment, the socket is merely an opening in an electrical appliance, equipment or device. For example, in another embodiment, the socket is in the form of a sleeve comprising a main body and a central opening for receiving the plug/plug assembly, for either isolating the wire or making an electrical connection with one or more other wires or conductors. The central opening can be blind or not.

The socket main body and end wall can be of unitary construction or comprise multiple connectable pieces. The socket main wall and end wall can be made of any suitable non-conductive material or materials such as plastics material, rubber, carbon fibre, insulated metal or ceramics material. The socket main wall and end wall can preferably be made of plastics material, and may have a Shore D hardness of approximately 85+ or 100-120R Rockwell.

In one embodiment the socket can comprise an opening extending axially within a main body for receiving the plug, preferably the socket receiving end of the plug body or preferably the plug adapter and plug body. The main body can have an outer face and an inner face that extends around the opening. The socket can comprise an end wall that borders a blind end of the opening. The main body can be in the form of a sleeve or tube having a sealed/blind end. The other end of the sleeve can be flared or the main body can have a stepped interior. The sleeve or tube can be of any suitable cross section, but preferably is of circular cross-section or of substantially circular cross-section. Alternatively, the main body (sleeve or tube) can be of triangular, rectangular or other geometrical cross-section. The inner and outer faces can be of similar or different cross-sections. Preferably, the main body is shaped to snugly receive the plug body and/or plug. That is, preferably the outer surface of the plug body is snugly received by the inner face/opening of the socket main body.

The plug can be adapted to be received within the socket in any suitable way. That is, the connection apparatus can comprise at least one male and female formation or at least one engagement formation enabling the plug body and/or plug adapter to be received within an opening in the socket and to be held or locked in place within the socket opening.

For example, the outside face of the plug body or plug adapter can have at least one male or female formation that engages at least one male or female formation of the inner face (or which are located at the inner face) of the socket main body. For example, the at least one engagement formation can comprise the outside face of the plug body or plug adapter having engagement formations for engagement with complementary engagement formations of the inner face (or which are located at the inner face) of the socket main body.

In one embodiment, the outside face of the plug body and/or plug adapter can have one or more teeth that engage one or more teeth located at the main body inner face. For example, the teeth can be in the form of a pawl and ratchet arrangement whereby the teeth of the pawl engage the ratchet teeth as the plug body or plug adapter is inserted into the socket opening. The pawl can be hinged to the main body of the socket and the teeth of the pawl can extend adjacent the inner face of the main body.

In one embodiment, the at least one engagement formation comprises a plurality of circumferentially extending grooves or slots in regular spaced relationship axially along the outside face of the plug body. Preferably, the grooves have a saw-tooth configuration and extend circumferentially such that the engagement formations and complementary engagement formations of the socket main body engage and lock together.

In another embodiment, the outside face of the plug adapter can a groove that engages one or more projections or flanges located at the main body inner face.

In an embodiment, the at least one gripping formation is preferably provided at the socket receiving end and the at least one engagement and at least one sealing formations are preferably provided at the other opposed end of the plug body.

The hinged end of the plug body can be selected as the end which is insertable into the socket, or the other end may be so selected, the at least one gripping, sealing and engagement formations being provided on the appropriate end to accommodate the selection of the insertable end.

The connection apparatus can comprise a guide for aligning the plug body with the socket main body and guiding it axially within the opening in the socket. The guide can be of any suitable form.

The guide can be in the form of the plug and socket having a keyway and key arrangement for aligning the plug body with the socket main body and guiding it axially within the opening in the socket. The guide can incorporate some of the at least one engagement formation or male and female formations as described above, but this need not be the case.

In an embodiment the socket can comprise an opening extending axially within a main body for receiving the socket receiving end of the plug body. The main body can have an outer face and an inner face that borders the opening. The socket can have an end wall that borders a blind end of the opening. The socket can comprise an electrical conductor located adjacent the end wall of the socket at the blind end of the opening, for contacting the wire located within the plug. That is, as the plug body is inserted into the opening in the socket, a conducting filament of the wire within the plug makes an electrical connection with the conductor. In one embodiment, the conductor is flat or raised and adjacent the end wall of the socket. In another embodiment, the conductor is in the form of a penetrator—spike or pin, for example—for penetrating the wire when the wire of the plug is inserted into the opening in the socket. Preferably the penetrator is capable of penetrating the external insulating coating of the wire in the event that the filament is not exposed.

The conductor, such as the penetrator, can extend through the end wall of the socket to an exterior of the socket end wall to provide another electrical point of contact. If the conductor extends to an exterior of the end wall as a pin or other point of electrical contact then the socket/connection apparatus can function as an electrical plug that can be plugged into an electrical appliance, equipment or device. That is, the plug captures an end of the wire to form a plug assembly, the plug assembly is received by the socket to make an electrical connection within the socket, and the socket itself serves as a plug that can be plugged into an electrical appliance, equipment or device so as to make another electrical contact by virtue of the exposed conductor (pin or other point of electrical contact) with the electrical appliance, equipment or device. That is, the plug and socket can serve as an adapter plug for the wire.

In another embodiment, if the wire comprises multiple spaced and insulated filaments such as in a coaxial cable, for example, the socket can comprise more than one appropriately positioned penetrator or other conductor to make more than one electrical connection with the spaced filaments of the wire.

If a non-electrical connection is required (eg. when merely isolating the end of the wire), the socket can be devoid of any electrical conductor adjacent the end wall of the socket.

As mentioned the connection apparatus can be used to make a connection to another wire or wires, or to an electrical appliance, equipment or device in a waterproof or fluid-tight manner in a moist or wet environment. In one embodiment, the socket can comprise a sealing arrangement or sealing means in the form of a sealant or sealants located within the socket, and the plug body can comprise at least one vent for venting air and for receiving some of the sealant/s when the socket receiving end of the plug body is brought into contact with the sealant/s and displaces the sealant/s. In this way, the point of electrical contact can be rendered fluid-tight, especially watertight. Preferably the sealant/s is located at or within the blind end of the opening adjacent the socket end wall.

Any suitable type of sealant/s can be used. The sealant/s may set, for example, when exposed to air, moisture, light or heat, or when different sealant components mix with one another. Suitable sealants include non-conductive sealants that coat an end of the wire and stick to the plug body and socket main body, although binding with the bodies may not be essential. Suitable sealants include those that have adhesive properties. Preferably the sealant/s is free flowing and hardens when exposed to air or when two sealant components are mixed together.

The term 'sealant' as defined herein is preferably insoluble, non-conducting, corrosion resistant and adhesive. It is preferably a liquid, although it need not be free-flowing. The term includes all types of sealants usually used for electrical work, including adhesives, cements, pastes and other settable materials. Examples include silicone-based sealants, drying adhesives (eg. solvent based adhesives and polymer dispersion adhesives), contact adhesives (eg. natural rubber and polychloroprene), one-part adhesives (eg. cyanoacrylates and urethanes) and multi-part adhesives (polyester resin—polyurethane resin, polyols—polyurethane resin, and acrylic polymers—polyurethane resins).

The socket can include at least one rupturable isolated chamber/cavity or at least one rupturable membrane, seal or bladder for compartmentalising the sealant from exposure to air or moisture or light, for example. Upon rupture and exposure to air, moisture or light, the sealant can cure/harden.

The socket can include one or more isolated chambers, rupturable membranes, seals or bladders for compartmentalising two sealant components from one another, for example. Upon rupture, the sealant components can mix, chemically react, and cure/harden. In one embodiment, one or more chambers, membranes, seals or bladders containing sealant/s (settable materials) can be disposed about the at least one conductive penetrator or other conductor within the blind end of the opening adjacent the end wall of the socket. The penetrator can be located externally of the chamber, membrane, seal or bladder, or a wire penetrating end of the penetrator can be located within the chamber, membrane, seal or bladder.

The rupturable membrane or bladder can be annular (in the shape of a donut) and can be placed in the blind end of the opening such that the conductor/penetrator extends through a central opening in the chamber, membrane, seal or bladder.

The at least one vent can comprise a gap or channel extending between the outside face of the plug body and main body (inner face) of the socket, linking the blind end of the opening/sealant to the atmosphere. Gaps or channels can extend along opposed longitudinal sides of the outside face to the blind end of the opening/sealant.

The connection apparatus can comprise at least one piercer for piercing a wall of the isolated chamber, membrane, seal or bladder containing the sealant/settable material. Either the plug or the socket can comprise the piercer. The piercer can be of any suitable size, shape and construction. The plug or socket can have more than one piercer.

For example, the hinge or hinges of the plug body having a pointed edge (fold line) extending toward the blind end of the opening in the socket can function as a piercer or piercers. Such a piercer (or piercers) can be received within a recess or groove extending within the end wall of the socket.

For example, one or more piercers can extend from the socket receiving end of the plug body. Such piercers can be received within a recess or groove extending within the end wall of the socket. The recess or groove can be circular or annular.

For example, one or more piercers can extend alongside or within the isolated chamber or rupturable membrane/bladder etc or sealed sealant/settable material. Such piercers can be received within a recess or groove extending within the socket receiving end of the plug body. The recess or groove can be annular.

It is possible that the penetrator, if fully located within the isolated chamber, membrane, seal or bladder, can both rupture and penetrate the wire as the socket receiving end is forced against the isolated chamber wall, membrane, seal or bladder.

Preferably, the plug is of unitary construction and is made of plastics material, and may have a Shore D hardness of approximately 85+ or 100-120R Rockwell.

The connection apparatus can comprise other components such as, for example, a closure for isolating or enclosing an end of the wire. The closure can be, for example, a cap or cover that friction fits or screws to the plug and/or socket. Preferably the closure is a cap that extends over an end of the plug and friction fits to the outer face of the main body of the socket.

In an embodiment the conductor of the socket can make electrical contact with any suitable number of conductors (wires or other types of conductors). Any suitable number includes 1, 2, 3, 4, 5, 6, 7, 8, 9, 10, about 15, about 20, about 25, about 30, about 35, about 40, about 45, about 50, about 55, about 60, about 65, about 70, about 75, about 80, about 85, about 90, about 95, about 100 (and any number in between 10-100) and more than 100.

In an embodiment, the socket can have diametrically opposed blind openings separated by a common end wall (median wall). Such an embodiment could receive a respective plug/plug assembly within each opening to electrically connect two wires together. That is, the socket can be in the form of a dual socket for connecting two wires together, said dual socket comprising essentially two said sockets connected at their said end walls, and the penetrator of both sockets is connected together.

If the dual socket is to be waterproof, each socket can comprise a sealant (contained within a rupturable membrane, bladder or chamber or contained by a seal, or not) and/or a sealing member or sealing means, such as an O-ring.

In another embodiment, the socket can have more than two, three, four or five blind openings for receiving more than two, three, four or five plugs/plug assemblies.

In another embodiment, the socket can have any suitable number of blind openings for receiving any suitable number of plugs/plug assemblies. For example, the one socket can be electrically connected to 1, 2, 3, 4, 5, 6, 7, 8, 9, 10, about 15, about 20, about 25, about 30, about 35, about 40, about 45, about 50, about 55, about 60, about 65, about 70, about 75, about 80, about 85, about 90, about 95, about 100 (and any number in between 10-100) and more than 100. Preferably, the sockets are connected by their end walls or by way of an additional connector region, branched body or webbing, and the conductors/penetrators of the sockets are connected together.

In an embodiment, the socket can be in the form of a socket assembly for connecting two or more wires or other types of conductors together, said socket assembly comprising two or more said sockets electrically connected together.

According to a seventh aspect of the present invention, there is provided a dual socket assembly for connecting two wires or other types of conductors together, said dual socket assembly comprising two said sockets as defined according to the fourth aspect of the invention electrically connected together and capable of receiving two plugs or plug assemblies as defined according to the first, second or third aspects of the invention.

According to an eighth aspect of the present invention, there is provided a socket assembly for connecting a plurality of wires or other types of conductors together, said socket assembly comprising a plurality of sockets as defined according to the fourth aspect of the invention electrically connected together and capable of receiving a plurality of plugs or plug assemblies as defined according to the first, second or third aspects of the invention.

The connection apparatus can comprise a guide for aligning the plug body with the socket main body and guiding it axially within the opening in the socket. The guide can be of any suitable form.

The guide can be in the form of the plug and socket having a keyway and key arrangement for aligning the plug body with the main adapter body and guiding it axially within the opening in the main adapter body. The guide can incorporate some of the at least one engagement formation or male and female formations as described above, but this need not be the case.

According to a preferred ninth aspect of the present invention, there is provided a plug adapted to hold a wire and to be received within a socket, said plug comprising:

a plug body comprising: a plug adapter engaging end; and a passage extending axially within the plug body for receiving a wire, wherein the plug body is configurable in a first wire-receiving configuration so that a wire can be placed within the passage and extend from the plug adapter engaging end of the plug body, and a second clamping configuration so that the plug body can clamp to and retain the wire within the passage; and a plug adapter comprising: a barrel portion comprising an open-ended chamber for receiving and housing the plug body; and a wire-receiving portion comprising a wire-receiving passage for receiving the wire, such that when the plug adapter houses the plug body the plug is receivable within a socket.

In a preferred embodiment, the plug adapter can seal the plug body within the socket and render the connection watertight (fluid-tight).

According to a preferred tenth aspect of the present invention, there is provided a plug adapted to hold a wire and to be received within a socket in a fluid-tight manner, said plug comprising:

a plug body comprising: a plug adapter engaging end; and a passage extending axially within the plug body for receiving a wire, wherein the plug body is configurable in a first wire-receiving configuration so that a wire can be placed within the passage and extend from the plug adapter engaging end of the plug body, and a second clamping configuration so that the plug body can clamp to and retain the wire within the passage; and a plug adapter comprising: a barrel portion comprising an open-ended chamber for receiving and housing the plug body; a wire-receiving portion comprising a wire-receiving passage for receiving the wire; and a sealing arrangement such that when the plug adapter houses the plug body and the plug is received by a socket, the plug body is sealed within the socket in a fluid-tight manner.

According to an eleventh aspect of the present invention, there is provided a connection apparatus comprising the plug of the ninth or tenth aspect and a socket for receiving the plug.

According to a twelfth aspect of the present invention, there is provided a method of forming an electrical connection comprising the steps of: locating a wire within a plug as defined according to the ninth or tenth aspect; and receiving the plug within a socket comprising an electrical conductor.

According to a thirteenth aspect of the present invention, there is provided a dual socket assembly for connecting two wires or other types of conductors together, said dual socket assembly comprising two sockets electrically connected together and capable of receiving two plugs as defined according to the ninth or tenth aspect.

According to a fourteenth aspect of the present invention, there is provided a socket assembly for connecting a plurality of wires or other types of conductors together, said socket assembly comprising a plurality of sockets electrically connected together and capable of receiving a plurality of plugs as defined according to the ninth or tenth aspect.

Features of any of these aspects can be as described for the earlier aspects of the invention.

The barrel portion can be of any suitable size, shape and construction. The barrel portion can comprise a barrel wall that surrounds the chamber. The plug body can be completely or partially housed within the chamber. Preferably, all but an enlarged end of the plug body is housed within the chamber.

The wire-receiving portion can be of any suitable size, shape and construction. The wire-receiving portion can comprise an enlarged end, comprising a circumferentially extending flange and/or a cuboid, rectangular prism or cylindrical body enabling gripping by fingers or a pair of pliers, for example.

Any suitable type of sealing arrangement can be used. In one embodiment, the sealing arrangement can comprise one, two or more sealing members, such as O-rings, being preferably made of rubber. In another embodiment, the sealing arrangement can comprise at least one sealing formation integrally formed with the plug body, as described earlier herein.

A first sealing member can extend around the wire adjacent the plug adapter engaging end between the chamber and the wire-receiving passage, for preventing fluid (gas, liquid or particulate matter) movement from the wire-receiving passage to the plug body. The first sealing member can be an O-ring located within a groove, space or cavity of the plug adapter located adjacent the chamber.

A second sealing member can extend around the barrel wall, between the barrel wall and socket, for preventing the entry of fluid into the socket. The second sealing member can be an O-ring extending around the barrel wall adjacent the wire-receiving portion, and is locatable within a groove, cavity or shoulder of the socket main body.

Preferably the plug adapter is of unitary construction, but with possible exception if the sealing arrangement comprises one or more O-rings.

The plug adapter can optionally comprise at least one sealing formation extending around the inside face of the plug body, to further seal against fluid from flowing between an outer periphery of the wire and the inside face. The at least one sealing formation can comprise at least one circumferentially extending ridge or tooth that engages the wire. The at least one sealing formation can be spaced from the at least one gripping formation, near to the plug adapter engaging end.

The plug body can taper or narrow in an axial direction from the enlarged end to the plug adapter receiving end. In a similar manner, the chamber can narrow in an axial direction from the enlarged end to the adapter receiving end.

Preferably the plug body clamps to and retains the wire within the passage when the plug adapter engaging end of the plug body has been received within the chamber.

Preferably the plug body comprises an inside face and an outside face, and the plug further comprises at least one gripping formation extending inwardly from the inside face for gripping the wire when located within the passage. Preferably the at least one gripping formation comprises one or more gripping teeth extending along the inside face of the plug body that are pointed in a direction that prevents or minimises the risk of the wire being pulled out of the passage in an axial direction. Preferably the gripping teeth point away from the plug adapter engaging end. Preferably the gripping teeth grip or bite into an exterior insulating coat or sheath of the wire.

Preferably the plug body comprises two plug body portions that are hinged together and are moveable together via a hinge into the second clamping configuration. Preferably the plug body comprises two substantially identical body portions hinged together at an end of the plug body using at least one hinge. Preferably one or more hinges are located at an enlarged end of the plug body. Preferably the substantially identical body portions resemble a sleeve or tube split into longitudinal halves and are hinged at an end of the sleeve or tube.

Preferably the passage extends centrally along a longitudinal axis of the plug body completely through the plug body.

Preferably the connection apparatus comprises at least one engagement formation enabling the plug adapter to be received within the opening in the socket and to be held or locked in place within the opening. Preferably the at least one engagement formation comprises a female formation engaging a male formation. For example, a male formation can extend from the main body and be received within a female formation of the plug adapter wire-receiving portion, preferably being a groove extending within a flange or tab of the wire-receiving portion.

Preferably the connection apparatus comprises at least one engagement formation enabling the plug body to be received within the chamber and to be held or locked in place within the chamber. Preferably the at least one engagement formation comprises a female formation engaging a male formation. For example, a male formation can extend from the plug body and be received within a female formation of the plug adapter, preferably being a groove extending within the barrel wall.

As already mentioned, any of the features described herein or as defined in the paragraphs above or below can be combined in any combination with any one or more of the other features described herein within the scope of the invention.

In a further aspect the present invention resides broadly in a waterproof connection apparatus including a plug assembly (described elsewhere in this specification as a plug) engageable with a socket assembly (described elsewhere in this specification as a socket), the plug assembly including: a sleeve body (described elsewhere in this specification as a plug body) being provided in two or more parts engageable with one another to form a wall surrounding a passage passing through the sleeve body, the wall having an inside face and an outside face; one or more gripping formations extending inwardly from the inside face of the wall for gripping a cable or the insulation thereof (described elsewhere in this specification as a wire) when introduced into the passage; and engagement formations about the outside face of the wall for engagement with complementary engagement formations of the socket assembly, the socket assembly including: a main body; a socket (described elsewhere in this specification as an opening) formed into the main body to receive the plug assembly and having a conductive spike (described elsewhere in this specification as a penetrator) arranged at a disposition within the socket for electrical contact with the cable of the plug assembly and a rupturable membrane disposed about the spike to provide an annular cavity within the membrane, the annular cavity having therein a liquid material (described elsewhere in this specification as a sealant) settable upon rupturing of the membrane, the parts being so arranged to provide a gap (described elsewhere in this specification as a vent) between the plug assembly and at least some of the socket to receive the settable liquid upon rupturing of the membrane.

In a further aspect, the present invention resides broadly in a plug assembly (described elsewhere in this specification as a plug) for securing conductors to an electrical connector comprising: a sleeve body (described elsewhere in this specification as a plug body) being provided in two or more parts engageable with one another to form a wall surrounding a passage passing through the sleeve body, the wall having an inside face and an outside face; one or more gripping formations extending inwardly from the inside face of the wall for gripping a cable or the insulation thereof (described elsewhere in this specification as a wire) when introduced into the passage; and engagement formations about the outside face of the wall for engagement with complementary engagement formations of a socket assembly (described elsewhere in this specification as a socket) as hereinbefore described.

In a further aspect, the present invention resides broadly in a socket assembly (described elsewhere in this specification as a socket) comprising: a main body; a socket (described elsewhere in this specification as an opening) formed into the main body to receive a plug assembly (described elsewhere in this specification as a plug) as hereinbefore described and having a conductive spike (described elsewhere in this specification as a penetrator) arranged at a disposition within the socket for electrical contact with the cable (described elsewhere in this specification as a wire) of the plug assembly and a rupturable membrane disposed about the spike to provide an annular cavity within the membrane, the annular cavity having therein a liquid material settable (described elsewhere in this specification as a sealant) upon rupturing of the membrane, the parts being so arranged to provide a gap (described elsewhere in this specification as a vent) between the plug assembly and at least some of the socket to receive the settable liquid upon rupturing of the membrane.

In a further aspect, the present invention resides broadly in a rupturable membrane having an annular cavity formed for placement in a socket about a spike (described elsewhere in this specification as a conductive penetrator) to form the socket assembly (described elsewhere in this specification as a socket) as hereinbefore described.

In a further aspect, the present invention resides broadly in an apparatus for conductively connecting one or more cables to one another in a waterproof manner, the apparatus comprising: a non-conductive connector housing having an open end, an opposing end and a passage extending through the housing from the open end to the opposing end; a conductive spike disposed within the housing extending into the passage intermediate the open and the opposing ends; a membrane disposed within the passage about the conductive spike and defining an annular chamber between the pin and the housing; and a liquid sealant substantially filling said annular chamber.

Preferably, the sleeve body is provided in two parts connected to one another by a hinge connection at one end to provide a hinged end and an open end. Each part is substantially identical, being substantially semicircular in cross-section so that, when the hinge is closed along with the gap between the parts, the passage penetrates the entire length of the sleeve body.

Preferably, the sleeve body is formed from rigid plastics material of a kind which permits a live hinge comprising the plastics material to be provided for the hinge connection between the two parts.

Preferably, sealing formations are provided about the inner face of the passage spaced from the other end of the sleeve body from which the gripping formations are provided.

Preferably, the sealing formations are provided in the form of a plurality of circumferentially running ridges or teeth preferably having a square, rectangular, wedge-shaped, tapered, triangular or pointed circumferential cross section. An inner face of each ridge/tooth or point of contact with the wire can be rounded, pointed or flat, for example. The wire can be snugly or tightly received by the sealing formation. Preferably the ridges or teeth grip or bite into the wire, particularly the exterior insulating coat or sheath of the wire.

The gripping formations are provided on the end of the sleeve body which is insertable into the socket and the engagement and sealing formations are provided on the other end.

The hinged end may be selected as the end which is insertable into the socket, or the other end may be so selected, the gripping, sealing and engagement formations being provided on the appropriate end to accommodate the selection of the insertable end.

Preferably, the conductive spike is supported by a median wall substantially closing the passage intermediate the ends of the connector housing. Preferably, cable guides are included at the open end of the connector housing extending radially inward to engage a plug assembly as hereinbefore described having the wire passing through the passage of the sleeve to form the plug assembly, or a cable introduced directly into the non-conductive connector housing. In one form, the cable guides include a plurality of inwardly directed barbs. Preferably, the cable guides constitute a plurality of complementary engagement formations each in the form of a pawl member, the saw-tooth profile of the engagement formations of the plug assembly constituting a ratchet by which the plug assembly once inserted into the socket assembly is substantially non-removable by virtue of the ratchet and pawl action of the engagement and complementary engagement formations respectively.

Preferably, the liquid sealant is air-activated. Insertion of a wire or a sleeve-encased wire into the open end of the connector housing and into contact with the pin punctures provides electrical connection. The wire or sleeve encased wire may be further inserted with force sufficient to rupture the membrane causing at least some of the liquid sealant to exit from the annular chamber around the wire and pin and set to form a non-conductive plug.

The connector of U.S. Pat. No. 7,211,725 may be considered as a socket for the plug of the present invention. The sealant may be activated by a catalyst, setting compound or other substance if desired.

This aspect of the invention has particular application to making electrical connections in respect of conductors, such as electrical wires, to appliances in a waterproof manner in a moist or wet environment. However, this aspect of the invention has application to making electrical connections in environments which do not require water proofing. This aspect of the invention may also have application to making connections using the electrical connector described in U.S. Pat. No. 7,211,725 and improvements to that connector, hereinafter referred to as the patented connector. However, it will be appreciated that this aspect of the invention is not limited to connection of conductors to or using the patented connector.

Some embodiments of the invention are defined in the paragraphs below.

1. A plug adapted to hold a wire and to be received within a socket, said plug comprising a plug body and a passage extending axially within the plug body for receiving a wire, wherein the plug body is configurable in a first wire-receiving configuration so that a wire can be placed within the passage and a second clamping configuration so that the plug body can clamp to and retain the wire within the passage.

2. The plug of paragraph 1, wherein the plug body clamps to and retains the wire within the passage when a socket receiving end of the plug body has been received within a socket.

3. The plug of paragraph 1 or paragraph 2, wherein the passage extends centrally along a longitudinal axis of the plug body completely through the plug body (and optionally through a socket receiving end of the plug body).

4. The plug of paragraph 2 or paragraph 3, wherein the plug body comprises an inside face and an outside face, and the plug further comprises at least one gripping formation extending inwardly from the inside face for gripping the wire when located within the passage.

5. The plug of paragraph 4, wherein the at least one gripping formation comprises one or more gripping teeth extending along the inside face of the plug body that are pointed in a direction that prevents or minimises the risk of the wire being pulled out of the passage in an axial direction.

6. The plug of paragraph 5, wherein the gripping teeth grip or bite into an exterior insulating coat or sheath of the wire.

7. The plug of any one of paragraphs 4 to 6 further comprising at least one sealing formation extending around the inside face of the plug body, to seal against fluid from flowing between an outer periphery of the wire and the inside face.

8. The plug of paragraph 7, wherein the at least one sealing formation comprises at least one circumferentially extending ridge or tooth that engages the wire.

9. The plug of paragraph 7 or paragraph 8, wherein the at least one sealing formation is spaced from the at least one gripping formation, away from the socket receiving end of the plug body.

10. The plug of any one of paragraphs 2 to 9, wherein the plug body comprises two plug body portions that are hinged together and are moveable together via a hinge into the second clamping configuration.

11. The plug of paragraph 10, wherein the plug body comprises two substantially identical body portions hinged together at an end of the plug body using at least one hinge.

12. The plug of paragraph 11, wherein the substantially identical body portions resemble a sleeve or tube split into longitudinal halves and hinged at an end of the sleeve or tube.

13. The plug of any one of paragraphs 1 to 12, wherein the plug is of unitary construction, preferably being made of plastics material.

14. A connection apparatus comprising the plug of any one of paragraphs 1 to 13 and a socket for receiving the plug.

15. The connection apparatus of paragraph 14, wherein the socket is an opening in an electrical appliance, equipment or device.

16. The connection apparatus of paragraph 14, wherein the socket comprises an opening extending axially within a main body for receiving the plug.

17. The connection apparatus of paragraph 16, wherein the main body comprises an outer face, an inner face that extends around the opening and an end wall that borders a blind end of the opening.

18. The connection apparatus of paragraph 17, wherein the main body is in the form of a sleeve or tube having a sealed or blind end.

19. The connection apparatus of paragraph 17 or paragraph 18, wherein the apparatus comprises at least one engagement formation enabling the plug body to be received within the opening in the socket and to be held or locked in place within the opening.

20. The connection apparatus of paragraph 19 when dependent on any one of paragraphs 4 to 9, wherein the at least one engagement formation comprises the outside face of the plug body comprising teeth that engage further teeth of the at least one engagement formation located at the main body inner face.

21. The connection apparatus of paragraph 19 or paragraph 20, wherein the teeth of the at least one engagement formation are in the form of a pawl and ratchet arrangement whereby the teeth of the pawl engage the ratchet teeth as the plug body is inserted into the socket opening.

22. The connection apparatus of paragraph 19 when dependent on any one of paragraphs 4 to 9, wherein the at least one engagement formation comprises the outside face of the plug body comprising a plurality of circumferentially extending formations in regular spaced relationship axially along the outside face of the plug body that engage complementary formations of the at least one engagement formation located at the main body inner face.

23. The connection apparatus of any one of paragraphs 16 to 22 further comprising a guide for aligning the plug body with the socket main body and guiding it axially within the opening in the socket.

24. The connection apparatus of paragraph 23, wherein the guide is in the form of the plug and socket having a keyway and key arrangement for aligning the plug body with the socket main body and guiding it axially within the opening in the socket.

25. The connection apparatus of any one of paragraphs 17 to 22, wherein the socket comprises an electrical conductor located adjacent the end wall of the socket at the blind end of the opening, for contacting the wire located within the plug.

26. The connection apparatus of paragraph 25, wherein the conductor is in the form of a penetrator for penetrating the wire when the wire of the plug is inserted into the opening in the socket.

27. The connection apparatus of paragraph 26, wherein the conductor or penetrator extends through the end wall of the socket to an exterior of the socket end wall to provide another electrical point of contact.

28. The connection apparatus of paragraph 27, wherein the socket of the connection apparatus functions as an electrical plug that can be plugged into an electrical appliance, equipment or device.

29. The connection apparatus of any one of paragraphs 26 to 28, wherein the socket comprises a sealant located at the blind end of the opening, and the plug body comprises at least one vent for venting air and for receiving at least some of the sealant when the socket receiving end of the plug body is brought into contact with the sealant and displaces the sealant.

30. The connection apparatus of paragraph 29, wherein the sealant sets when exposed to air and renders a connection between the wire and conductor waterproof.

31. The connection apparatus of paragraph 29 or paragraph 30, wherein the socket comprises at least one rupturable membrane or bladder that contains the sealant.

32. The connection apparatus of paragraph 31, wherein the at least one rupturable membrane or bladder is disposed about the penetrator within the blind end of the opening.

33. The connection apparatus of any one of paragraph 29 to 32, wherein the at least one vent comprises a channel extending between the outside face of the plug body and main body of the socket, linking the blind end of the opening to the atmosphere.

34. The connection apparatus of paragraph 33, wherein two said channels extend along opposed longitudinal sides of the outside face to the blind end of the opening.

35. The connection apparatus of any one of paragraphs 31 to 34 further comprising at least one piercer for piercing a wall of the rupturable membrane or bladder containing the sealant.

36. The connection apparatus of paragraph 35, wherein the at least one piercer extends from the socket receiving end of the plug.

37. The connection apparatus of paragraph 35, wherein the at least one piercer extends from the end wall of the main body.

38. The connection apparatus of any one of paragraphs 25 to 37, wherein the socket is in the form of a dual socket for connecting two wires together, said dual socket comprising essentially two said sockets connected at their said end walls, and the conductor of both sockets is connected together.

39. The connection apparatus of any one of paragraphs 25 to 37, wherein the socket is in the form of a socket assembly for connecting many wires together, said socket assembly comprising a plurality of said sockets electrically connected together.

40. The connection apparatus of any one of paragraphs 14 to 39, wherein said connection apparatus provides a fluid-tight connection.

41. A method of forming an electrical connection comprising the steps of: locating a wire within a plug as defined in any one of paragraphs 1 to 13; and receiving the plug within a socket comprising an electrical conductor.

42. A socket as described in any one of paragraphs 14 to 37 and 40, or a dual socket as described in paragraph 38, or a socket assembly as described in paragraph 39.

43. A dual socket assembly for connecting two wires or other types of conductors together, said dual socket assembly comprising two sockets as described in any one of paragraphs 14 to 38 electrically connected together and capable of receiving two plugs as defined in any one of paragraphs 1 to 13.

44. A socket assembly for connecting a plurality of wires or other types of conductors together, said socket assembly comprising a plurality of sockets as described in any one of paragraphs 14 to 37 or 39 electrically connected together and capable of receiving a plurality of plugs as defined in any one of paragraphs 1 to 13.

Yet further embodiments of the invention are defined in the paragraphs below.

1. A plug adapted to hold a wire and to be received within a socket, said plug comprising:

a plug body comprising: a plug adapter engaging end; and a passage extending axially within the plug body for receiving a wire, wherein the plug body is configurable in a first wire-receiving configuration so that a wire can be placed within the passage and extend from the plug adapter engaging end of the plug body, and a second clamping configuration so that the plug body can clamp to and retain the wire within the passage; and a plug adapter comprising: a barrel portion comprising an open-ended chamber for receiving and housing the plug body; and a wire-receiving portion comprising a wire-receiving passage for receiving the wire, such that when the plug adapter houses the plug body the plug is receivable within a socket.

2. A plug adapted to hold a wire and to be received within a socket in a fluid-tight manner, said plug comprising:

a plug body comprising: a plug adapter engaging end; and a passage extending axially within the plug body for receiving a wire, wherein the plug body is configurable in a first wire-receiving configuration so that a wire can be placed within the passage and extend from the plug adapter engaging end of the plug body, and a second clamping configuration so that the plug body can clamp to and retain the wire within the passage; and a plug adapter comprising: a barrel portion comprising an open-ended chamber for receiving and housing the plug body; a wire-receiving portion comprising a wire-receiving passage for receiving the wire; and a sealing arrangement such that when the plug adapter houses the plug body and the plug is received by a socket, the plug body is sealed within the socket in a fluid-tight manner.

3. A connection apparatus comprising the plug of paragraph 1 or paragraph 2 and a socket for receiving the plug.

4. A method of forming an electrical connection comprising the steps of: locating a wire within a plug as defined according to paragraph 1 or paragraph 2; and receiving the plug within a socket comprising an electrical conductor.

5. A dual socket assembly for connecting two wires or other types of conductors together, said dual socket assembly comprising two sockets electrically connected together and capable of receiving two plugs as defined according to paragraph 1 or paragraph 2.

6. A socket assembly for connecting a plurality of wires or other types of conductors together, said socket assembly comprising a plurality of sockets electrically connected together and capable of receiving a plurality of plugs as defined according to paragraph 1 or paragraph 2.

Any of the features described herein can be combined in any combination with any one or more of the other features described herein within the scope of the invention.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of figures as follows.

BRIEF DESCRIPTION OF FIGURES

FIG. 21 is a top view of the plug assembly of FIG. 12 received within the socket of FIG. 18 to form a connection apparatus;

FIG. 22 is a left view of that shown in FIG. 21;

FIG. 23 is a front view of that shown in FIG. 21;

FIG. 24 is a right view of that shown in FIG. 21;

FIG. 25 is a section view of that shown in FIG. 21, taken through plane B-B;

FIG. 26 is a detail view showing part of the connection apparatus of FIG. 25;

Figure 37:
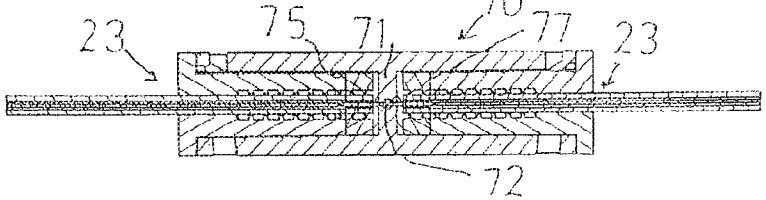
FIG. 37 is a section view of that shown in FIG. 35, taken through plane H-H.
Figure 34:
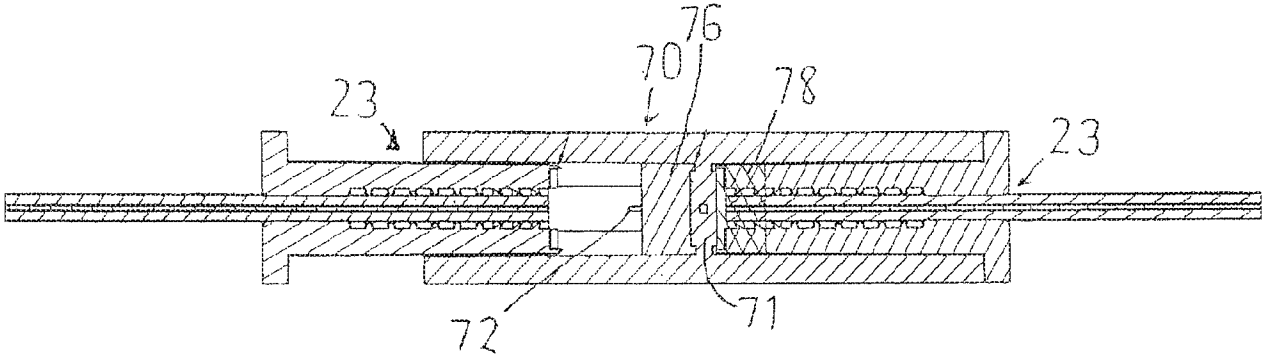
FIG. 34 is a section view of that shown in FIG. 32, taken through plane J-J.
Figure 31:
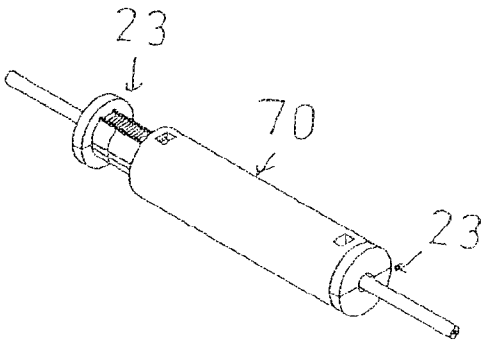
FIG. 31 is an isometric view of that shown in FIG. 30 except a first plug assembly has been fully received within a first socket and a second plug assembly is in the process of being received within a second socket, to form a connection apparatus.
Figure 33:
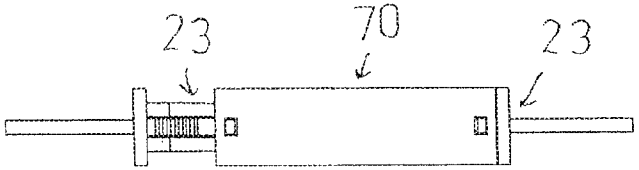
FIG. 33 is a top view of that shown in FIG. 31.
Figure 32:
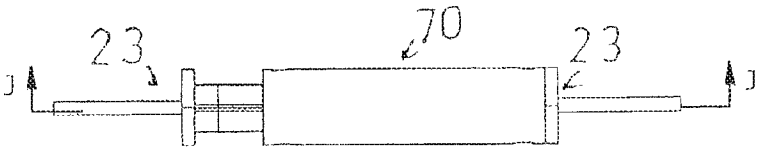
FIG. 32 is a front view of that shown in FIG. 31.
Figure 55A:
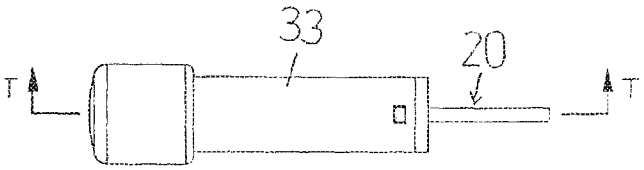
Figure 55B:
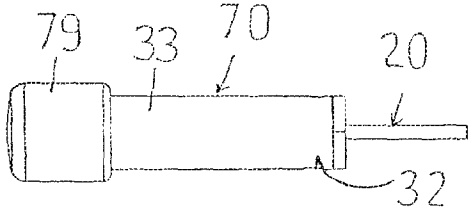
Figure 54:
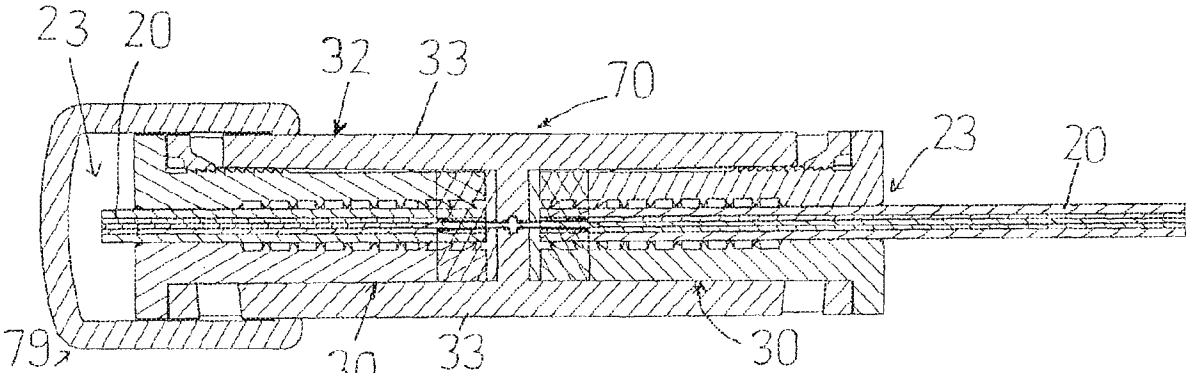
Figure 56:
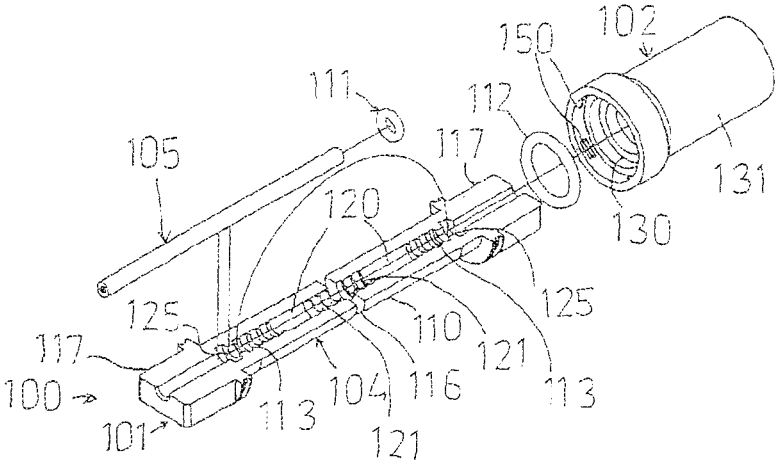
Figure 57:
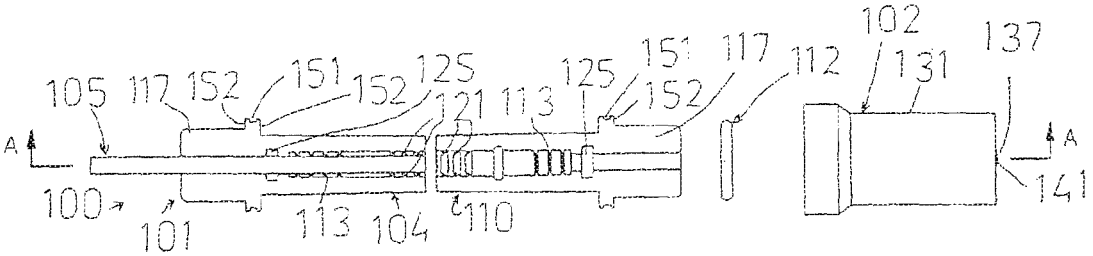
Figure 58:
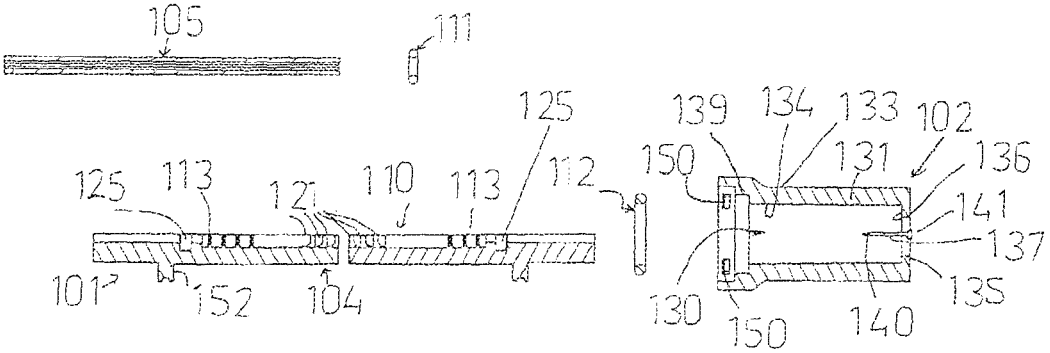
Figure 60:
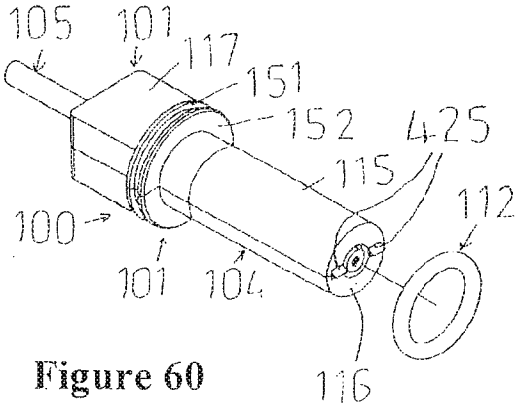
Figure 59:
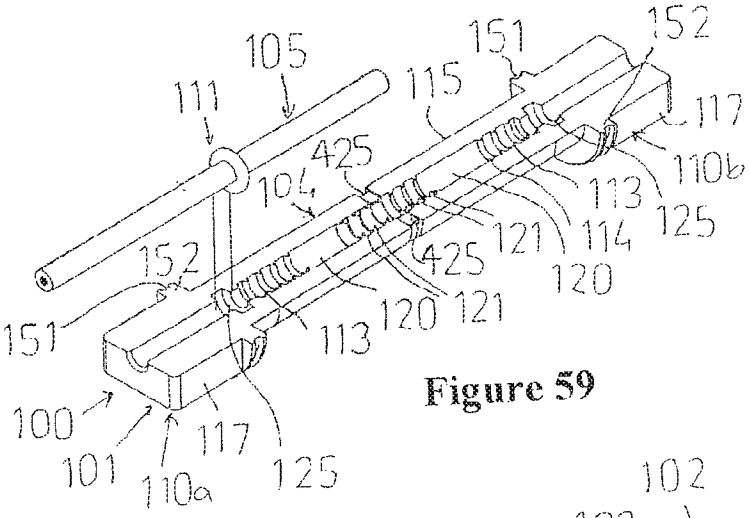
Figure 61:
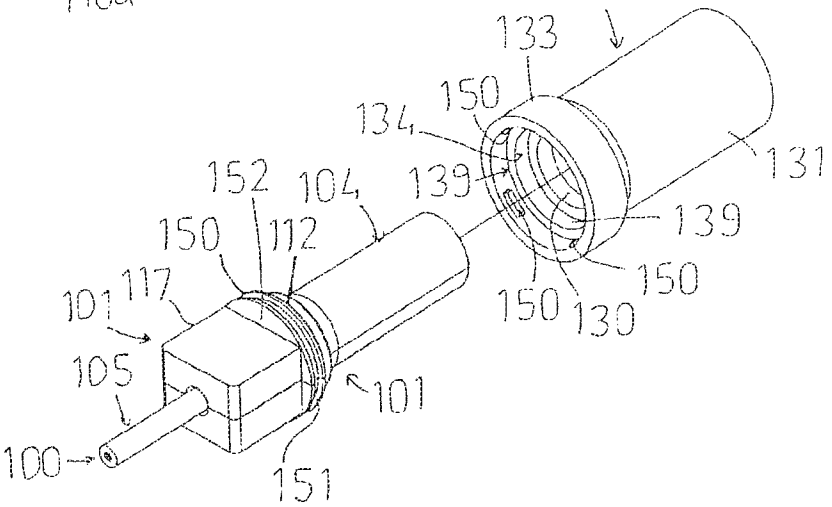
Figure 67:
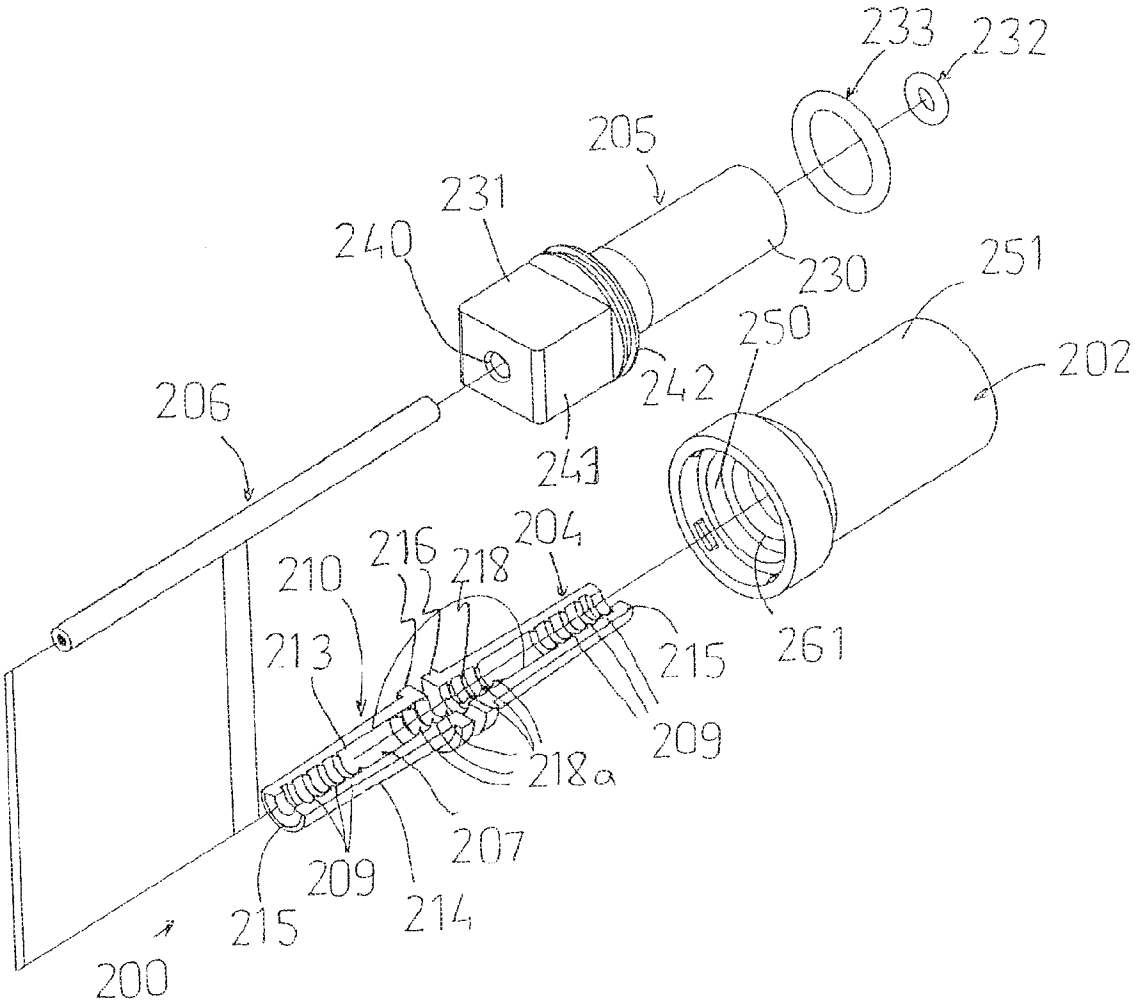
Figure 68:
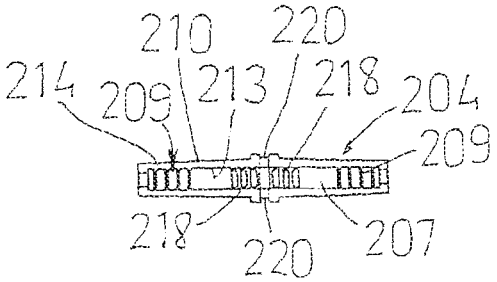
Figure 72:
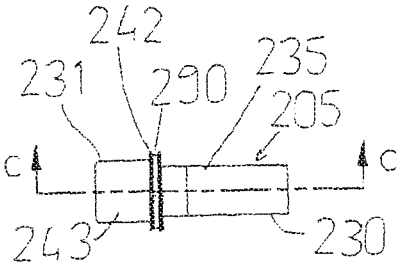
Figure 69:
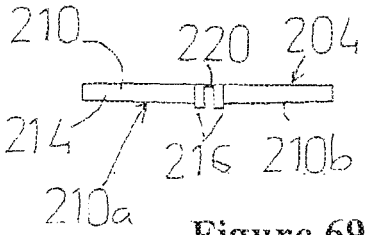
Figure 73:
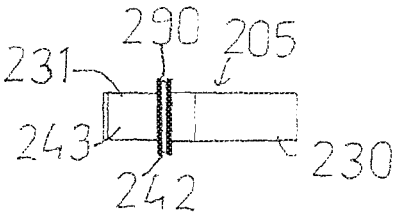
Figure 70:
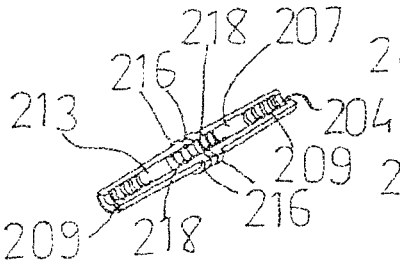
Figure 74:
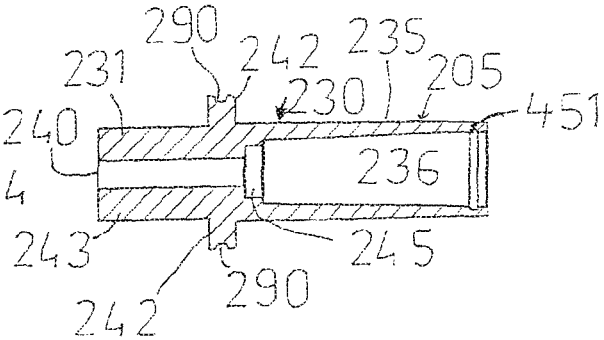
Figure 76:
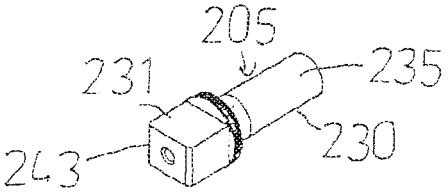
Figure 78:
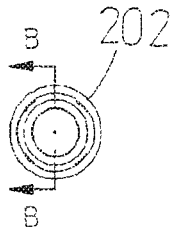
Figure 77:
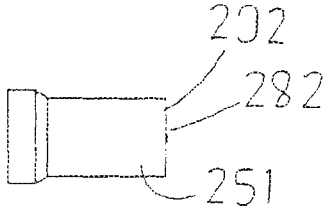
Figure 79:
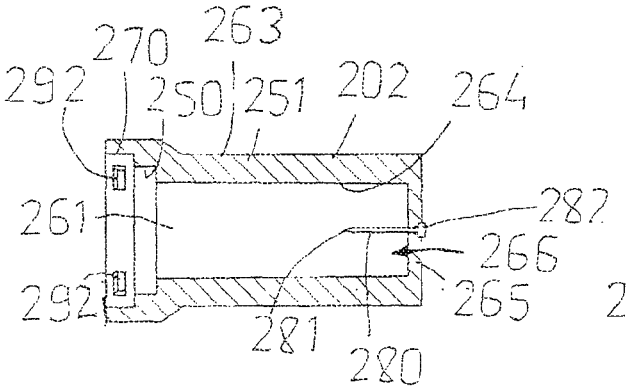
Figure 80:
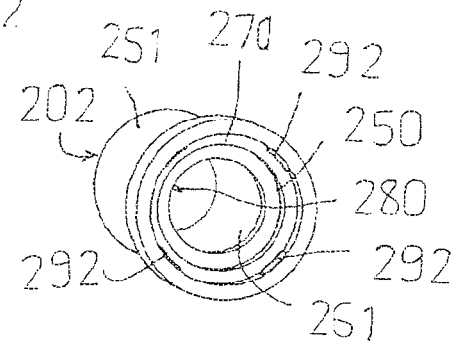
Figure 71:
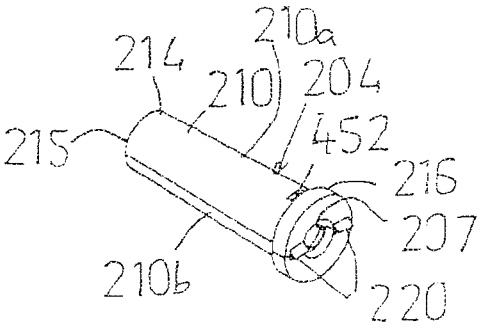
Figure 75:
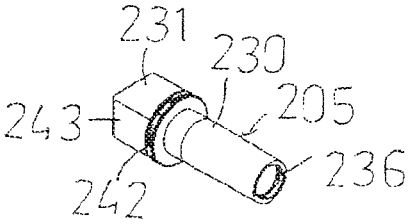
Figure 81:
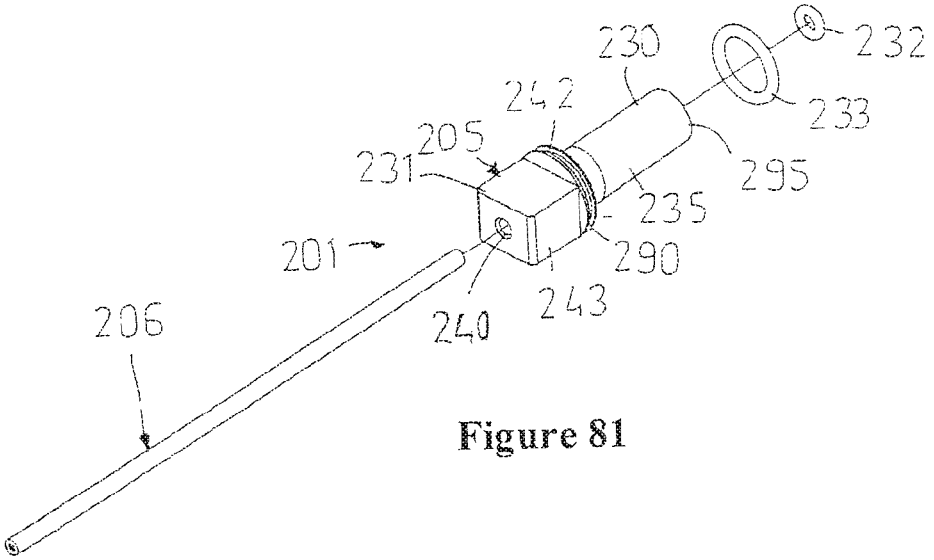
Figure 82:
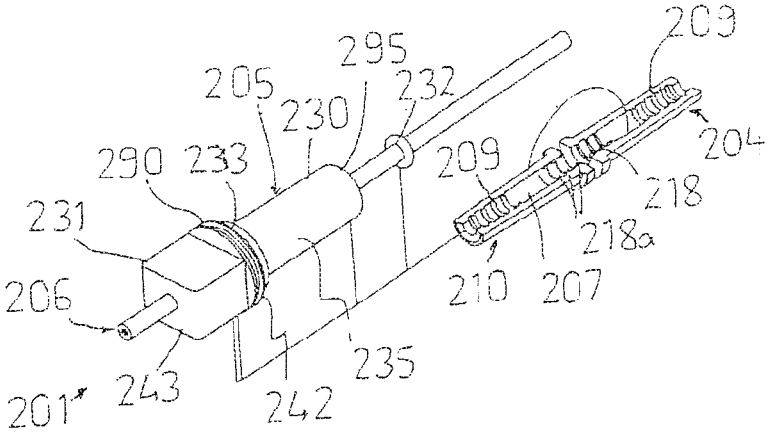
Figure 83:
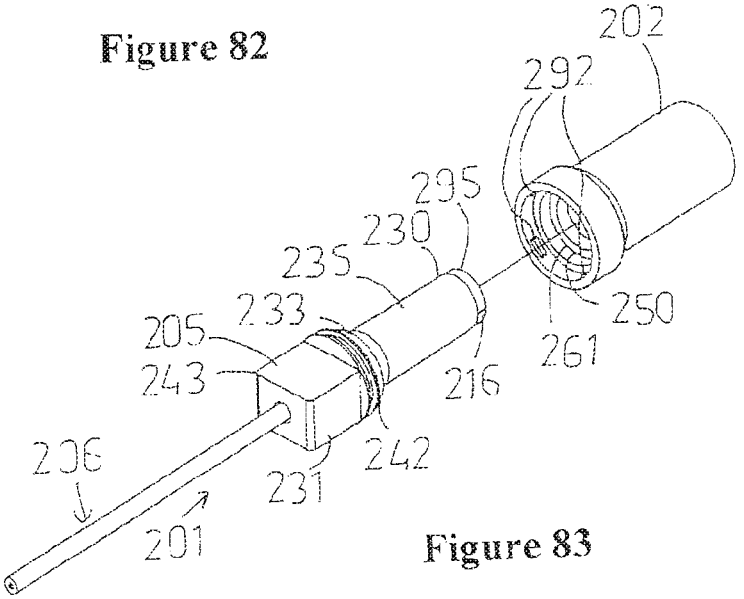
Figure 84:
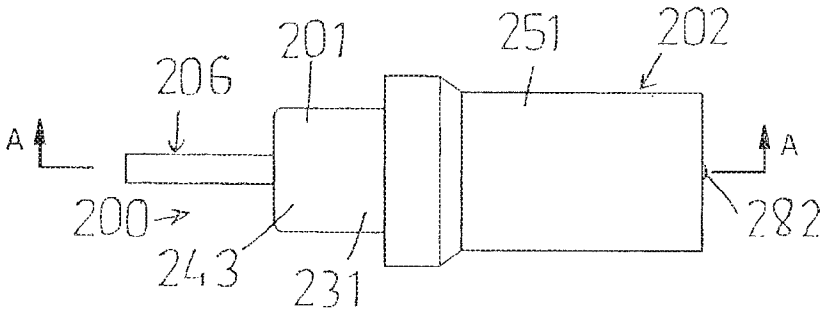
Figure 85:
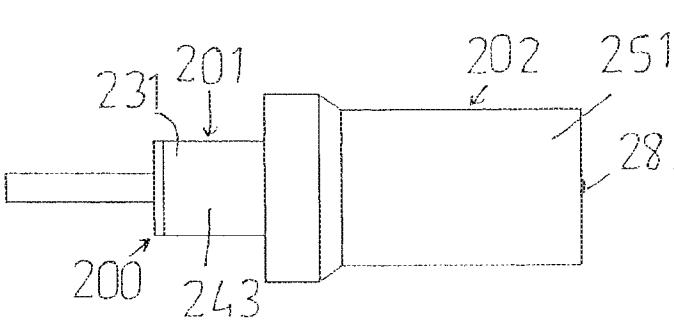
Figure 86:
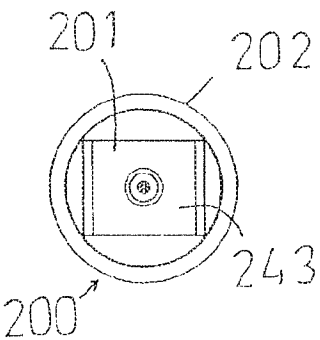
Figure 87:
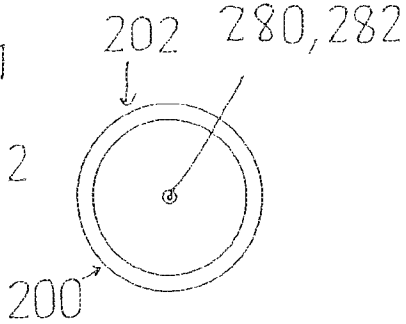
Figure 88:
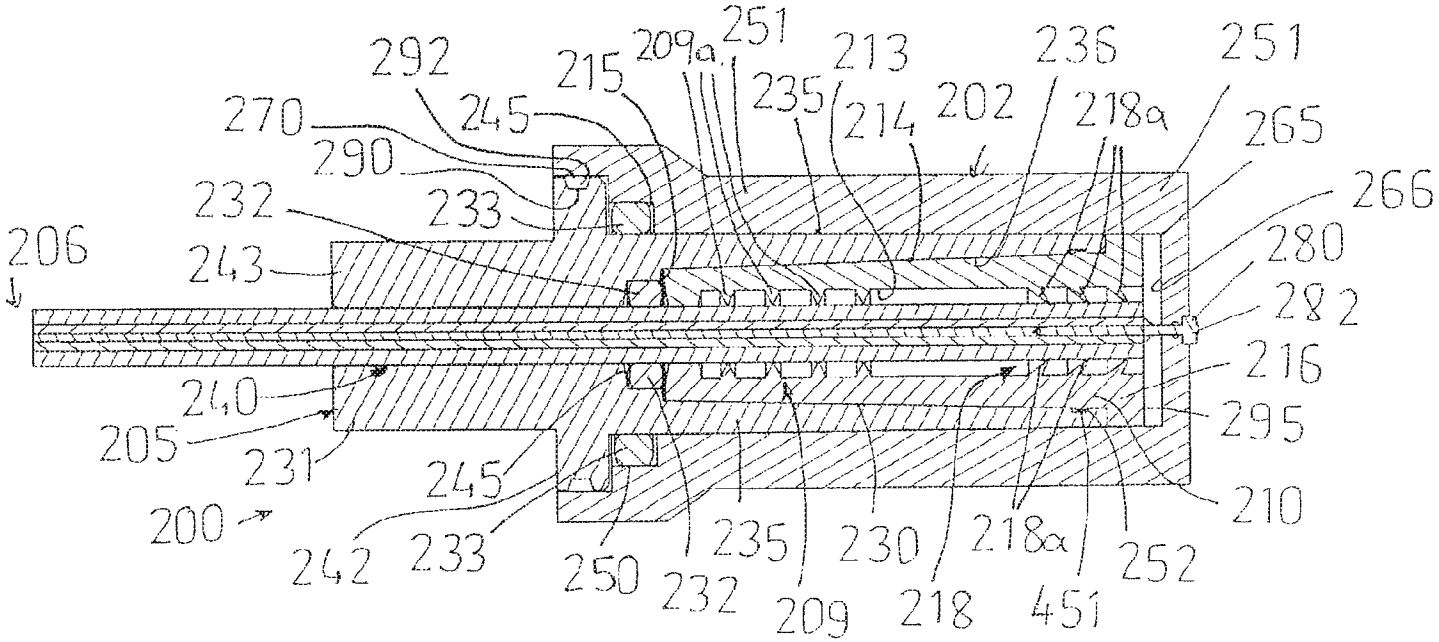
Figure 95:
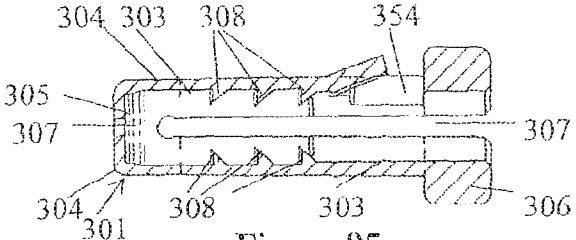
Figure 94:
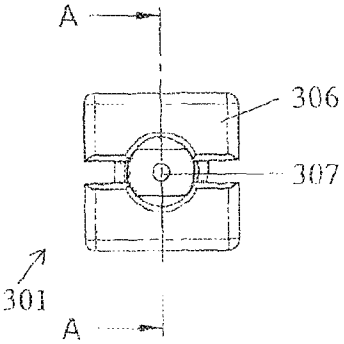
Figure 96:
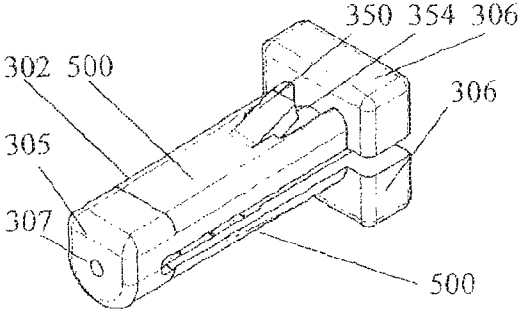
Figure 90:
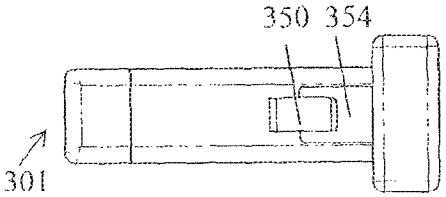
Figure 91:
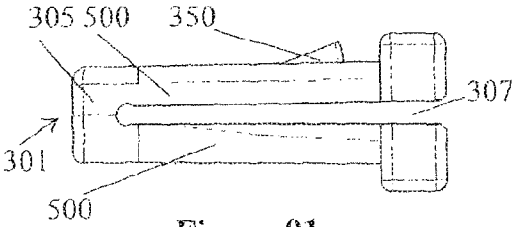
Figure 92:
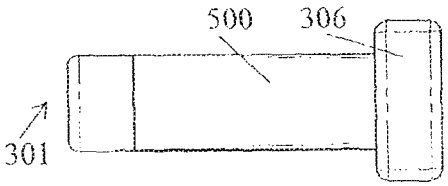
Figure 93:
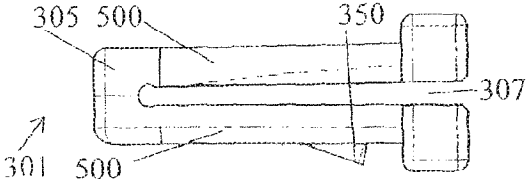
Figure 89:
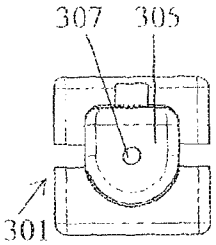
Figure 103:
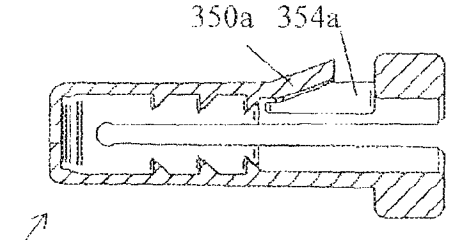
Figure 97:
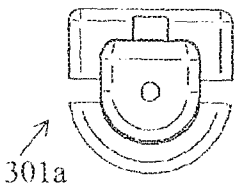
Figure 101:
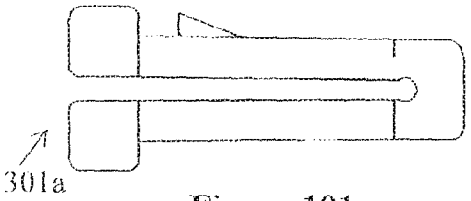
Figure 104:
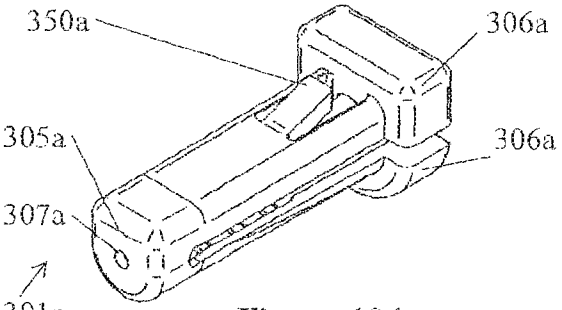
Figure 102:
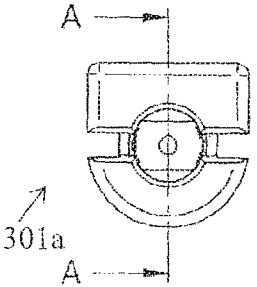
Figure 98:
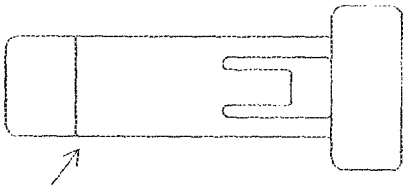
Figure 99:
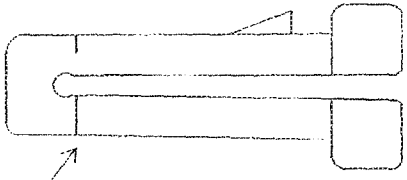
Figure 100:
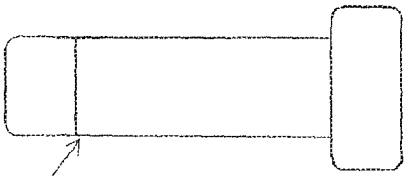
Figure 113:
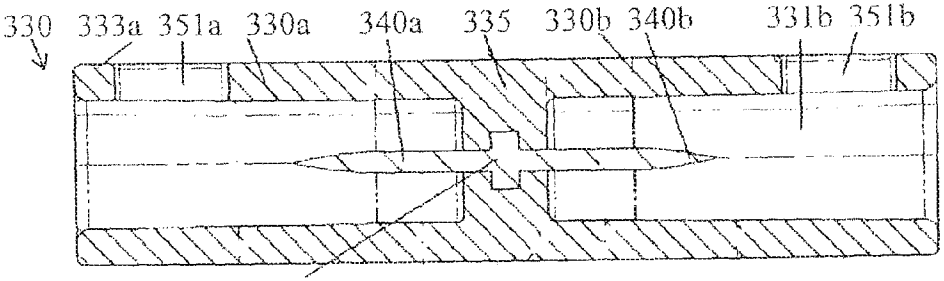
Figure 114:
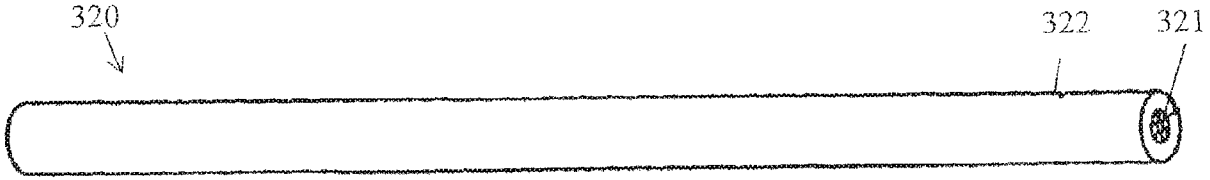
Figure 115:
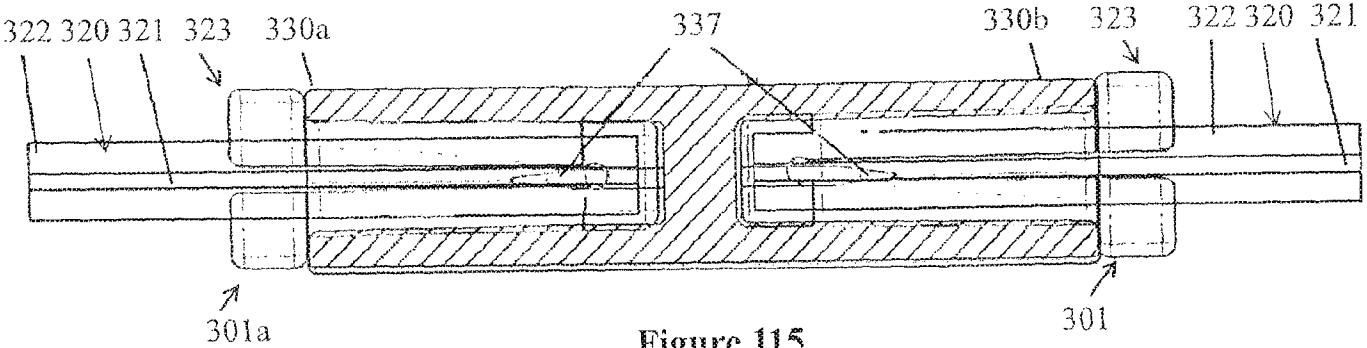
Figure 117:
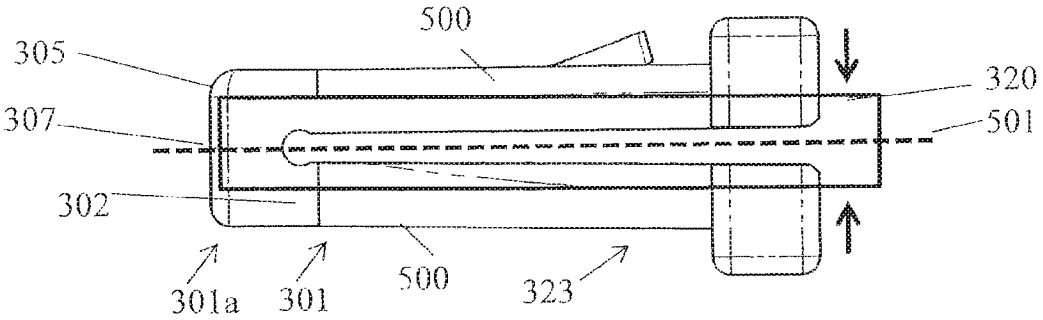
Figure 116:
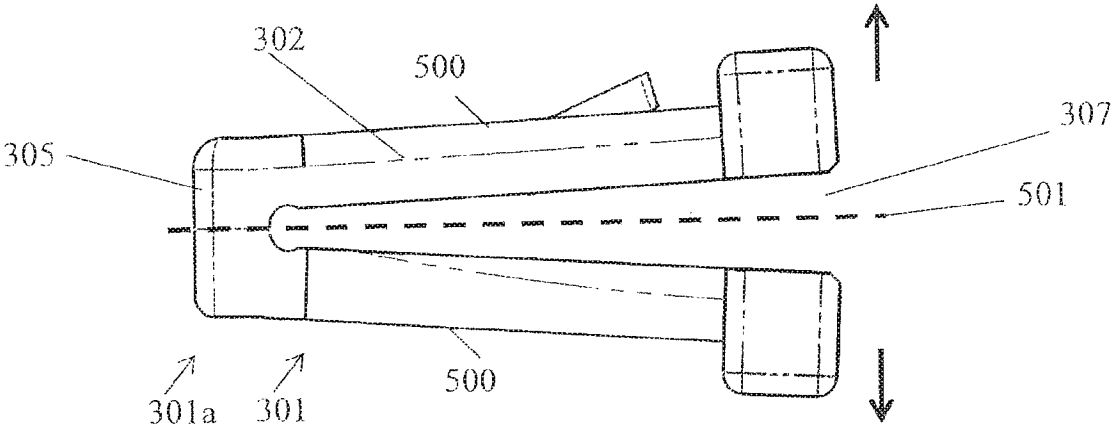

FIG. 54 is essentially the same as FIG. 37, except further showing a closure of the connection apparatus, according to an embodiment of the present invention;

FIG. 55*a* is a top view of that shown in FIG. 54, and FIG. 55*b* is a side view of that shown in FIG. 54;

FIG. 56 is an exploded isometric view of a wire, plug and socket, together forming an electrical connection apparatus, according to an embodiment of the invention;

FIG. 57 is a top view of that shown in FIG. 56;

FIG. 58 is a longitudinal cross-sectional view taken through plane A-A of FIG. 57;

FIG. 59 shows a first stage of assembling an electrical connection apparatus using the components shown in FIG. 56;

FIG. 60 shows a second stage of assembling an electrical connection apparatus;

FIG. 61 shows a third stage of assembling an electrical connection apparatus;

FIG. 62 is a top view showing an assembled electrical connection apparatus;

FIG. 63 is a left view of the apparatus shown in FIG. 62;

FIG. 64 is a front view of the apparatus shown in FIG. 62;

FIG. 65 is a right view of the apparatus shown in FIG. 62;

FIG. 66 is a longitudinal cross-sectional view taken through plane B-B of FIG. 62;

FIG. 67 is an exploded isometric view of a wire, plug and socket together forming an electrical connection apparatus, according to an embodiment of the invention;

FIG. 68 is a top view of the plug shown in FIG. 67;

FIG. 69 is a front view of the plug shown in FIG. 68;

FIG. 70 is an isometric view of the plug shown in FIG. 68;

FIG. 71 is an isometric view of the plug shown in FIG. 68, but configured to grip a wire;

FIG. 72 is a top view of the plug adapter shown in FIG. 67;

FIG. 73 is a front view of the adapter shown in FIG. 67;

FIG. 74 is a longitudinal cross-sectional view of the adapter shown in FIG. 72, taken through plane C-C;

FIG. 75 is an isometric view of the adapter shown in FIG. 67;

FIG. 76 is another isometric view of the adapter shown in FIG. 67;

FIG. 77 is a front view of the socket shown in FIG. 67;

FIG. 78 is a left view of the socket shown in FIG. 67;

FIG. 79 is a longitudinal cross-sectional view of the socket shown in FIG. 78, taken through plane B-B;

FIG. 80 is a perspective view of the socket shown in FIG. 67;

FIG. 81 shows a first stage of assembling an electrical connection apparatus using the components shown in FIG. 67;

FIG. 82 shows a second stage of assembling an electrical connection apparatus;

FIG. 83 shows a third stage of assembling an electrical connection apparatus;

FIG. 84 is a top view showing an assembled electrical connection apparatus;

FIG. 85 is a front view of that shown in FIG. 84;

FIG. 86 is a left view of that shown in FIG. 84;

FIG. 87 is the right view of that shown in FIG. 84;

FIG. 88 is a longitudinal cross-sectional view of the electrical connection apparatus of FIG. 84, taken through plane A-A;

FIG. 89 is an end view of a plug, according to an embodiment of the invention;

FIG. 90 is a top view of the plug shown in FIG. 89;

FIG. 91 is a front view of the plug shown in FIG. 89;

FIG. 92 is bottom view of the plug shown in FIG. 89;

FIG. 93 is a rear view of the plug shown in FIG. 89;

FIG. 94 is another end view of the plug shown in FIG. 89;

FIG. 95 is a sectional view of the plug shown in FIG. 94, taken through plane A-A;

FIG. 96 is an isometric view of the plug shown in FIG. 89;

FIG. 97 is an end view of a plug, according to an embodiment of the invention;

FIG. 98 is a top view of the plug shown in FIG. 97;

FIG. 99 is a front view of the plug shown in FIG. 97;

FIG. 100 is bottom view of the plug shown in FIG. 97;

FIG. 101 is a rear view of the plug shown in FIG. 97;

FIG. 102 is an end view of the plug shown in FIG. 97;

FIG. 103 is a sectional view of the plug shown in FIG. 102, taken through plane A-A;

FIG. 104 is an isometric view of the plug shown in FIG. 102;

FIG. 105 is an isometric view of a dual socket, according to an embodiment of the present invention;

FIG. 106 is a top view of the socket shown in FIG. 105;

FIG. 107 is a sectional view of the socket shown in FIG. 106, taken through plane A-A;

FIG. 108 is a bottom view of the socket shown in FIG. 105;

FIG. 109 is a rear view of the socket shown in FIG. 105;

FIG. 110 is a front view of the socket shown in FIG. 105;

FIG. 111 is an end view of the socket shown in FIG. 105;

FIG. 112 is another end view of the socket shown in FIG. 105;

FIG. 113 is a sectional view of the socket shown in FIG. 106, taken through plane B-B;

FIG. 114 is an isometric view of a wire the can be held by the plug of FIG. 89 or FIG. 97;

FIG. 115 is a cross-sectional view of a connection apparatus comprising the dual socket shown in FIG. 107, a first plug as shown in FIG. 89, a second plug as shown in FIG. 97, and two insulated wires of the type shown in FIG. 114;

FIG. 116 shows the plug of FIG. 89 or FIG. 97 in a first wire receiving configuration; and FIG. 117 shows the plug of FIG. 89 or FIG. 97 in a second wire clamping configuration.

DETAILED DESCRIPTION OF EMBODIMENTS

In the figures like reference numerals refer to like features (eg. 1*a* and 1*b* are like features).

The figures show different types of connection apparatuses generally comprising different types of plugs and sockets, wherein each plug can clamp a wire and be retained within a general socket of sorts.

Figure 17:
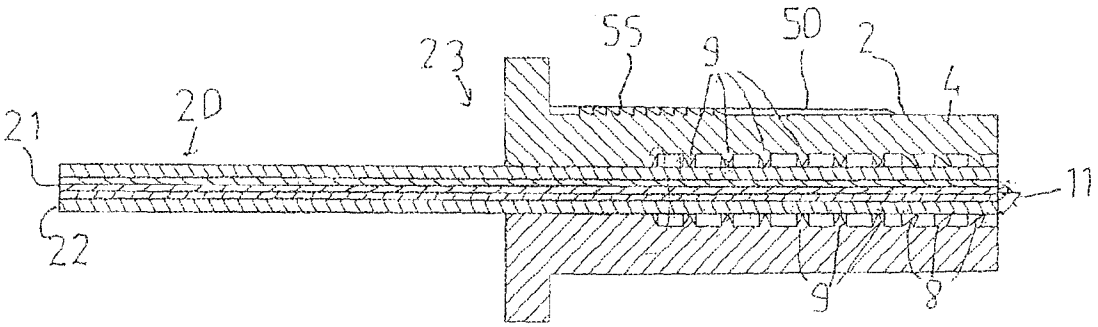
FIG. 17 is a section view of that shown in FIG. 13, taken through plane E-E.
Figure 18:
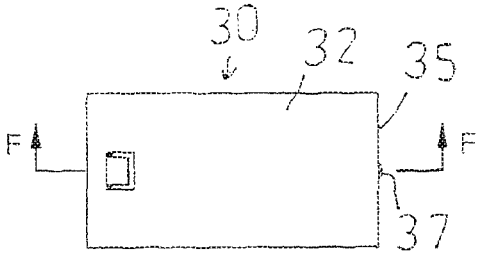
FIG. 18 is a top view of the socket shown in FIG. 9.
Figure 19:
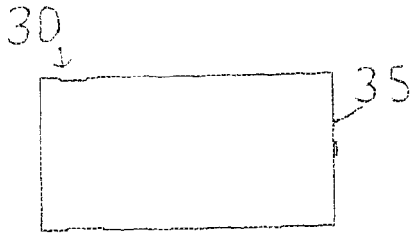
FIG. 19 is a front view of the socket shown in FIG. 18.

Referring first to FIGS. 1-17, there is shown a plug 1 for clamping a wire 20, that together with the wire 20 form a plug assembly 23 as seen in FIGS. 13 to 17, according to an embodiment of the invention. The wire 20 in this example has a conductive filament interior 21 and an insulating sheathed exterior 22, as best seen in FIGS. 1 and 17.

Figure 1:
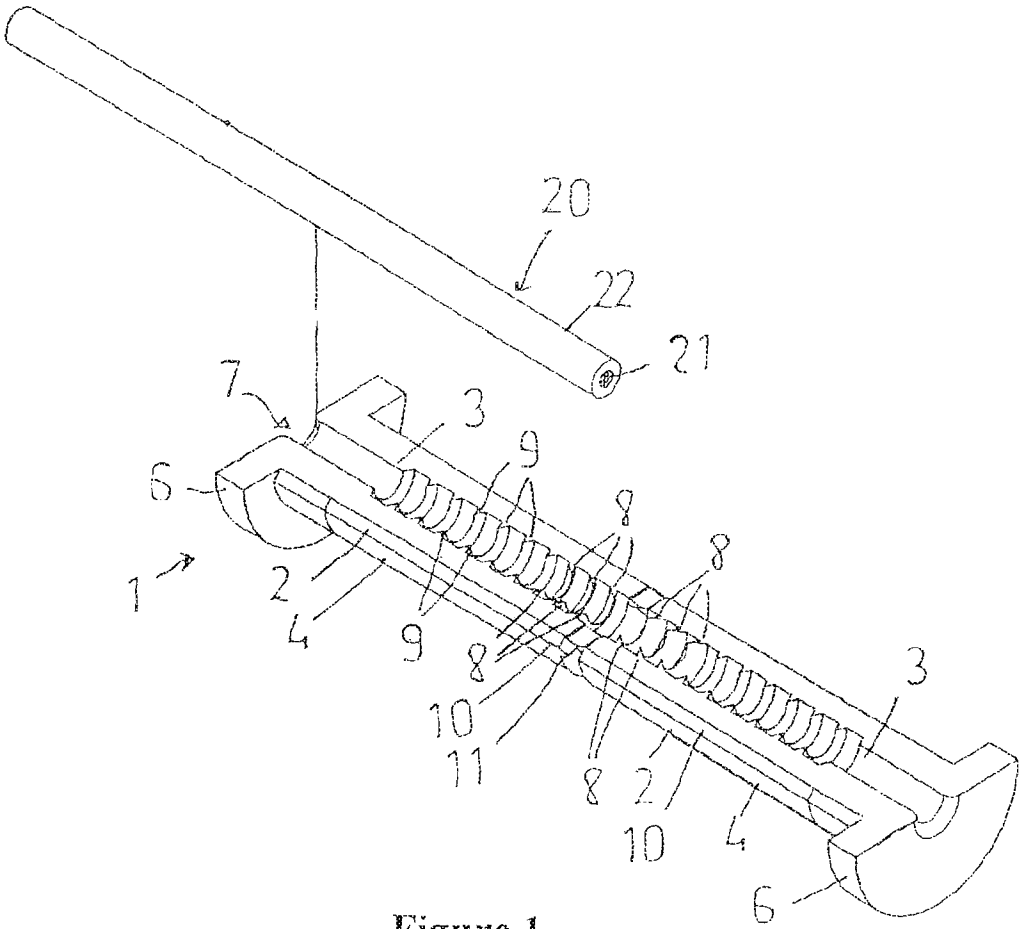
FIG. 1 is an exploded isometric view of a wire and a plug in a wire-receiving configuration, according to an embodiment of the invention.
Figure 2:
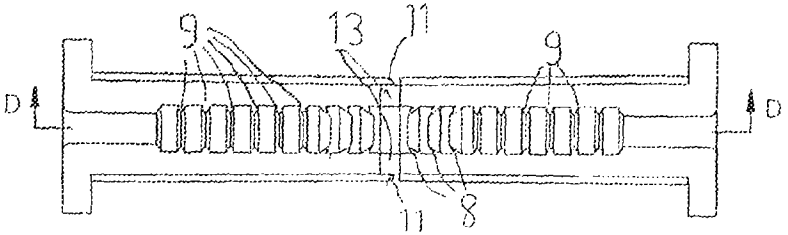
FIG. 2 is a top view of the plug shown in FIG. 1.
Figure 3:
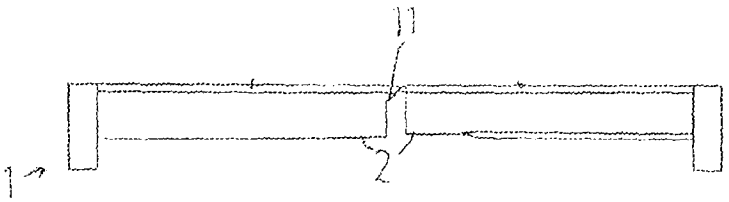
FIG. 3 is a front view of the plug shown in FIG. 1.
Figure 4:
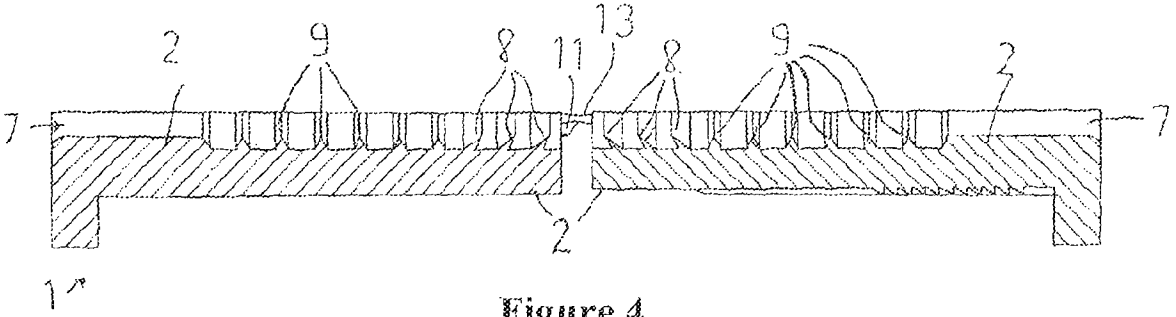
FIG. 4 is a section view of the plug shown in FIG. 2, taken through plane D-D.
Figure 5:
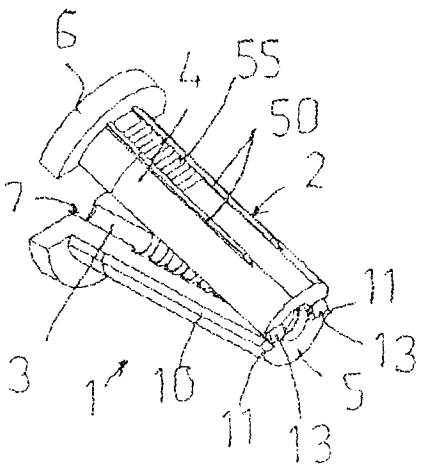
FIG. 5 is an isometric view of the plug shown in FIG. 1, but shown in a different configuration.
Figure 6:
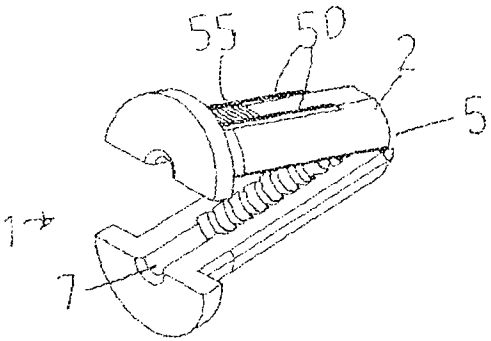
FIG. 6 is another isometric view of the plug shown in FIG. 5.
Figure 7:
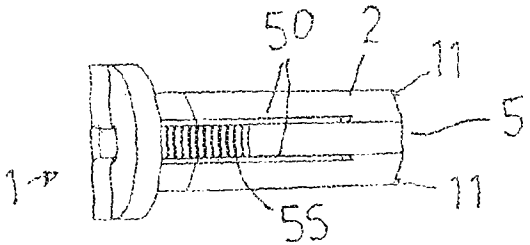
FIG. 7 is a top view of the plug shown in FIG. 5.
Figure 8:
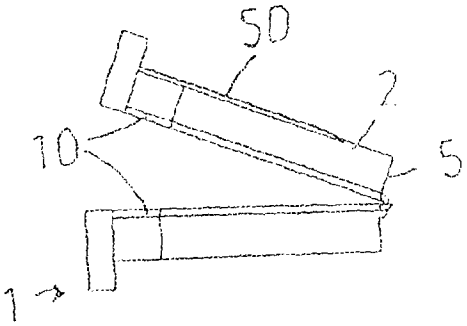
FIG. 8 is a front view of the plug shown in FIG. 5.
Figure 9:
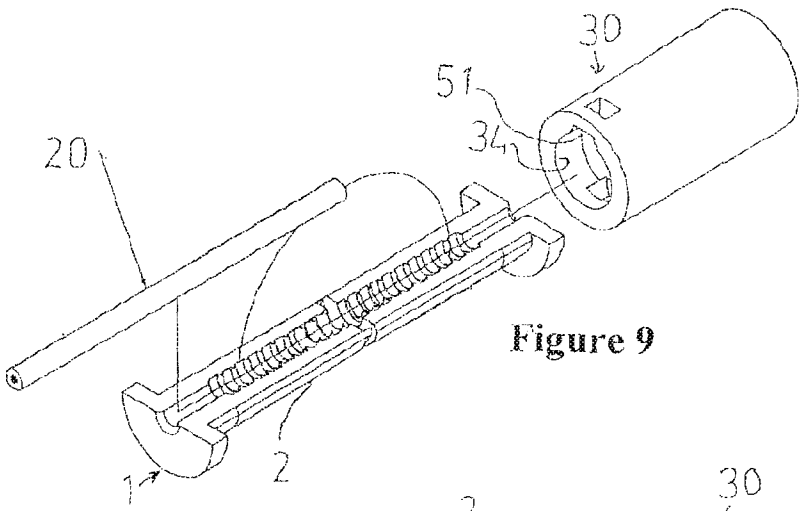
FIG. 9 is an exploded isometric view of the wire and plug shown in FIG. 1 and a socket, together forming an electrical connection apparatus, according to an embodiment of the invention.
Figure 10:
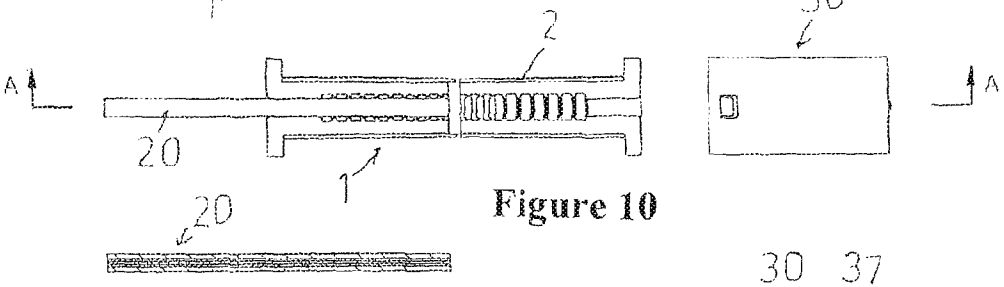
FIG. 10 is a top view of that shown in FIG. 9.
Figure 11:
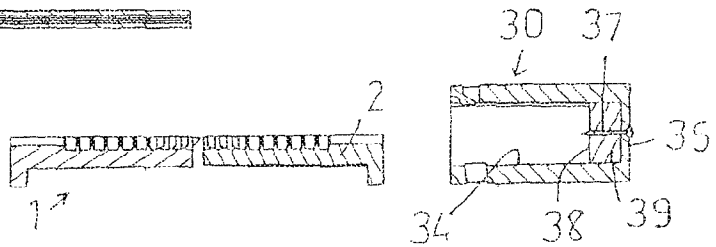
FIG. 11 is a section view of that shown in FIG. 10, taken through plane A-A.
Figure 12:
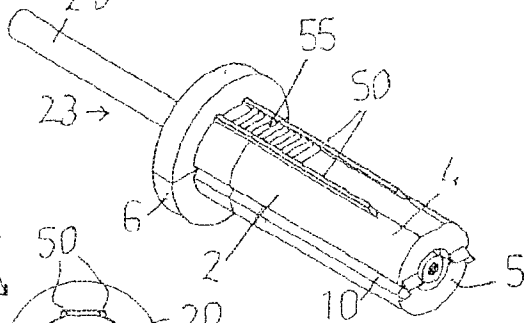
FIG. 12 is an isometric view of the plug shown in FIG. 1 but shown in a wire-clamping configuration, whereby the wire of FIG. 1 is clamped by the plug to form a plug assembly.
Figure 15:
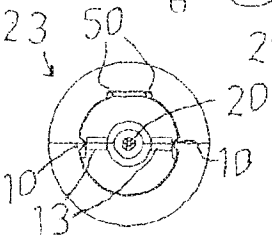
FIG. 15 is a right view of that shown in FIG. 12.
Figure 13:
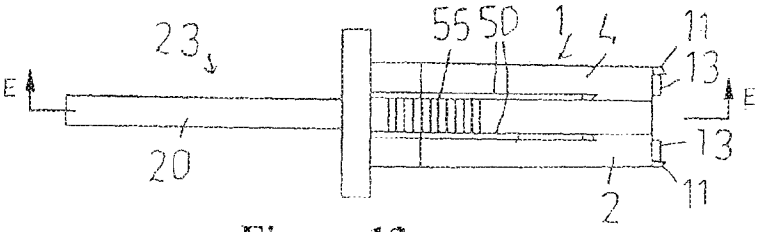
FIG. 13 is a top view of that shown in FIG. 12.
Figure 14:
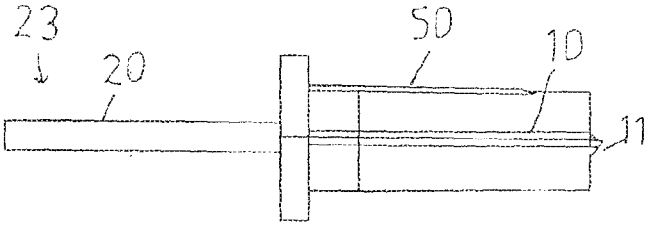
FIG. 14 is a front view of that shown in FIG. 12.
Figure 16:
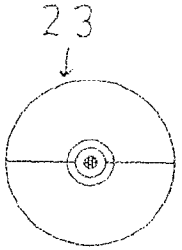
FIG. 16 is a left view of that shown in FIG. 12.

As seen in FIGS. 1, 5 and 12, the plug 1 includes a plug body 2 having an inside face 3, an outside face 4, a socket receiving end 5 (plug end wall 5) and an enlarged head (flange) 6 at an opposing end. The plug 1 includes a passage 7 extending axially through the plug body 2, including the plug end wall 5, for snugly receiving a wire 20, a gripping formation 8 extending inwardly from the inside face 3 for gripping the wire 20 when located within the passage 7, a sealing formation 9 extending around the inside face 3 of the plug body 2 to seal against fluid (such as air or sealant as described later) from flowing between an outer periphery of the wire 20 and the inside face 3, a vent 10 (for air or sealant as described later), and two piercers 11.

The passage 7 extends centrally along a longitudinal axis of the plug body 2, completely through the plug body 2, including the plug end wall/socket receiving end 5.

Alternatively, an end of the passage 7 at the socket receiving end 5 could be blind or substantially blind, so as to completely or substantially isolate and insulate an end of the wire 20 for a non-electrical connection with the socket. If blind, the socket can simply help isolate an end of the wire from electrical contact or the elements, such as rain or moisture. Alternatively, the socket could be used as a means of labelling/identifying the wire/nature of the wire/intended purpose for the wire.

The diameter of the passage 7 will vary in accordance with the gauge of the wire, such that the fit is snug.

The gripping formation 8 has tapered teeth (barbs) extending as circumferential pointed ridges around the inside face 3, and spaced apart from one another along the inside face 3 relative to the longitudinal axis (not all of the teeth 8 have been labelled). Sharp edges of the teeth 8 are pointed towards the socket receiving end 5 so as to prevent or minimise the risk of the wire 20 being pulled out of the passage 7 in an axial direction.

Figure 43:
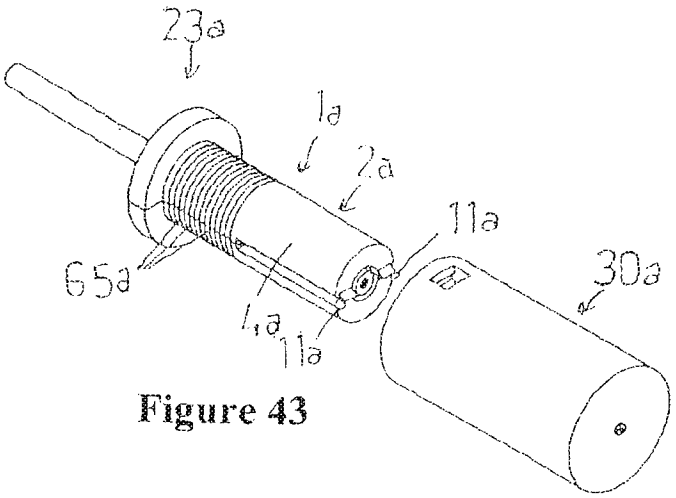
FIG. 43 is an isometric view of a connection apparatus like that shown in FIG. 25, except that the plug and socket differ slightly from those shown in FIG. 25, according to another embodiment of the invention.
Figure 42:
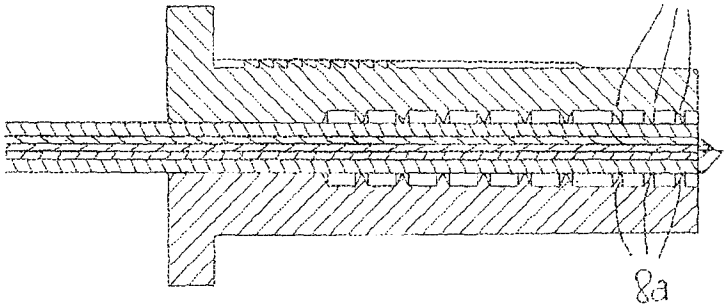
FIG. 42 is a longitudinal section view of another embodiment of a plug which differs slightly from the plug shown in FIG. 17, according to another embodiment of the invention.

FIGS. 42 and 43, in another embodiment, show that the pointed edges of the teeth 8*a* (all of which have been labelled in FIG. 42) can extend perpendicularly towards the central longitudinal axis, rather than towards the socket receiving end 5.

The teeth 8, 8*a* may or may not deflect when gripping or biting the wire 20. That is, the teeth 8, 8*a* may be flexible or rigid in differing circumstances depending on the nature of the wire—for example, whether insulated or not, and whether flexible or malleable or not. The teeth 8, 8*a* as illustrated can grip or bite into the exterior insulating coat or sheath of the wire 20.

Referring chiefly now to FIGS. 1 to 17, the sealing formation 9 has ridges extending as circumferential pointed ridges/teeth 9 around the inside face 3, and spaced apart from one another along the inside face 3 relative to the longitudinal axis (not all of the sealing formation ridges/teeth 9 have been labelled). The pointed ridges/teeth 9 contact an outer periphery of the wire 20.

The two piercers 11 are spikes that extend from the socket receiving end 5 (plug end wall 5) of the plug body 2.

The vent 10 is in the form of two V-shaped channels 10 that extend longitudinally along the outside face 4 of the plug body 2, at opposing sides of the plug body 2. Each channel 10 extends from the socket receiving end 5 to the enlarged head 6.

As seen in FIGS. 1-4, the plug body 2 comprises two substantially identical body halves 2 that are hinged together at the socket receiving end 5 by way of two live hinges/fold lines 13. FIGS. 1-11 show that the plug body 2 is configurable in a first wire-receiving configuration so that a wire 20 can be snugly seated within part of the passage 7 so that an end of the wire 20 sits flush with the plug end wall 5, and FIGS. 12-17 show that the plug body 2 is configurable in a second clamping configuration so that the plug body 2 can clamp to and retain the wire 20 within the passage 7 after the plug 1 has been received within a socket 30 (see FIGS. 21-25). The plug body 2 is in the form of a cylindrical sleeve/tube extending around the wire 20 when in the second clamping configuration. Clamping of the wire 20 is most clearly shown in FIGS. 12-17. Although the plug 2 can be manufactured in a form as shown in FIG. 1 and then manipulated into the form shown in FIGS. 5 to 8 and then manipulated further to clamp a wire 20 as shown in FIG. 12, it is to be understood that the plug 2 may be manufactured in a different form from that shown in FIG. 1.

The plug 1 as illustrated is of unitary construction and is made of moulded plastics material having a Shore D hardness of approximately 85+, or 100-120R Rockwell.

Referring now to FIGS. 18-26, there is shown in a socket 30 for receiving the plug assembly 23, according to embodiment of the present invention. The socket 30 includes an opening 31 extending axially within a main body 32 for receiving the socket receiving end 5 of the plug body 2. The main body 32 is in the form of a sleeve and has an outer face 33 and an inner face 34 that extends around the opening 31. The socket 30 has an end wall 35 that borders a blind end 36 of the opening 31.

The socket main body 32 and end wall 35 can be made of any suitable non-conductive material or materials such as plastics material, rubber, carbon fibre, insulated metal or ceramics material. The socket main wall and end wall are preferably made of plastics material, and may have a Shore D hardness of approximately 85+ or 100-120R Rockwell.

The socket 30 as illustrated in FIGS. 11 and 18-25 is for making a waterproof electrical connection. To that end, the socket 30 includes a conductive penetrator 37 (conductor) in the form of a conductive spike 37 and a rupturable membrane/bladder 38 containing a sealant 39 within the blind end 36 of the opening 31.

The conductive spike 37 has a sharpened end 40 (see FIGS. 20 and 25) extending within the opening 31 that is capable of penetrating the conductive filament 21 of the wire 20 (and outer insulating coating/sheath 22, if required). Another end of the conductive spike 37 extends through the end wall 35 in a sealed manner and has an enlarged head (electrical contact point) 41 that protrudes slightly from the end wall 35 (see FIGS. 20 and 25).

The rupturable membrane/bladder 38 containing the sealant 39 extends as an annulus about the conductive spike 37. In this embodiment the sealant 39 is a liquid chemical which, when exposed to air or alternatively moisture, cures/hardens. In use, as the plug body 2 is inserted into the socket opening 31, the two piercers 11 rupture the membrane 38, thereby releasing the liquid sealant 39 from the membrane/bladder 38. As the socket receiving end 5 of the plug 1 is moved toward the end wall 35, the conductive spike 37 penetrates the wire 20 and the sealant 39 and air are displaced from the blind end 36 of the opening 31 and flow into the wire 20 and passage 7, as well as between the outside face 4 of the plug body 2 and inner face 34 of the socket main body 32 and in particular through the vent channels 10. In this way, the sealant adheres to the plug body 2, wire 20 and socket main wall 32 and end wall 35, and renders the connection between the wire filament 21 and conductive spike 37 waterproof. Normally, due to the volume of sealant 39 present, the sealant 39 fills the vent channels 10 but does not overflow the socket main body 32.

Depending on the nature of the sealant, the socket 30 can contain two separate membranes/bladders each of which contains different sealant components which, once mixed, cure/harden (eg. multi-part adhesives). The membranes/bladders may be located within the blind end of the opening—each side of the conductive spike 37. In such an instance, the connection apparatus may have more than one piercer.

The sealant is preferably insoluble, non-conducting, corrosion resistant and adhesive. It is preferably a liquid, although it need not be free-flowing. The term includes all types of sealants usually used for electrical work, including adhesives, cements, pastes and other settable materials. Examples include silicone-based sealants, drying adhesives, contact adhesives, one-part adhesives and multi-part adhesives (polyester resin—polyurethane resin, polyols—polyurethane resin, and acrylic polymers—polyurethane resins). This list is by no means exhaustive.

Figure 44:
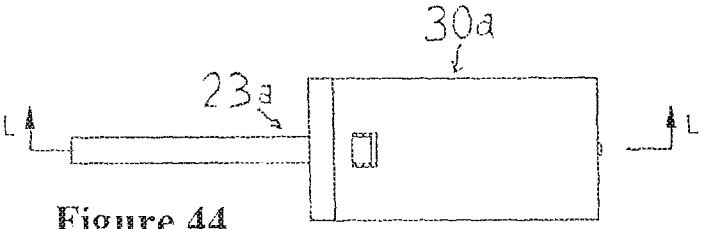
FIG. 44 is a top view of the plug and socket shown in FIG. 43, except that the plug assembly has been received within the socket to form a connection apparatus, according to an embodiment of the invention.
Figure 45:
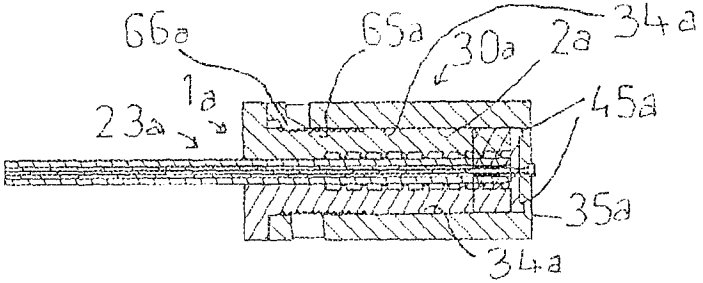
FIG. 45 is a section view of that shown in FIG. 44, taken through plane L-L.

The embodiment of FIGS. 43 to 45 shows that the plug 1*a* can have piercers 11*a* that are received within a circular recess 45*a* in an end wall 35*a* of a socket 30*a*.

Figure 46:
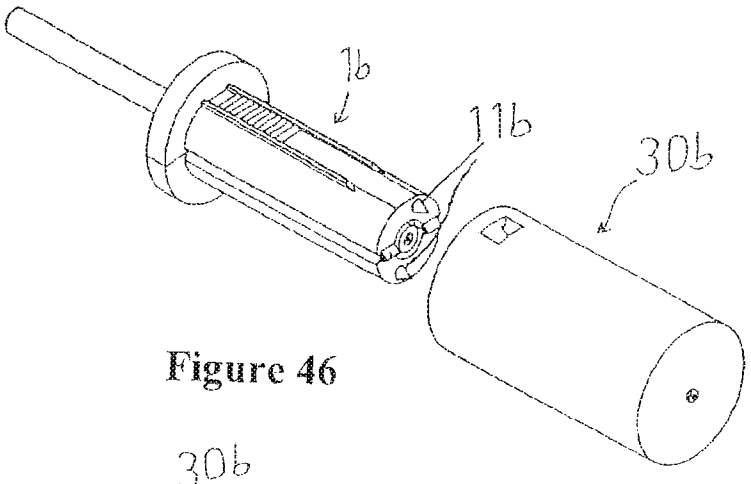
FIG. 46 is an isometric view of a plug and socket which differ slightly from those shown in FIG. 45, according to another embodiment of the invention.
Figure 47:
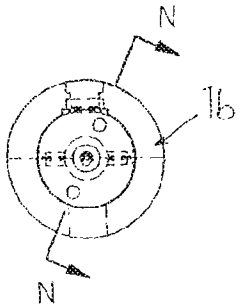
FIG. 47 is an end view of that shown in FIG. 46.
Figure 48:
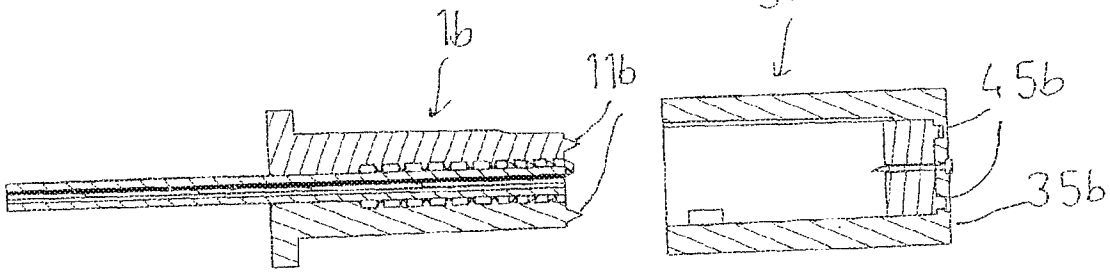
FIG. 48 is a section view of that shown in FIG. 47, taken through plane N-N.

The embodiment of FIGS. 46 to 48 shows that the plug 1*b* can have a different arrangement of piercers 11*b* that are received with a circular recess 45*b* in an end wall 35*b* of a socket 30*b*.

Figure 49:
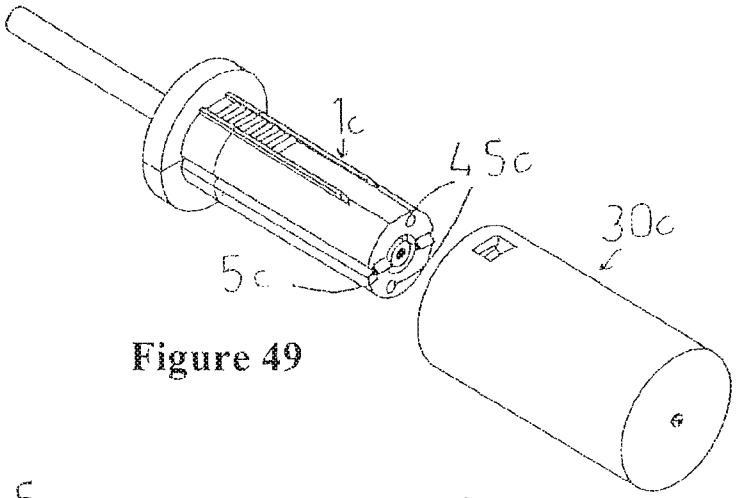
FIG. 49 is an isometric view of a plug and socket which differ slightly from those shown in FIG. 45, according to another embodiment of the invention.
Figure 51:
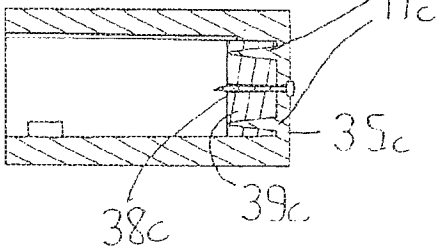
FIG. 51 is a section view of that shown in FIG. 50, taken through plane P-P.
Figure 50:
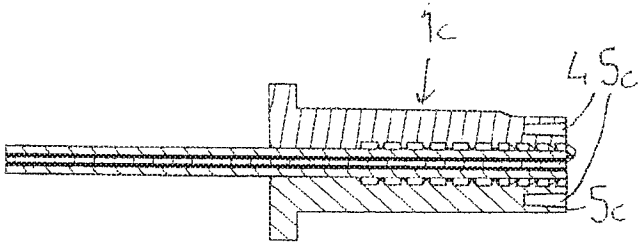
FIG. 50 is an end view of that shown in FIG. 49.
Figure 50:
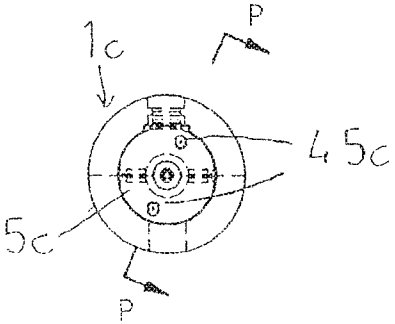

The embodiment of FIGS. 49 to 51 shows that piercers 11*c* can be provided by a socket 30*c* rather than a plug 1*c*. Two piercing spikes 11*c* extend from a socket end wall 35*c* within a rupturable membrane 38*c* containing sealant 39*c*. The piercers 11*c* are receivable within recesses 45*c* located within a socket receiving end 5*c* of the plug 1*c*.

As seen in FIGS. 9, 12, 13, 20, 21, 25 and 26, the connection apparatus 23 includes a guide for aligning the plug body 2 with the socket main body 32 and guiding it axially within the opening 31 in the socket 30. The guide is in the form of a key 50 and keyway 51 arrangement, whereby a key 50 comprising two parallel ridges extending longitudinally along the outside face 4 of the plug body 2 (best seen in FIG. 12) is receivable within a keyway 51 comprising a longitudinal passage extending as a groove within the inner face 34 of the socket main wall 32 (best seen in FIG. 9).

As seen in FIGS. 9, 12, 13, 20, 21, 25 and 26, the connection apparatus includes an engagement formation enabling the plug body 2 to be received within an opening 31 in the socket 30 and to be held or locked in place within the socket opening 31. The engagement formation as depicted includes the outside face 4 of the plug body 2 having teeth 55 (not all of which have been labelled) that engage teeth 56 located at the main body inner face 34 (see FIG. 26). The teeth 55, 56 are in the form of a pawl and ratchet arrangement whereby the teeth 56 of the pawl 56 engage the ratchet teeth 55 as the plug body 2 is inserted into the socket opening 31. The pawl 56 is hinged to the main body 32 of the socket 30 via hinge 57 (see FIGS. 25 and 26) and the teeth of the pawl 56 extend adjacent the inner face 34 of the main body 32 within the keyway passage 51 to thereby engage the teeth 55 that are present on the outside face 4 of the plug body 2—which teeth 55 are located between the key 50 ridges. As the plug body 2 is inserted into the socket opening 31, the teeth 55 on the plug body 2 lift the teeth 56 of the pawl out of engagement by way of its hinge 57. However, when the teeth 56 of the pawl engage the teeth 55 of the plug body 2, because the teeth 55, 56 extend directionally, the plug body 2 is unable to be removed from the socket 30 unless the pawl teeth 56 are manually disengaged from the teeth 55 of the plug body 2.

In the embodiment shown in FIGS. 43, 44 and 45, the connection apparatus 23*a* lacks a guide and has a different type of engagement formation enabling the plug body 2*a* to be received within an opening 31*a* in the socket 30*a* and to be held or locked in place within the socket opening 31*a*. The engagement formation as depicted includes the outside face 4*a* of the plug body 2*a* having circumferentially extending teeth/ridges 65*a* that engage teeth/ridges 66*b* located at the main body inner face 34*a*. The teeth 66*a* located at the main body inner face 34*a* are in the form of a hinged pawl 66*a*, essentially as described above.

In FIGS. 9, 18-20, 21-26, 43-48 and 49-51, the socket 30 contains a conductor 37 and can convert the plug assembly 23 into a type of electrical plug that can then be plugged into an external or internal socket of an electrical appliance, equipment or device, for example. An electrical appliance, equipment or device includes, but is not limited to, anything of an electrical or electronic nature, or anything used in the transfer or transmission of data. An electrical appliance, equipment or device includes a major appliance, microcontroller, power tool or small appliance, or a component part of an electrical distribution system such as an electric switchboard, distribution board, circuit breaker or disconnect, electricity meter or transformer. It is also possible that the plug assembly 23 could be plugged directly into an electrical appliance, equipment or device that contains key features of the socket 30.

Referring now to FIGS. 38-41, there is shown the socket 30 of FIG. 25 but when connected to or part of an electrical appliance, equipment or device 68 and the electrical appliance, equipment or device 68 is generally depicted as a rectangle in broken lines. The conductive spike 37 can be soldered or otherwise electrically connected to circuitry of the appliance, equipment or device 68.

Figure 41:
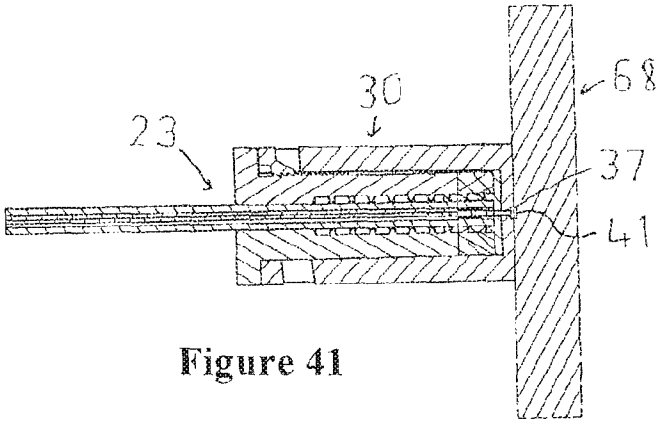
FIG. 41 is a section view of that shown in FIG. 39, taken through plane K-K.

Alternatively, the socket 30 itself can be plugged into a further external or internal electrical socket of an electrical appliance, equipment or device 68—in which case the socket 30 would become an electrical plug of sorts whereby conductive spike head 41 becomes the electrical contact point of the new plug (see FIG. 41).

Figure 20:
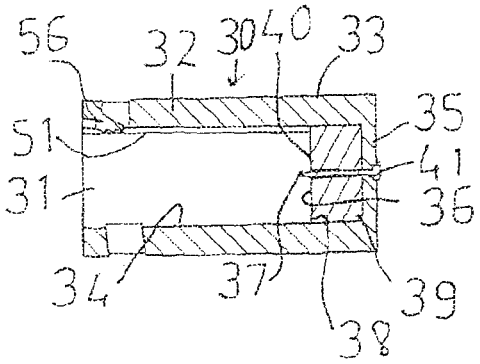
FIG. 20 is a section view of the socket shown in FIG. 18, taken through plane F-F.
Figure 27:
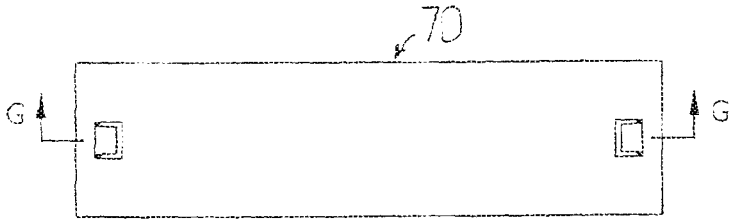
FIG. 27 is a top view of a dual socket, according to an embodiment of the present invention.
Figure 28:
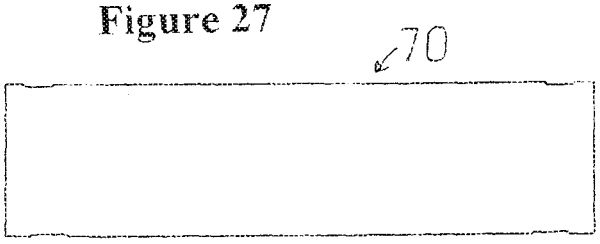
FIG. 28 is a front view of the socket shown in FIG. 27.
Figure 29:
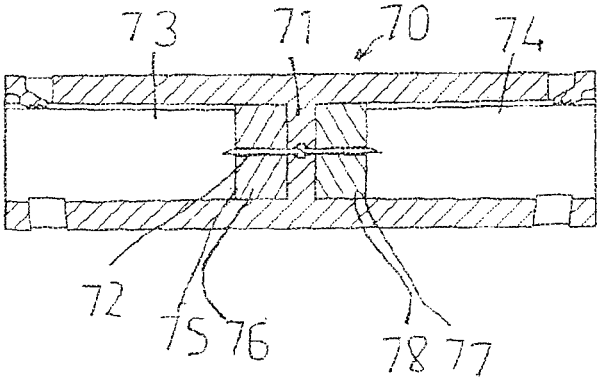
FIG. 29 is a section view of the socket shown in FIG. 27, taken through plane G-G.
Figure 30:
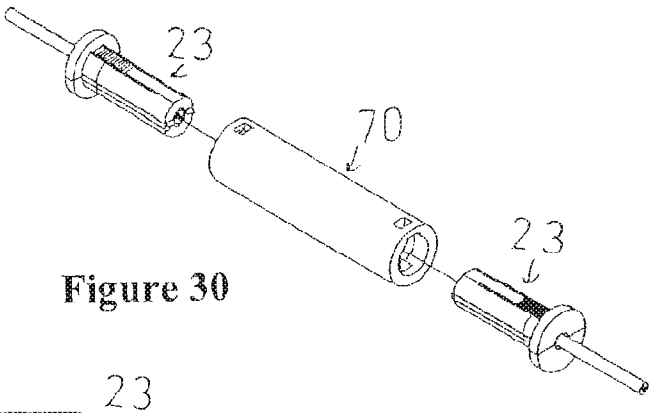
FIG. 30 is an exploded isometric view of a dual socket assembly receiving two plug assemblies as shown in FIG. 12, to form a connection apparatus.
Figure 35:
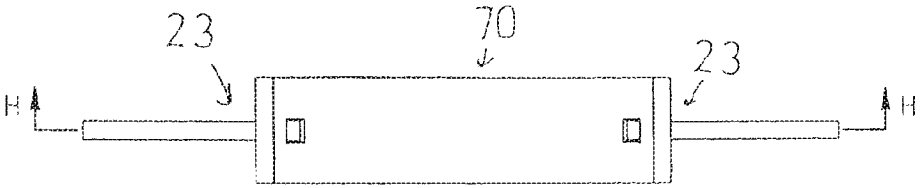
FIG. 35 is a top view of that shown in FIG. 31 except that both plug assemblies have been fully received within the sockets.
Figure 36:
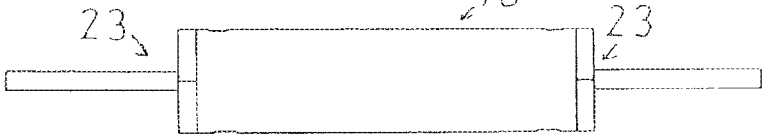
FIG. 36 is a front view of that shown in FIG. 35.

Referring now to FIGS. 27-37, there is shown the socket 30 of FIGS. 20 and 25 but configured as a double unit 70 (ie. a socket assembly). That is, a socket like the socket 30 of FIG. 20 or FIG. 25 is connected end wall to end wall—which in fact becomes a median wall 71—and a conductive penetrator spike/conductor 72 extends from one blind end of an opening 73 to the other 74. The double socket 70 can be used to electrically connect a wire 20 from a first plug assembly 23 to a wire 20 of a second plug assembly 23 in a waterproof manner. However, it is possible to omit the rupturable membranes 75, 77 and sealant 76, 78, in which case the connection may not be waterproof.

FIGS. 54, 55*a* and 55*b* show the double socket 70 of FIG. 37 but further having a closure 79 for enclosing a wire 20. The closure 79 is in the form of a cap that extends over an end of the plug assembly 23 and friction fits to the outer face 33 of the main body 32 of the socket 30. The closure 79 is particularly useful for isolating a live wire/conductor, such as for a circuit breaker and can, of course, be used in a single socket arrangement.

Figure 52:
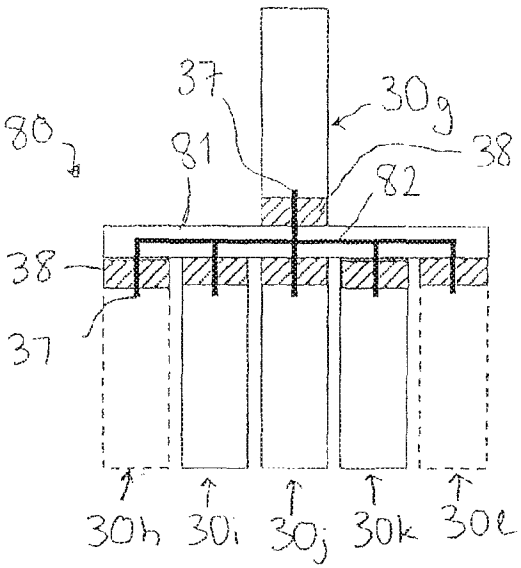
FIG. 52 is a detailed plan view of a socket assembly comprising a plurality of sockets like that shown in FIGS. 20 and 25 (but only shown in part), all being electrically connected together, according to an embodiment of the present invention.

Referring now to FIG. 52, there is shown a detailed plan view of a socket assembly 80 comprising a plurality of sockets 30*g*, 30*h*, 30*i*, 30*j*, 30*k*, 30*l* essentially like the socket 30 shown in FIGS. 20 and 25 (but only shown in part), all being connected mechanically and electrically together. Each socket 30 includes a penetrator/conductor 37 and rupturable membrane or bladder 38. The assembly 80 comprises an interconnecting body 81 and an interconnecting conductor 82. In this way, the penetrator/conductor 37 of each socket 30 is electrically connected together. Each socket 30 can receive a plug like plug 2 or plug assembly like plug assembly 23. The sockets 30*h*, 30*l* are shown in broken lines as they represent any suitable number of sockets.

Figure 53:
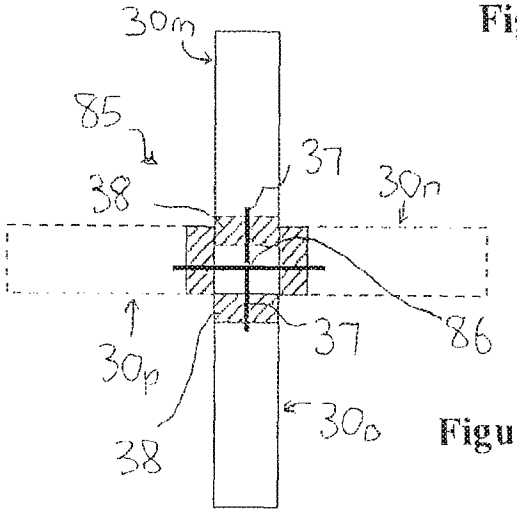
FIG. 53 is a detailed plan view of a socket assembly comprising a plurality of sockets like that shown in FIGS. 20 and 25 (but shown in part), all being electrically connected together, according to an embodiment of the present invention.
Figure 38:
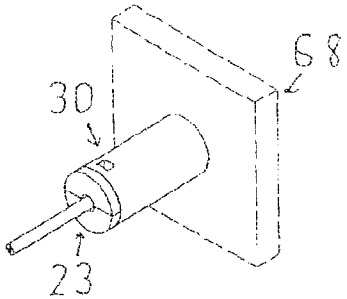
FIG. 38 is an isometric view of a socket that is part of an electrical appliance, equipment or device, according to another embodiment of the invention.
Figure 39:
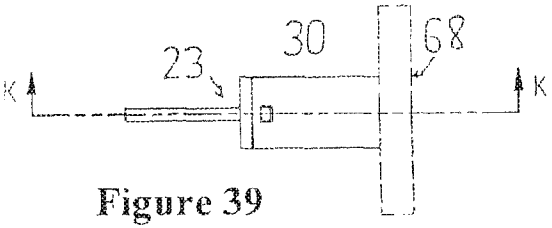
FIG. 39 is a top view of that shown in FIG. 38.
Figure 40:
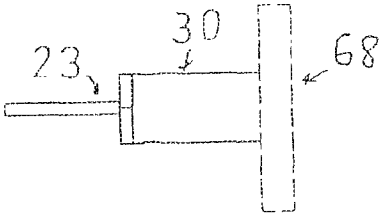
FIG. 40 is a side view of that shown in FIG. 38.

Referring now to FIG. 53, there is shown a detailed plan view of a socket assembly 85 comprising a plurality of sockets 30*m*, 30*n*, 30*o*, 30*p*, essentially like the socket 30 shown in FIGS. 20 and 25 (but only shown in part), all being connected mechanically and electrically together. Each socket 30 includes a penetrator/conductor 37 and rupturable membrane or bladder 38. The assembly 85 comprises interconnecting ends and an interconnecting conductor 86. In this way, the penetrator/conductor 37 of each socket 30 is electrically connected together. Each socket 30 can receive a plug like plug 2 or plug assembly like plug assembly 23. The sockets 30*n*, 30*p* are shown in broken lines as they represent any suitable number of sockets.

Advantages of the present invention as exemplified include:

1. Waterproof electrical connections between wires and/or an electrical appliance, equipment or device can be readily made, which can be particularly important in corrosive marine environments (where fires have been known to occur due to voltage leaks).

2. Waterproof electrical connections can be miniaturised by way of the plug and socket design.

3. The socket 30 itself can function as an electrical plug.

4. Components of the socket 30 can be incorporated within an electrical appliance, equipment or device.

5. No pre-stripping of the wire 20 is necessary because the conductive penetrator 37 can penetrate the sheath as well.

6. Possible contamination of the wire end by fingers is avoided once it has been clamped within the plug because the wire need not be trimmed nor twisted by the user.

7. The plug body can be of unitary construction, and thereby easy to manufacture by way of plastic moulding.

8. The plug/passage can be sized to accommodate wires of differing gauge.

9. Since the wire 20 is pre-clamped in the plug 2, the wire can easily be brought into electrical contact with a conductor 37, simply by inserting the plug 2 into the socket 30.

Referring now to FIGS. 56 to 66, there is shown a connection apparatus 100 including a plug 101 and socket 102. The plug 101 includes a plug body 104 and a sealing arrangement which in this embodiment renders the connection fluid-tight (waterproof). However, this need not be the case.

The plug 101 together with the wire 105 form a plug assembly.

The wire 105 in this example has a conductive filament interior 106 and an insulating sheathed exterior 107, as best seen in FIG. 66.

As seen in FIGS. 56 to 60, the plug 101 includes a plug body 110 and a sealing arrangement that incudes first 111 and second O-ring sealing members 112 and an optional sealing formation 113.

The plug body 110 has an inside face 114, an outside face 115, a socket receiving end 116 (plug end wall 116) and an enlarged flanged gripping head 117 (for pliers) at an opposing end 117. The plug 101 includes a passage 120 extending axially through the plug body 110, including the plug end wall 116 and head 117, for snugly receiving a wire 105, a gripping formation 121 extending inwardly from the inside face 114 for gripping the wire 105 when located within the passage 120, a groove 125 for containing the first O-ring 111, and the second O-ring 112 extending around the plug body 110, and the optional sealing formation 113 extending around the inside face 114 of the plug body 110 to further seal against fluid (such as air) from flowing between an outer periphery of the wire 105 and the inside face 114.

The passage 120 extends centrally along a longitudinal axis of the plug body 110, completely through the plug body 110, including the plug end wall/socket receiving end 116.

Alternatively, an end of the passage 120 at the socket receiving end 116 could be blind or substantially blind, so as to completely or substantially isolate and insulate an end of the wire 105 for a non-electrical connection with the socket 102. If blind, the socket 102 can simply help isolate an end of the wire 105 from electrical contact or the elements, such as rain or moisture. Alternatively, the socket 102 could be used as a means of labelling/identifying the wire/nature of the wire/intended purpose for the wire 105.

The diameter of the passage 120 will vary in accordance with the gauge of the wire, such that the fit is snug.

The gripping formation 121 has tapered teeth 121*a* (barbs) extending as circumferential pointed ridges around the inside face 114, and spaced apart from one another along the inside face 114 relative to the longitudinal axis (not all of the teeth 121*a* have been labelled). Sharp edges of the teeth 121*a* are pointed towards the socket receiving end 116 so as to prevent or minimise the risk of the wire 105 being pulled out of the passage 120 in an axial direction.

The teeth 121*a* may or may not deflect when gripping or biting the wire 105. That is, the teeth 121*a* may be flexible or rigid in differing circumstances depending on the nature of the wire—for example, whether insulated or not, and whether flexible or malleable or not. The teeth 121*a* as illustrated can grip or bite into the exterior insulating coat or sheath 107 of the wire 105 (as described for earlier embodiments).

The sealing formation 113, which is optional, has ridges extending as circumferential pointed ridges/teeth around the inside face 114, and spaced apart from one another along the inside face 114 relative to the longitudinal axis (the sealing formation ridges/teeth have not been labelled). The pointed ridges/teeth contact an outer periphery of the wire 105.

As seen in FIG. 59, the plug body 110 comprises two substantially identical body halves 110*a*, 110*b* that are hinged together at the socket receiving end 116 by way of two live hinges/fold lines 425 (shown in FIG. 59). The plug body 110 is configurable in a first wire-receiving configuration so that a wire 105 can be snugly seated within part of the passage 120 so that an end of the wire 105 sits flush with the plug end wall 116. The plug body 110 is configurable in a second clamping configuration so that the plug body 110 can clamp to and retain the wire 105 within the passage 120 after the plug 100 has been received within a socket 102. The plug body 110 is in the form of a cylindrical sleeve/tube extending around the wire 105 when in the second clamping configuration. Clamping of the wire 105 is most clearly shown in FIGS. 62 to 66. Although the plug 100 can be manufactured in a form as shown in FIG. 59 and then manipulated into the form shown in FIG. 60, it is to be understood that the plug 100 may be manufactured in a different form from that shown in FIG. 59.

The plug 100 as illustrated is of unitary construction and is made of moulded plastics material having a Shore D hardness of approximately 85+, or 100-120R Rockwell.

Referring now to FIGS. 56-58 and 61-66, there is shown in a socket 102 for receiving the plug assembly, according to embodiment of the present invention. The socket 102 includes an opening 130 extending axially within a main body 131 for receiving the socket receiving end 116 of the plug body 110. The main body 131 is in the form of a sleeve and has an outer 133 and an inner face 134 that extends around the opening 130. The socket 102 has an end wall 135 that borders a blind end 136 of the opening 130. The other end of the socket 102 is flared and incudes an internal stepped shoulder/cavity 139.

The socket main body 131 and end wall 135 can be made of any suitable non-conductive material or materials such as plastics material, rubber, carbon fibre, insulated metal or ceramics material. The socket main wall and end wall are preferably made of plastics material, and may have a Shore D hardness of approximately 85+ or 100-120R Rockwell.

The socket 102 as illustrated is for making a waterproof electrical connection. To that end, the socket 102 includes a conductive penetrator 137 (conductor) in the form of a conductive spike 137.

The conductive spike 137 has a sharpened end 140 (see FIG. 58) extending within the opening 130 that is capable of penetrating the conductive filament 106 of the wire 105 (and outer insulating coating/sheath 107, if required). Another end of the conductive spike 137 extends through the end wall 135 in a sealed manner and has an enlarged head (electrical contact point) 141 that protrudes slightly from the end wall 135.

The connection apparatus 100 includes an engagement formation enabling the plug body 110 to be received within an opening 130 in the socket 102 and to be held or locked in place within the socket opening 130. The engagement formation as depicted includes the inner face 134 having circumferentially spaced locking flanges/tabs 150 (not all of which have been labelled) that engage a groove 151 in the flange 152 of the gripping head 117 of the plug body 110.

In use, the first sealing member 111 is threaded onto the wire 105, and the wire 105 is placed within the passage 120 such that an end of the wire 105 is situated at end 116 and the first sealing member 111 locates within groove 125, as seen in FIG. 59. The plug body 110 is configured such that the two plug body halves 110*a*, 110*b* are brought together to clamp the wire 105. The second sealing member 112 is then threaded onto the plug body 110 and, using a pair of pliers that grip head 117, the plug 100 is moved into the socket opening 130. As the socket receiving end 116 of the plug 100 is moved toward the end wall 135 of the socket 102, the conductive spike 137 penetrates the wire 105 and the groove 151 in the flange 152 and tabs 150 extending from the socket main wall 131 engage and lock together. The second sealing member 112 seats within shoulder/cavity 139. In this way, the plug body 2 and electrical connection are rendered fluid-tight.

It is to be appreciated that the plug 110 can be used with the socket types as illustrated in the earlier figures.

Referring now to FIGS. 67 to 88, there is shown a connection apparatus 200 including a plug 201 and socket 202. The plug 201 includes a plug body 204 and a plug adapter 205 which in this embodiment renders the connection fluid-tight (waterproof). However, this need not be the case. The plug 201 together with a wire 206 form a plug assembly.

As seen in FIGS. 67 to 71, 82 and 88, the plug 204 includes a plug body 210 having an inside face 213, an outside face 214, a plug adapter receiving end 215 and an enlarged head (flange) 216 at an opposing end. The plug 201 includes a passage 207 extending axially through the plug body 210 including the plug adapter receiving end 215, for snugly receiving a wire 206, a gripping formation 218 extending inwardly from the inside face 213 for gripping the wire 206 when located within the passage 207, and an optional sealing formation 209 extending around the inside face 213 of the plug body 210 to seal against fluid (such as air or moisture) from passing between an outer periphery of the wire 206 and the inside face 213.

Alternatively, an end of the passage 207 at the enlarged end 216 could be blind or substantially blind, so as to completely or substantially isolate and insulate an end of the wire 206 for a non-electrical connection with the socket 202. If blind, the socket 202 can simply help isolate an end of the wire 206 from electrical contact or the elements, such as rain or moisture. Alternatively, the socket 202 could be used as a means of labelling/identifying the wire/nature of the wire/intended purpose for the wire.

The diameter of the passage 207 will vary in accordance with the gauge of the wire, 206 such that the fit is snug.

The plug body 210 narrows in an axial direction from the enlarged end 216 to the adapter receiving end 215.

The gripping formation 218 has tapered teeth 218*a* (barbs) extending as circumferential pointed ridges around the inside face 213, and spaced apart from one another along the inside face 213 relative to the longitudinal axis (not all of the teeth 218*a* have been labelled). Sharp edges of the teeth 218*a* are pointed towards the enlarged end 216 so as to prevent or minimise the risk of the wire 206 being pulled out of the passage 207 in an axial direction.

The teeth 218*a* may or may not deflect when gripping or biting the wire 206. That is, the teeth 218*a* may be flexible or rigid in differing circumstances depending on the nature of the wire—for example, whether insulated or not, and whether flexible or malleable or not. The teeth 218*a* as illustrated can grip or bite into the exterior insulating coat or sheath of the wire 206.

The sealing formation 209 has ridges extending as circumferential pointed ridges/teeth 209*a* around the inside face 213, and spaced apart from one another along the inside face 213 relative to the longitudinal axis (not all of the sealing formation ridges/teeth 209*a* have been labelled). The pointed ridges/teeth 209*a* contact an outer periphery of the wire 206.

As seen in FIGS. 68 to 71, the plug body 210 comprises two substantially identical body halves 210*a*, 210*b* that are hinged together at the enlarged end 216 by way of two live hinges/fold lines 220. FIG. 67 (note: does not illustrate the hinges) shows that the plug body 210 is configurable in a first wire-receiving configuration so that a wire 206 can be snugly seated within the passage 207 so that an end of the wire 206 sits flush with the enlarged end 216, and FIG. 88 shows that the plug body 210 is configurable in a second clamping configuration so that the plug body 210 can clamp to and retain the wire 206 within the passage 207 after the plug 201 has been received within a plug adapter 205. The plug body 210 is in the form of a cylindrical sleeve/tube extending around the wire 206 when in the second clamping configuration and narrows in diameter in an axial direction from the enlarged head 216 to the plug adapter receiving end 215. Clamping of the wire 206 is most clearly shown in FIG. 88. Although the plug 201 can be manufactured in a form as shown in FIG. 68 and then manipulated into the form shown in FIG. 71, it is to be understood that the plug 201 may be manufactured in a different form from that shown in FIG. 1.

The plug body 210 as illustrated is of unitary construction and is made of moulded plastics material having a Shore D hardness of approximately 85+, or 100-120R Rockwell.

As seen in FIGS. 72 to 76, the plug adapter 205 includes a barrel portion 230, a wire-receiving portion 231 and a sealing arrangement comprising first 232 and second 233 sealing members.

The barrel portion 230 includes a barrel wall 235 and an open-ended chamber 236. The chamber 236 narrows in an axial direction from the enlarged end 216 of the plug body 210 to the wire-receiving portion 231.

The wire-receiving portion 231 includes a wire-receiving passage 240 for receiving a wire 206. The wire-receiving portion 231 includes an enlarged end, comprising a circumferentially extending flange 242 and a cuboid body 243 enabling gripping by fingers or a pair of pliers. The wire-receiving passage 240 can be used to determine whether a wire is of an appropriate gauge/diameter.

As seen in FIG. 88, the first sealing member 232 is an O-ring that extends around the wire 206 within a cavity 245 of the plug adapter 205 adjacent the plug adapter engaging end 215 between the chamber 236 and the wire-receiving passage 240, for preventing fluid movement from the wire-receiving passage 240 to the plug body 210.

The second sealing member 233 is an O-ring that extends around the barrel wall 235, between the barrel wall 235 and socket 202, for preventing the entry of fluid into the socket 202. The second sealing member 233 extends around the barrel wall 235 adjacent the flange 242 of the wire-receiving portion 231, and is locatable within a cavity 250 of a socket main body 251.

The plug 201 also includes an engagement formation for holding the plug body 210 within the chamber 236. The engagement formation includes a groove 451 in the barrel wall 235 (best seen in FIGS. 74 and 88) that receives circumferential flanges/locking tabs 452 of the plug body 210 (best seen in FIGS. 71 and 88).

Referring now to FIGS. 67, 77 to 80, and 83 to 88, there is shown a socket 202 for receiving the plug assembly. The socket 202 includes an opening 261 extending axially within a main body 251 for receiving the plug 201. The main body 251 is in the form of a sleeve and has an outer face 263 and an inner face 264 that extends around the opening 261 (see FIG. 79). The socket 202 has an end wall 265 that borders a blind end 266 of the opening 261.

An end of the socket main body 251 is flared, providing a stepped interior and adjacent cavities 250, 270 for receiving the second O-ring 233 and flange 242 of the wire-receiving portion 231. This is best seen in FIGS. 79 and 88.

The socket main body 251 and end wall 265 can be made of any suitable non-conductive material or materials such as plastics material, rubber, carbon fibre, insulated metal or ceramics material. The socket main body 251 and end wall 265 are preferably made of plastics material, and may have a Shore D hardness of approximately 85+ or 100-120R Rockwell.

The socket 202 as illustrated is for making a waterproof electrical connection. To that end, the socket 202 includes a conductive penetrator 280 (conductor) in the form of a conductive spike 280. The conductive spike 280 has a sharpened end 281 (see FIG. 79) extending within the opening 261 that is capable of penetrating the conductive filament of the wire 206 (and outer insulating coating/sheath, if required). Another end of the conductive spike 282 extends through the end wall 265 in a sealed manner and has an enlarged head (electrical contact point) 282 that protrudes slightly from the end wall 265 (see FIGS. 79 and 88).

The connection apparatus includes an engagement formation for holding the plug 201 within the socket 202. The engagement formation includes a groove 290 that extends along the flange 242 of the wire-receiving portion 231 (best seen in FIGS. 74 and 88) that receives circumferentially spaced flanges/locking tabs 292 that extend from the socket main body 251 (best seen in FIGS. 67, 79, 80 and 88).

In use, a wire 206 is threaded through the wire-receiving passage 240 of the plug adapter 205, as seen in FIG. 81. The wire-receiving passage 240 can be used as a check that the wire is of an appropriate diameter. As seen in FIG. 82, the wire 206 is threaded through the second 233 and first 232 sealing members, and the wire 206 is then placed within the plug body 210 such that the first sealing member 232 locates adjacent the plug adapter receiving end 215. The plug body 210 is then configured such that the two plug body halves 210*a*, 210*b* are brought together to clamp the wire 206. The plug body 210 is then slid into the chamber 236 such that the adapter receiving end 215 abuts a blind end of the chamber 236, and the first sealing member 232 is trapped between the adapter receiving end 215 and the wire-receiving portion 231. The enlarged end 216 of the plug body 210 abuts an end of the barrel wall 235. As the plug body 210 is slid into the chamber 236, the engagement formation 251, 252 locks the plug body 210 within the chamber 236.

As a socket receiving end 295 of the plug 201 (enlarged end 216 of the plug body 210) is moved toward the end wall 265 of the socket 202, the conductive spike 280 penetrates the wire 206 and the groove 290 in the flange 242 and tabs 292 extending from the socket main wall 251 engage and lock together. The second sealing member 233 seats within the cavity 270. In this way, the plug body 210 and electrical connection are rendered fluid-tight.

It is to be appreciated that the plug 201 can be used with the socket types as illustrated in the earlier figures.

Further advantages of the present invention as exemplified in FIGS. 67-88 include:

1. The connection can be waterproof, so no exposure of the wire to the atmosphere.
2. No trimming of the wire is necessary because the conductive penetrator can penetrate the sheath as well.
3. The connection can be safely, efficiently and easily made, using only a pair of pliers (at most).
4. The connection apparatus can be used to isolate a live wire.
5. The electrical connection can be wire-to-wire or wire to electrical contact.
6. The wire-receiving passage of the wire-receiving portion can be used to check wire diameter.
7. The connection apparatus can be readily disassembled and reused.
8. The connection apparatus requires no chemical sealant for waterproofing.

Referring now to FIGS. 89-117, there is shown a plug 301 for clamping a wire 320, that together with the wire 320 form a plug assembly 323 (see FIG. 117), according to an embodiment of the invention. A wire 320 in this example has a conductive filament interior 321 and an insulating sheathed exterior 322, as best seen in FIGS. 114 and 115.

The plug 301 includes a plug body 302 having an inside face 303, an outside face 304, a socket receiving end 305 (plug end wall 305) and an enlarged head (flange) 306 at an opposing end. The socket receiving end 305 is D-shaped when viewed in end elevation. The enlarged head 306 is in the shape of a rectangle when viewed in end elevation. The plug 301 includes a passage 307 extending axially through the plug body 302, including the plug end wall 305, for snugly receiving a wire 320, as well as a gripping formation comprising teeth 308 extending inwardly from the inside face 303 for gripping the wire 320 when located within the passage 307.

The passage 307 extends centrally along a longitudinal axis of the plug body 302, completely through the plug body 302, including the plug end wall/socket receiving end 305. In this embodiment the passage 307 is shaped to receive a wire 320 of circular cross-section.

Alternatively, an end of the passage 307 at the socket receiving end 305 could be blind or substantially blind, so as to completely or substantially isolate and insulate an end of the wire 320 for a non-electrical connection with the socket. If blind, the socket can simply help isolate an end of the wire from electrical contact or the elements, such as rain or moisture. Alternatively, the socket could be used as a means of labelling/identifying the wire/nature of the wire/intended purpose for the wire.

The diameter of the passage 307 will vary in accordance with the gauge of the wire, such that the fit is snug.

The gripping formation 308 has tapered teeth (barbs) extending as circumferential pointed ridges around the inside face 303, and spaced apart from one another along the inside face 303 relative to the longitudinal axis. Sharp edges of the teeth 308 prevent or minimise the risk of the wire 320 being pulled out of the passage 307 in an axial direction.

The teeth 308 may or may not deflect when gripping or biting the wire 320. That is, the teeth 308 may be flexible or rigid in differing circumstances depending on the nature of the wire—for example, whether insulated or not, and whether flexible or malleable or not. The teeth 308 as illustrated can grip or bite into the exterior insulating coat or sheath 322 of the wire 320.

The plug body 302 resembles a longitudinally split tube or longitudinally split sleeve. The plug body 302 comprises two similar body portions 500 that are connected together at the socket receiving end 305. In one sense, the body portions 500 are hinged at/to the socket receiving end 305 by way of a hinge or hinge region. In this regard, see FIG. 116. In another sense, the body portions 500 are connected at the socket receiving end 305 and can be bent or flexed relative to the socket receiving end 305. Again, see FIGS. 116 and 117 (arrow pairs) as to how the body portions 500 can be moved relative to a central axis 501 of the plug body 302 along which the passage 307 extends.

FIG. 116 shows that the plug body 302 is configurable in a first wire-receiving configuration so that a wire 320 can be snugly seated within part of the passage 307 so that an end of the wire 320 sits flush with the plug end wall 305. As seen in FIG. 116, the two plug body portions 500 can the moved or flexed away from the central axis 501 so as to receive a wire 320.

FIGS. 115 and 117 shows that the plug body 302 is configurable in a second clamping configuration so that the plug body 302 can clamp to and retain the wire 320 within the passage 307 after the plug 501 has been received within a socket 330. The plug body 302 is in the form of a split sleeve/tube extending around the wire 320 when in the second clamping configuration.

An outer diameter of the plug body 302 slightly reduces as it extends from the enlarged head 306 towards the socket receiving end 305 (plug end wall 305).

The plug 301 as illustrated is of unitary construction and is made of moulded plastics material having a Shore D hardness of approximately 85+, or 100-120R Rockwell.

Referring now to FIGS. 97 to 104, there is shown a plug 301*a* for clamping a wire 320, that together with the wire 320 form a plug assembly 323 (see FIG. 117), according to an embodiment of the invention.

The plug 301*a* is in most respects identical to plug 301 and operates in the same manner, except that plug 301*a* has an enlarged head (flange) 306*a* that is D-shaped when viewed in end elevation, much like the end wall 305*a*.

Referring now to FIGS. 105-113 and 115, there is shown a dual socket 330 for receiving two plug assemblies 323, according to an embodiment of the present invention. That is, the dual socket 330 can be used to connect two wires together. The dual socket 330 will be chiefly described below as comprising two individual sockets 330*a*, 330*b* having a shared end wall 335 and a shared conductive penetrator 337.

Each socket 330 includes an opening 331*a*, 331*b* extending axially within a main body 332*a*, 332*b* for receiving the socket receiving end 305 of the plug body 302. The main body 332*a*, 332*b* is in the form of a sleeve and has an outer face 333*a*, 333*b* and an inner face 334*a*, 334*b* that extends around the opening 331*a*, 331*b*. Each socket 330*a*, 330*b* has an end wall 335 that borders a blind end 336*a*, 336*b* of the opening 331*a*, 331*b*.

The socket main body 332 and end wall 335 can be made of any suitable non-conductive material or materials such as plastics material, rubber, carbon fibre, insulated metal or ceramics material. The socket main wall and end wall are preferably made of plastics material, and may have a Shore D hardness of approximately 85+ or 100-120R Rockwell.

A diameter of each opening 331*a*, 331*b* slightly reduces as it extends (in an axial direction) towards the end wall 335, so as to assist with insertion of the plug body 302 and with manufacturing—ie. to alleviate stickiness during the moulding process.

The conductive penetrator 337 (conductor) is in the form of a conductive spike 337. The conductive spike 337 has a sharpened end 340*a*, 340*b* extending within the opening 331*a*, 331*b* that is capable of penetrating the conductive filament 321 of the wire 320 (and outer insulating coating/sheath 322, if required). A central region of the conductive spike 337 extends through the end wall 335 in a sealed manner, as best seen in FIG. 113.

As can be inferred from FIGS. 96 and 104 and FIG. 105, the plugs 301, 301*a* and socket openings 331*a*, 331*b* are shaped such that the plugs 301, 301*a* can only be inserted into the socket openings 331*a*, 331*b* in a particular orientation. This is because they are each generally D-shaped when viewed in end elevation.

As seen in FIGS. 96, 104, 105 and 106, the connection apparatus includes at least one engagement formation enabling the plug body 302 to be received within an opening 331*a*, 331*b* in the socket 330*a*, 330*b* and to be held or locked in place within the socket opening 331*a*, 331*b*. The engagement formation as depicted includes the outside face 304 of the plug body 302 having a flexibly resilient tooth 350 that engages and locks within an opening 351*a*, 351*b* in the socket main body 332*a*, 332*b*. The plug body 302 has an opening 354 situated between the tooth 350 and flange 306 and extending beneath the tooth 350 that enables the tooth 350 to flex relative to the plug body 302. That is, when first pushing the plug body 302 into the socket, the tooth 350 flexes from its resting position due to the force exerted by the socket main wall 332 towards the wire 320. However, when the tooth 350 engages the opening 351 in the socket main body 332, then the tooth 350 springs back into its resting position and locks within the opening 351. That is, an edge, shoulder of the tooth 350 abuts an edge of the opening 351 to prevent the plug body 302 from being pulled out from within the socket 330. However, the plug body 302 can be removed from the socket 330 after disengaging the tooth 350 from the opening 351 using a pointed instrument.

The connection between the plug assemblies 323 and socket 330*a*, 330*b* can be rendered waterproof by dipping the wire/end of the wire 320 into a chemical sealant, holding the wire 320 within the plug body 302, applying chemical sealant to the outside face of the plug body 302, and inserting the plug body 302 into the socket 330. Once the chemical sealant has dried/set/cured, the connection may be fluid-tight/waterproof.

The sealant is preferably insoluble, non-conducting, corrosion resistant and adhesive. It is preferably a liquid, although it need not be free-flowing. The term includes all types of sealants usually used for electrical work, including adhesives, cements, pastes and other settable materials. Examples include silicone-based sealants, drying adhesives, contact adhesives, one-part adhesives and multi-part adhesives (polyester resin—polyurethane resin, polyols—polyurethane resin, and acrylic polymers—polyurethane resins). This list is by no means exhaustive.

In use, the two body portions 500 of the plug body 302 are flexed apart by hand or as a wire 320 is inserted into the passage 307, as indicated by FIG. 116. A wire 320 is then moved between the body portions 500, hard up against the end wall 305, as shown in FIG. 117, to make a plug assembly 323. The two body portions 500 are then held together by hand or using a pair of pliers. The plug assembly 323 is then inserted into a socket opening 331 in an allowable orientation. As the plug assembly 323 slides within the socket opening 331 into contact with the penetrator 337, the sharpened end 340 of the penetrator 337 penetrates the conductive filaments 321 of the wire 320. When the plug body has reached the end of the passage 307, the locking tooth 350 engages the opening 351 and locks the plug 301 within the socket 330. If desired, the connection between the plug assemblies 323 and socket 330*a*, 330*b* can be rendered waterproof by dipping the wire/end of the wire 320 into a chemical sealant, holding the wire 320 within the plug body 302, applying chemical sealant to the outside face of the plug body 302, and inserting the plug body 302 into the socket 330. In this way a connection apparatus is made.

It is to be appreciated that the plug 301, 301*a* can be used with sockets generally of the type as illustrated in the earlier figures, including those of FIGS. 38 to 53.

Advantages of the present invention as exemplified include:

1. The connection can be fluid-tight, so no exposure of the wire to the atmosphere.

2. Waterproof electrical connections between wires can be readily made, which can be particularly important in corrosive marine environments (where fires have been known to occur due to voltage leaks).

3. Waterproof electrical connections can be miniaturised by way of the plug and socket design.

4. No pre-stripping or trimming of the wire is necessary because the conductive penetrator can penetrate the sheath as well.

5. Possible contamination of the wire end by fingers is avoided once it has been clamped within the plug because the wire need not be trimmed nor twisted by the user.

6. The plug body can be of unitary construction, and thereby easy to manufacture by way of plastic moulding.

7. The plug/passage can be sized to accommodate wires of differing gauge.

8. Since the wire is pre-clamped in the plug, the wire can easily be brought into electrical contact with a conductor, simply by inserting the plug into the socket.

9. The connection can be safely, efficiently and easily made, using only a pair of pliers (at most).

10. The connection apparatus can be used to isolate a live wire.

11. The electrical connection can be wire-to-wire.

12. The wire-receiving passage can be used to check wire diameter.

13. The connection apparatus can be disassembled and reused.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A plug adapted to hold a wire and to be received within a socket, said plug comprising: a plug body comprising at least two plug body portions that are connected to a plug body end; and a passage extending substantially along a central longitudinal axis of the plug body for receiving the wire, wherein:

the plug body is configurable in a first wire-receiving configuration so that the wire can be placed within the passage and a second clamping configuration so that the plug body can clamp to and retain the wire within the passage such that conducting strands of the wire extend substantially along the central longitudinal axis of the plug body;

the at least two plug body portions are moveable away from the central longitudinal axis into the first wire-receiving configuration, and are moveable towards the central longitudinal axis into the second clamping configuration; and wherein the plug body resembles a sleeve or tube split into longitudinal halves, whereby the plug body portions are connected at an end of the sleeve or tube.

2. The plug of claim 1, wherein the passage extends along the central longitudinal axis of the plug body completely through the plug body including substantially centrally through the plug body end.

3. The plug of claim 1, wherein the two plug body portions resemble a sleeve or tube split into longitudinal halves and are hinged at an end of the sleeve or tube.

4. The plug of claim 1, wherein the two plug body portions are similar, substantially identical or identical to each other.

5. The plug of claim 1, wherein the plug body portions are spaced or substantially spaced from each other when gripping the wire in the second clamping configuration.

6. The plug of claim 1, wherein the plug is of unitary construction.

7. A connection apparatus comprising the plug of claim 1 and the socket for receiving the plug.

8. A connection apparatus comprising two said plugs as defined in claim 1 and a double socket for receiving the plugs, wherein the double socket comprises at least one opening extending axially within a main body for receiving the plugs.

9. The plug of claim 1, wherein the plug body comprises an inside face and an outside face.

10. The plug of claim 9, wherein the plug comprises gripping formations extending inwardly from the inside face for gripping opposing sides of the wire when located within the passage.

11. The plug of claim 10, wherein each said gripping formation comprises one or more gripping teeth that: grip or bite into an exterior insulating coat or sheath of the wire; extend along the inside face of the plug body; and/or are pointed in a direction that prevents or minimises the risk of the wire being pulled out of the passage in an axial direction.

12. The plug of claim 10, wherein a first said gripping formation of a first said plug body portion is substantially identical to a second said gripping formation of a second said plug body portion.

13. The plug of claim 1, wherein each of the two plug body portions is hinged to the plug body end by way of at least one hinge or at least one hinge region.

14. The plug of claim 13, wherein each of the two plug body portions is connected to the plug body end such that each said plug body portion can be bent or flexed relative to the central longitudinal axis.

15. The plug of claim 9, wherein the inside face of a first said plug body portion is similar, substantially identical or identical to the inside face of a second said plug body portion.

16. The plug of claim 15, wherein when in the second clamping configuration the inside face has a cross-section shaped to snugly receive a said wire having a circular cross-section.

17. The plug of claim 1, wherein the end of the plug body is in the form of an end wall.

18. The plug of claim 17, wherein being hinged together at the end or end wall of the plug body enables both plug body portions to move towards the central longitudinal axis of the plug body so that the plug body clamps to and retains the wire within the passage.

19. The plug of claim 17, wherein being hinged together at the end or end wall of the plug body enables both of the plug body portions to move towards or away from the central longitudinal axis of the plug body when configuring the plug body.

20. A plug adapted to hold a wire and to be received within a socket, said plug comprising: a plug body comprising at least two plug body portions that are connected to a plug body end; and a passage extending substantially along a central longitudinal axis of the plug body for receiving the wire, wherein:

the plug body is configurable in a first wire-receiving configuration so that the wire can be placed within the passage and a second clamping configuration so that the plug body can clamp to and retain the wire within the passage such that conducting strands of the wire extend substantially along the central longitudinal axis of the plug body;

the at least two plug body portions are moveable away from the central longitudinal axis into the first wire-receiving configuration, and are moveable towards the central longitudinal axis into the second clamping configuration; and the two plug body portions resemble a sleeve or tube split into longitudinal halves and are hinged at an end of the sleeve or tube.

* * * * *